US008201919B2

(12) United States Patent
Mizoguchi et al.

(10) Patent No.: US 8,201,919 B2
(45) Date of Patent: Jun. 19, 2012

(54) INK-JET PRINTING APPARATUS AND METHOD OF CONTROLLING INK-JET PRINTING APPARATUS

(75) Inventors: Yoshito Mizoguchi, Kawasaki (JP); Hirokazu Yoshikawa, Kawasaki (JP); Yuji Konno, Kawasaki (JP); Daisaku Ide, Tokyo (JP); Hajime Nagai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 662 days.

(21) Appl. No.: 11/753,250

(22) Filed: May 24, 2007

(65) Prior Publication Data

US 2007/0279452 A1 Dec. 6, 2007

(30) Foreign Application Priority Data

May 31, 2006 (JP) ..... 2006-152690

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 4,130,126 A * 12/1978 Chocholaty et al. ..... 137/3
5,905,514 A 5/1999 Rhoads et al.
6,145,953 A * 11/2000 Medin ..... 347/28
6,244,685 B1 6/2001 Yamada et al.
6,530,642 B1 3/2003 Uchikata et al.
6,637,855 B2 10/2003 Ide et al.
6,669,327 B1 * 12/2003 Harper ..... 347/28
2005/0174382 A1 8/2005 Yoshikawa et al.
2007/0279451 A1 12/2007 Mizoguchi et al.

FOREIGN PATENT DOCUMENTS

JP 10-138502 5/1998
JP 2900272 B2 6/1999
JP 11-334074 12/1999
JP 11-342620 12/1999
JP 2001-341319 A 12/2001
JP 2002-166560 6/2002
JP 2002-246306 A 8/2002

OTHER PUBLICATIONS

Japan Patent Office, Office Action, Jun. 3, 2011 (issued in corresponding Japanese patent application No. 2006-152690).

* cited by examiner

*Primary Examiner* — Matthew Luu
*Assistant Examiner* — Alejandro Valencia
(74) *Attorney, Agent, or Firm* — Fitzpatrick, Cella, Harper & Scinto

(57) ABSTRACT

Image deterioration due to decrease in transfer amount, which arises when a remaining amount of wetting liquid for wet wiping is decreased, is reduced in an ink-jet printing apparatus. When the remaining amount of the wetting liquid decreases to reach a predetermined amount or less, a wetting liquid tank is moved down, and thereby an intrusion amount of a wiper into a transfer portion is made larger than a standard value. This increases an area of the wiper where the wiper comes into contact with the transfer portion, which allows the transfer amount to be maintained at a substantially same level as the reference value. This enables the transfer amount to be prevented from decreasing when the remaining amount decreases, and the transfer amount almost the same as that in an initial stage to be ensured even in a later stage of an apparatus life time.

6 Claims, 35 Drawing Sheets

CONSUMPTION AMOUNT OF WETTING LIQUID
(CONTACT TIME OF WIPER: 0.2 sec)

| TEMPERATURE (°C) | TRANSFER AMOUNT OF WETTING LIQUID (mg) |
|---|---|
| EQUAL TO OR HIGHER THAN 30°C | 0.6mg |
| 20~30°C | 0.5mg |
| 10~20°C | 0.2mg |
| 0~10°C | 0.1mg |

FIG.26A

CONSUMPTION AMOUNT OF WETTING LIQUID
(CONTACT TIME OF WIPER DEPENDS ON TEMPERATURE.)

| TEMPERATURE (°C) | CONTACT TIME OF WIPER (sec) | TRANSFER AMOUNT OF WETTING LIQUID (mg) |
|---|---|---|
| EQUAL TO OR HIGHER THAN 30°C | 0.1sec | 0.5mg |
| 20~30°C | 0.2sec | 0.5mg |
| 10~20°C | 2.2sec | 0.4mg |
| 0~10°C | 4.2sec | 0.3mg |

FIG.26B

ERROR

THE NUMBER OF PRINTED SHEETS REACHES
THE MAXIMUM NUMBER OF SHEETS FOR
WHICH THE PRINTER LASTS.
NO MORE PRINTING IS AVAILABLE.
CONTACT YOUR NEAREST SERVICE
CENTER FOR REPAIR.

FIG.28

WARNING

THE NUMBER OF PRINTED SHEETS IS ABOUT TO REACH THE MAXIMUM NUMBER OF SHEETS FOR WHICH THE PRINTER LASTS.
IF IT REACHES THE MAXIMUM NUMBER OF SHEETS OF THE PRINTER,
NO MORE PRINTING WILL BE AVAILABLE.

FIG.30

INK-JET PRINTING APPARATUS AND METHOD OF CONTROLLING INK-JET PRINTING APPARATUS

BACKGROUND OF THE INVENTION

1. Field of the Invention

The present invention relates to an ink-jet printing apparatus and a method for controlling thereof. More specifically, the present invention relates to wiping a surface (hereinafter referred to as the ejection opening formed face), on which ejection openings for ejecting ink in a printing head is formed, with a wiper to thereby maintain ejection performance.

2. Description of the Related Art

Printing apparatuses having functions as a printer, a copying machine, a facsimile, and the like, and printing apparatuses used as output equipment for complex electronic equipment including a computer and a word processor, a workstation, or the like is known. Such printing apparatuses are intended for use in printing images (including letters and symbols) onto a printing medium such as paper, cloth, a plastic sheet, or an OHP (overhead projector) sheet based on printing information. Among them, an ink-jet printing apparatus is intended for use in performing printing by ejecting ink onto a printing medium from a printing head. In this type of apparatus, the printing head is easily made compact, a high-resolution image can be printed at high speed, and printing can be performed onto plain paper without requiring special handling. This type of apparatus also has various other advantages such as a low running cost, low noise because of being a non-impact type, and easy printing of color images with the use of a wide variety of inks.

As an element for generating the energy to eject ink in a printing head, there exists an element that uses an electromechanical conversion element such as a piezo element, that utilizes the heat generation caused by irradiation of an electromagnetic wave such as a laser leading to the heat generation, that uses an electrothermal conversion element with a heat element, and the like. Among them, a printing head that uses the electrothermal conversion element can perform high-resolution printing because the ejection openings can be arrayed very densely. Also, the printing head using the electrothermal conversion element can be more easily made compact than the others; sufficiently utilize technological advances in the recent semiconductor field, the advantages of IC and micro process technologies of which reliability is significantly high; and this leads to high-density packaging more easily and lower manufacturing costs.

Furthermore, for various requirements for materials used as printing media, not only paper (including thin paper and treated paper), which is an ordinary printing medium, and a thin resin sheet (OHP, etc.), but also cloth, leather, non-woven cloth, even metal, and the like can be used as the printing media.

The above-described printing apparatuses can be roughly divided into a serial-type printing apparatus in which printing is performed while scanning is performed in a direction intersecting that of the conveying direction of the printing medium, and a full-line type printing apparatus in which a printing head arrayed with ejection openings according to a range in a width direction of the printing paper is held, and the printing medium is conveyed relative to the printing head to thereby perform printing. With the serial-type printing apparatus, an image is formed over the entire printing medium by repeated main scanning for printing the image with a printing head mounted on a carriage moving along the printing medium and conveying of a predetermined amount of paper (sub-scanning), after the printing medium is supplied to the predetermined printing position.

Meanwhile, with ink-jet printing apparatus, foreign matters such as ink droplets, dirt, dust, and paper powder may be attached to the surface of the printing head with a printing operation, and in order to remove such foreign matters, wiping (for example, wiping by rubbing) is performed. As a wiper (wiping member) used for the wiping, a flexible member such as a rubber blade made of a rubber-like elastic material is usually used. Also, ink near the ejection opening of the printing head may dry, causing clogging of the ejection opening due to thickening, fixing, or deposition of the ink. Further, the clogging of the ejection opening may occur due to air bubbles generated inside the ejection opening (liquid path), dust, or the like. As a system for recovering (preventing, eliminating, etc.) such clogging, a suction recovery operation is performed. That is, using a capping member to thereby form a closed system between the ejection opening formed face of the printing head and the member, and using a pump to thereby generate suction with negative pressure in the closed system cause the ink to be forcibly discharged from the ejection opening. Then, after the suction recovery operation has been performed, also the above-described wiping is performed. This can remove any ink attached to the ejection opening formed face due to the capping or the like.

Further, as the ink used in ink-jet printing apparatus, the use of aqueous dye ink had been mainstream. However, the dye ink does not adequately ensure so-called weather resistance such as resistance to light and gas because the molecules of the dye are very small, and therefore the problem of temporal color deterioration of the printed matter has existed, among others. For this reason, in recent years, aqueous pigment ink has been in practical use rather than the aqueous dye ink. The pigment ink being used now has a particle size of approximately 100 nm, which is considerably larger than the size of the dye molecules, so that even if it is affected by light or ozone, color deterioration of the color material is not significant, and the weather resistance of it is considerably better when compared with the dye ink.

However, with ink-jet printing head using such pigment ink, a problem may arise that is not significantly seen in an apparatus using the dye ink, regarding the wiping. That is, with the pigment ink, the period of time before thickening or fixing of the ink is shorter than in the case of the use where dye ink is used. Also, a cleaning-ability performed by scraping (or wiping) the pigment ink with the wiping member is lower than in the case where dye ink is used. For this reason, even if the ejection opening formed face of the printing head is wiped, the wiping may cause a thin film of the pigment ink to be formed on the ejection opening formed face, and furthermore the ink fixes in place, causing the problem that the effect of the wiping is of little use.

The pigment ink is ink in which hydrophilicity is given to pigment particles by pigment dispersions to thereby disperse them, or terminals of a structure itself of each of the pigment particles are made to have hydrophilic groups to thereby make them self-disperse in an aqueous solution, because the pigment particles are not generally dissolved in water. Accordingly, the ejection opening formed face gets wet easily with the pigment ink when the pigment ink is ejected from the printing head. Also, in the case of the ink using the dispersion materials such as resin, the resin easily wet the ejection opening formed face along with the pigment. Furthermore, performing the wiping while the pigment particles are present on the ejection opening formed face causes damage (such as scrapes) to the ejection opening formed face, which is also one of contributing factors causing the ejection opening formed face to get wet easily. Then, such wetting on the ejection opening formed face due to the pigment ink is nonuniformly formed, and the nonuniform wetting affects the ejected ink, causing defective ejection such as instability of an ejection direction.

For such a problem, there can be considered the use of a printing head in which a so-called water repellent treatment for repelling the pigment ink is given to the ejection opening formed face of the printing head. However, in the beginning of the use of the printing head, the problem such as the instability of the ejection direction does not arise, but if easily wetting ink such as the pigment ink is used, the water repellency is gradually deteriorated, resulting in the loss of the effect such as the stabilization of the ejection direction. The wiping also results in the spread of the easily wetting pigment ink on the ejection opening formed face, so that the water repellency becomes deteriorated.

Regarding the above problem, Japanese Patent Laid-Open No. 11-334074 (1999) describes that the periphery of the ejection opening of the printing head is made hydrophilic, which causes uniform wetting by the pigment ink, resulting in the prevention of the deviation in the ejection direction and the like due to nonuniform wetting. However, the effect of the hydrophilic treatment of the ejection opening formed face cannot be maintained for a long time, similarly to the water repellent treatment, but is deteriorated with time. Even if a relatively well-known UV ozone treatment or the like is given, the hydrophilic level is varied with time although hydrophilicity is exhibited immediately after the treatment.

Regarding the problem of such a variation in water repellent performance or hydrophilic performance on the ejection opening formed face, for example, Japanese Patent Laid-Open No. 10-138502 (1998) describes a technology of so-called wet wiping. This is a technology in which an extremely low volatile solvent (hereinafter referred to as a wetting liquid) such as glycerin or polyethylene glycol is attached to a wiper for wiping the ejection opening formed face, and the ejection opening formed face is wiped with the wiper to which the wetting liquid is attached. This can prevent wettability of the ejection opening formed face from varying. That is, functions of the use of the wiper to which the wetting liquid is attached is firstly to dissolve thickened matters of ink and matters with increased film layers accumulated on the ejection opening formed face. Secondly, it is to serve as a lubricant by intervening between the wiper and the ejection opening formed face. Thirdly, it is to attach the wetting liquid on the ejection opening formed face to thereby form a film for protecting the ejection opening formed face.

One example of a system for wet wiping is as follows. Principally, a wetting liquid holding portion for holding the wetting liquid is provided within a moving range of the wiper. The holding portion holds the wetting liquid, and the wiper comes into contact with a transfer portion provided in the holding portion, whereby the wetting liquid can be transferred to the wiper. The wiper comes into contact with a member for cleaning the wiper along with the movement of the wiper, and thereby the wiper is cleaned. After the cleaning, the wiper moves in the same direction and then comes into contact with the transfer portion in the wetting liquid holding portion. This allows the wetting liquid to be transferred to the wiper. Subsequently, the wiper returns to an original position, and then wipes the ejection opening formed face of the printing head with the part of the wiper to which the wetting liquid has been transferred while moving in the same direction as above.

However, the conventional system of wet wiping has some problems caused by the decrease in remaining amount of the wetting liquid in the wetting liquid holding portion.

A first problem is that with decreasing the remaining amount of the wetting liquid, a transfer amount to the wiper is also decreases.

FIG. 1 is a view schematically illustrating an appearance of transferring of the wetting liquid. In the figure, the reference numerals 10 and 21*a* denote the wiper, and the transfer portion formed of an absorber, foam, or the like in the wetting liquid tank, respectively. The wetting liquid holding portion or the transfer portion 21*a* has a large number of pores, and the wetting liquid forms menisci in the pores. When the wiper 10 comes into contact with the transfer portion in this state, the menisci are broken at a contact portion and the wetting liquid wets a surface of the wiper. At this time, if a remaining amount of the wetting liquid is large, the menisci are likely to be broken because force to form a meniscus in each of the pores is low, and even after the menisci have been broken, the menisci do not much move back into the pores. Accordingly, speed of wetting the wiper with the wetting liquid is high, resulting in a large transfer amount to the wiper. In contrast, if the remaining amount of the wetting liquid is relatively small, the menisci are unlikely to be broken because the force to form a meniscus in each of the pores is high, and after the menisci have been broken, the menisci move back. Accordingly, the speed of wetting the wiper is low, resulting in a small transfer amount to the wiper. In this manner, with decreasing the remaining amount of the wetting liquid, the transfer amount to the wiper decreases. As a result, the effect of the wiping is not sufficiently performed, which may cause an ejection failure.

Furthermore, if such an insufficient transfer state becomes extreme, there may be a so-called dry wiping state in which the wiping is performed without any wetting liquid on the wiper. If this state lasts long, water repellency on the ejection opening formed face of the printing head is significantly deteriorated and therefore the ejection direction becomes unstable, which causes an increase in the variation of landing position, whereby the image deterioration becomes significant. Also, for example, a user using the apparatus may repeat cleaning unnecessarily without understanding the cause of the image deterioration, causing an adverse effect of unnecessary consumption of ink. Accordingly, the apparatus becomes inconvenient to the user.

For the above-described extreme decrease in the remaining amount, the wetting liquid holding portion usually has a capacity capable of holding a coating liquid in an amount assumed for a maximum number of sheets in terms of durability (an apparatus lifetime converted into the number of printed sheets; hereinafter referred to as a number of sheets on durability) of the ink-jet printing apparatus. On the other hand, the capacity of the wetting liquid holding portion greatly affects a size and a cost of the printing apparatus. For this reason, the capacity of the wetting liquid holding portion is generally estimated from a total usage of the wetting liquid that is calculated based on an assumption that the user uses the apparatus in an ordinary usage pattern for the number of sheets on durability. In this case, if the user continues to use the apparatus in the condition where the number of sheets on durability in the apparatus is exceeded, or if the wiping is performed more than the assumed number of times due to user's usage even in the case that the number of sheets on durability is not exceeded, consumption of the wetting liquid by these wet wiping may increase, resulting in an extremely small remaining amount. The case where the wiping is performed more than the assumed number of times includes the cases of high printing duty and high printing frequency.

A second problem is that the decrease in the wetting liquid makes the printing apparatus unavailable even if there is room in other factors defined according to the number of sheets on durability.

The cumulative number of pulses to be supplied to the electrothermal conversion element in the printing head and a capacity of a waste ink absorber are the factors defined according to the number of sheets on durability in the printing apparatus, similarly to the capacity of the wetting liquid holding portion. If the use of the printing apparatus is prohibited based on the decrease in the remaining amount of the wetting liquid even if there is room in other factors as above, the apparatus becomes inconvenient to the user.

For example, a factor which first reaches a limit according to the assumed number of sheets on durability among a plurality of factors defined with the number of sheets on durability of the printing apparatus depends on as to how the user uses the apparatus. For example, if there frequently occurs a case where the user intermittently prints a small number of copies of documents (for example, a case where the user prints one sheet of text every 10 minutes), the wiping for the capping operation performed after the printing has been performed for each printing. This case corresponds to the state of a small number of printed sheets having been printed or of a low printing duty, from the beginning, i.e. the state where there is room in the cumulative number of pulses and the capacity of the waste ink absorber, and it also corresponds to the state of a small remaining amount of the wetting liquid. In this case, if it is prohibited to use the printing apparatus without notifying any information because of the small remaining amount of the wetting liquid, the apparatus becomes inconvenient to the user due to the unaccountable prohibition.

SUMMARY OF THE INVENTION

An objective of the present invention is to provide an ink-jet printing apparatus and a method for controlling the apparatus that take care of the problems of the decrease in transfer amount of a wetting liquid and the prohibition of the use of a printing apparatus, which arise when a remaining amount of the wetting liquid is decreased.

In the first aspect of the present invention, there is provided an ink jet printing apparatus performing a wiping operation in which an ejection opening formed face of a print head for ejecting ink is wiped with a wiper to which a wetting liquid is transferred, said apparatus comprising: remaining amount detection means for detecting a remaining amount of the wetting liquid in a holding portion that holds the wetting liquid; and control means for performing a transfer amount maintaining operation for maintaining an amount of the wetting liquid transferred to the wiper, depending on the remaining amount detected by said remaining amount detection means.

In the second aspect of the present invention, there is provided an ink jet printing apparatus performing a wiping operation in which an ejection opening formed face of a print head for ejecting ink is wiped with a wiper to which a wetting liquid is transferred, said apparatus comprising: remaining amount detection means for detecting a remaining amount of the wetting liquid in a holding portion that holds the wetting liquid; and wiping change means for changing the wiping operation, depending on the remaining amount detected by said remaining amount detection means.

In the third aspect of the present invention, there is provided an ink jet printing apparatus performing a wiping operation in which an ejection opening formed face of a print head for ejecting ink is wiped with a wiper to which a wetting liquid is transferred, said apparatus comprising: remaining amount detection means for detecting a remaining amount of the wetting liquid in a holding portion that holds the wetting liquid; and warning means for giving a user warning information, depending on the detected remaining amount.

In the fourth aspect of the present invention, there is provided a control method for an ink jet printing apparatus performing a wiping operation in which an ejection opening formed face of a print head for ejecting ink is wiped with a wiper to which a wetting liquid is transferred, said method comprising: a remaining amount detection step of detecting a remaining amount of the wetting liquid in a holding portion that holds the wetting liquid; and a control step of performing a transfer amount maintaining operation for maintaining an amount of the wetting liquid transferred to the wiper, depending on the remaining amount detected in said remaining amount detection step.

In the fifth aspect of the present invention, there is provided a control method for an ink jet printing apparatus performing a wiping operation in which an ejection opening formed face of a print head for ejecting ink is wiped with a wiper to which a wetting liquid is transferred, said method comprising: a remaining amount detection step of detecting a remaining amount of the wetting liquid in a holding portion that holds the wetting liquid; and a wiping change step of changing the wiping operation, depending on the remaining amount detected in said remaining amount detection step.

In the sixth aspect of the present invention, there is provided a control method for an ink jet printing apparatus performing a wiping operation in which an ejection opening formed face of a print head for ejecting ink is wiped with a wiper to which a wetting liquid is transferred, said method comprising: a remaining amount detection step of detecting a remaining amount of the wetting liquid in a holding portion that holds the wetting liquid; and a warning step of giving a user warning information, depending on the detected remaining amount.

According to the above first configuration, even if a remaining amount of the wetting liquid is decreased, a transfer amount of the wetting liquid to the wiper does not significantly change. This enables any trouble in wet wiping due to the shortage of the transfer amount caused by a small remaining amount to be prevented.

Also, according to the second configuration, even if a remaining amount of the wetting liquid is decreased, a wiping operation for compensating the shortage of the wetting liquid, such as a plurality times of wiping or wiping in which ink is applied to a wiper. This enables the wiping itself to be well performed even if the remaining amount of the wetting liquid is small.

Furthermore, according to the third configuration, a user is notified of information corresponding to a remaining amount of the wetting liquid, so that the user can know that the end of an apparatus lifetime in terms of the wetting liquid has been reached or is about to be reached. This causes usability of the apparatus to be improved, for example, when a printing operation in the apparatus is stopped due to its lifetime, the user understands the cause of the stop, and therefore does not have to perform any unnecessary operation.

Further features of the present invention will become apparent from the following description of exemplary embodiments (with reference to the attached drawings).

BRIEF DESCRIPTION OF THE DRAWINGS

FIGS. 26A and 26B are diagrams explaining a temperature dependent variation in consumption amount of the wetting liquid;

FIG. 28 is a view illustrating an error display according to one embodiment of the present invention;

FIG. 30 is a view illustrating an example in which a message is displayed indicating that the number of sheets on durability of a printer is about to be reached, according to one embodiment of the present invention;

DESCRIPTION OF THE EMBODIMENTS

Figure 1:
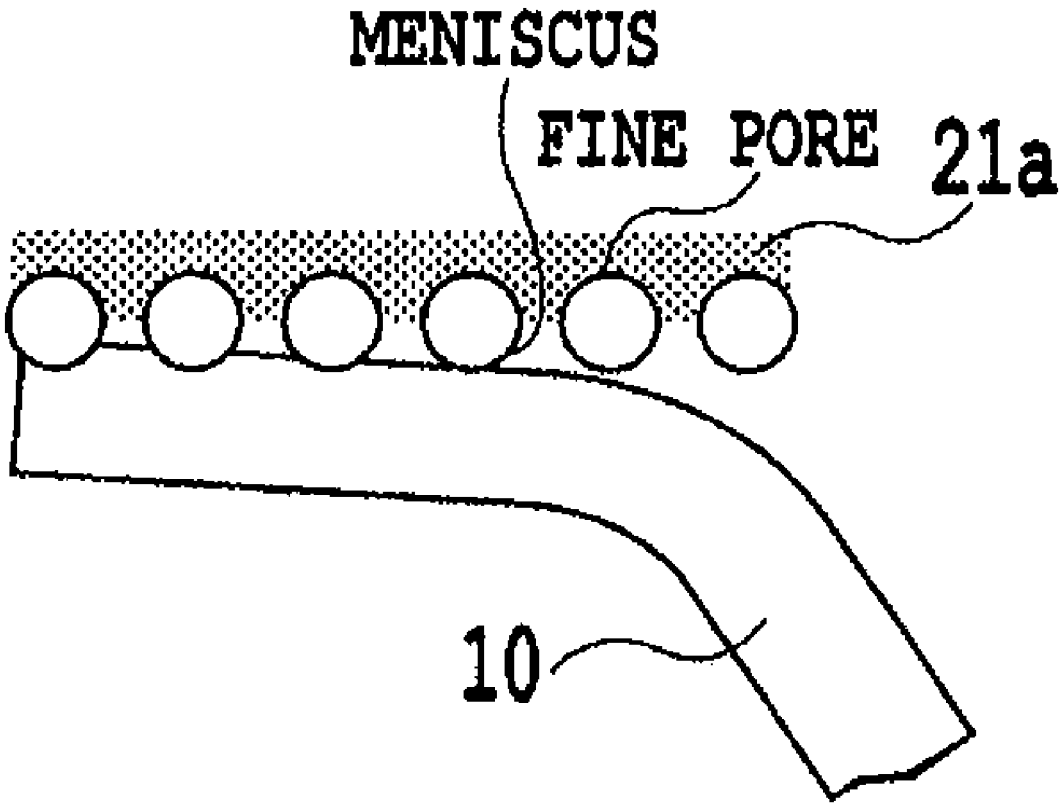
FIG. 1 is a view schematically illustrating an appearance of transfer of the wetting liquid.

Descriptions will be provided below for embodiments of the present invention by referring to the drawings. First of all, a basic configuration of an ink jet printing apparatus according to an embodiment of the present invention, before describing characteristic configuration according to several embodiments of the present invention.

Basic Configuration

Descriptions will be provided for a configuration of the mechanisms in the printing apparatus to which this embodiment is applied. The main body of the printing apparatus of this embodiment is divided into a paper feeding section, a paper conveying section, a paper discharging section, a carriage section, a flat-pass printing section and a cleaning section from a viewpoint of functions performed by the mechanisms. These mechanisms are contained in an outer case.

Figure 2:
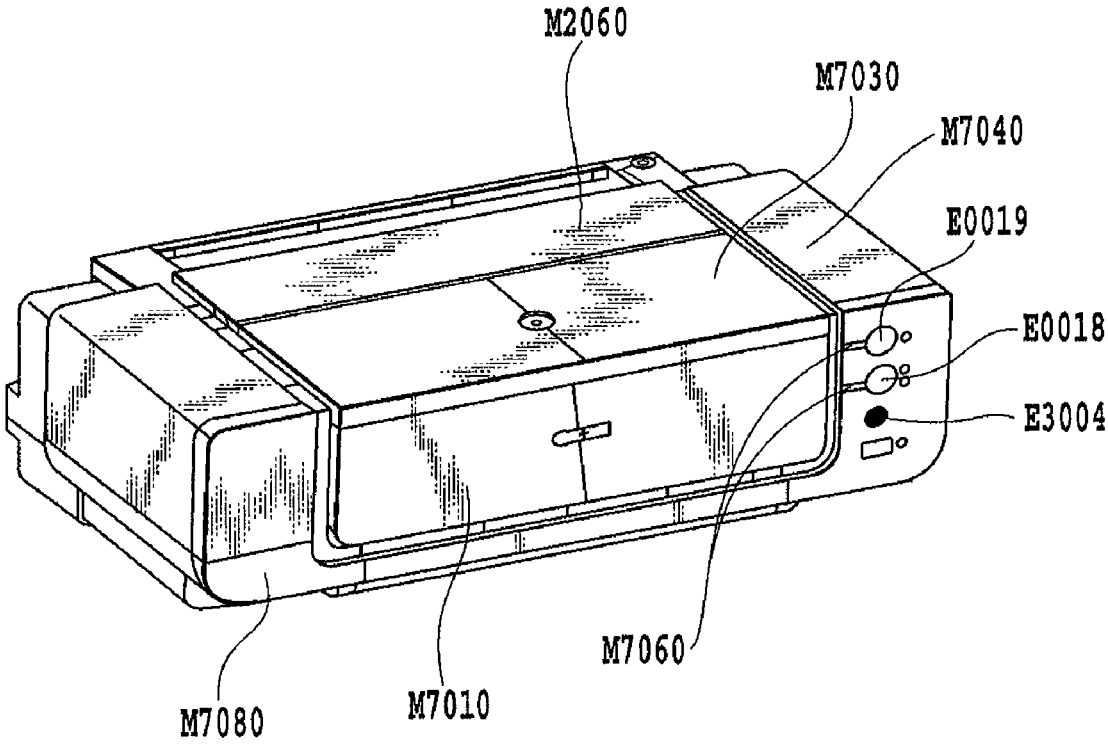
FIG. 2 is a perspective view in which a printing apparatus to which the present invention is applicable is viewed from its front face when it is not used.
Figure 3:
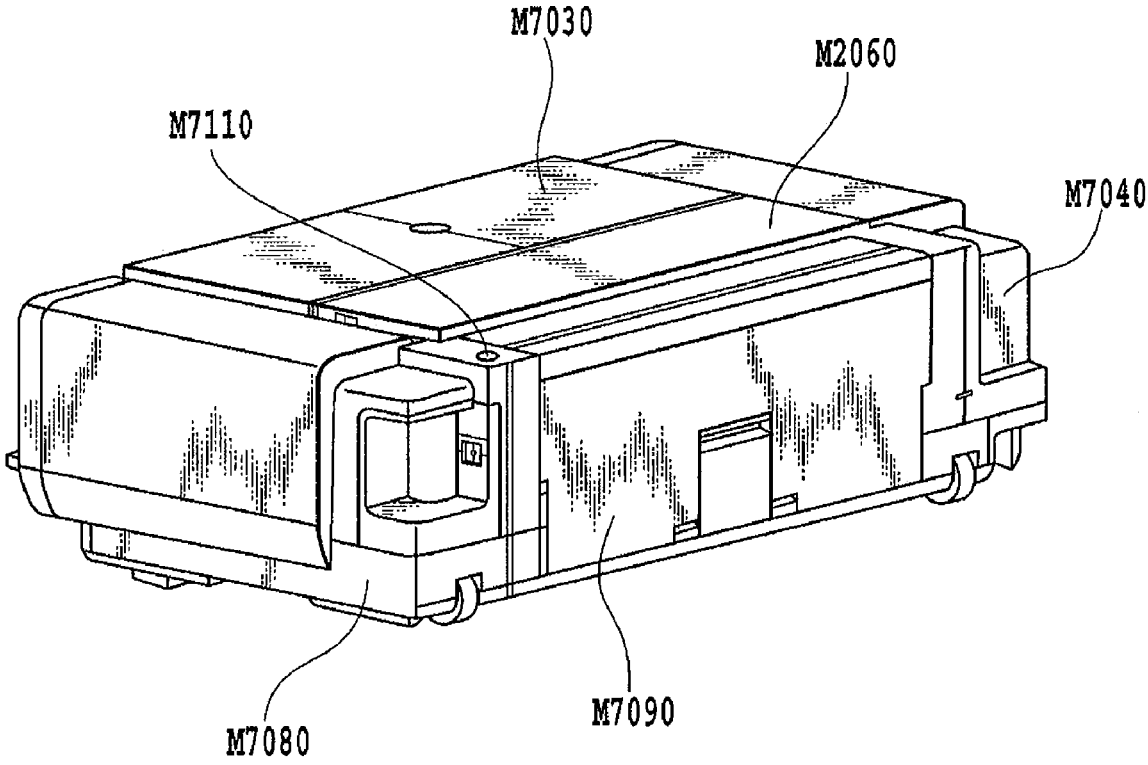
FIG. 3 is a perspective view in which the printing apparatus in FIG. 2 is viewed from its back face when it is not used.
Figure 4:
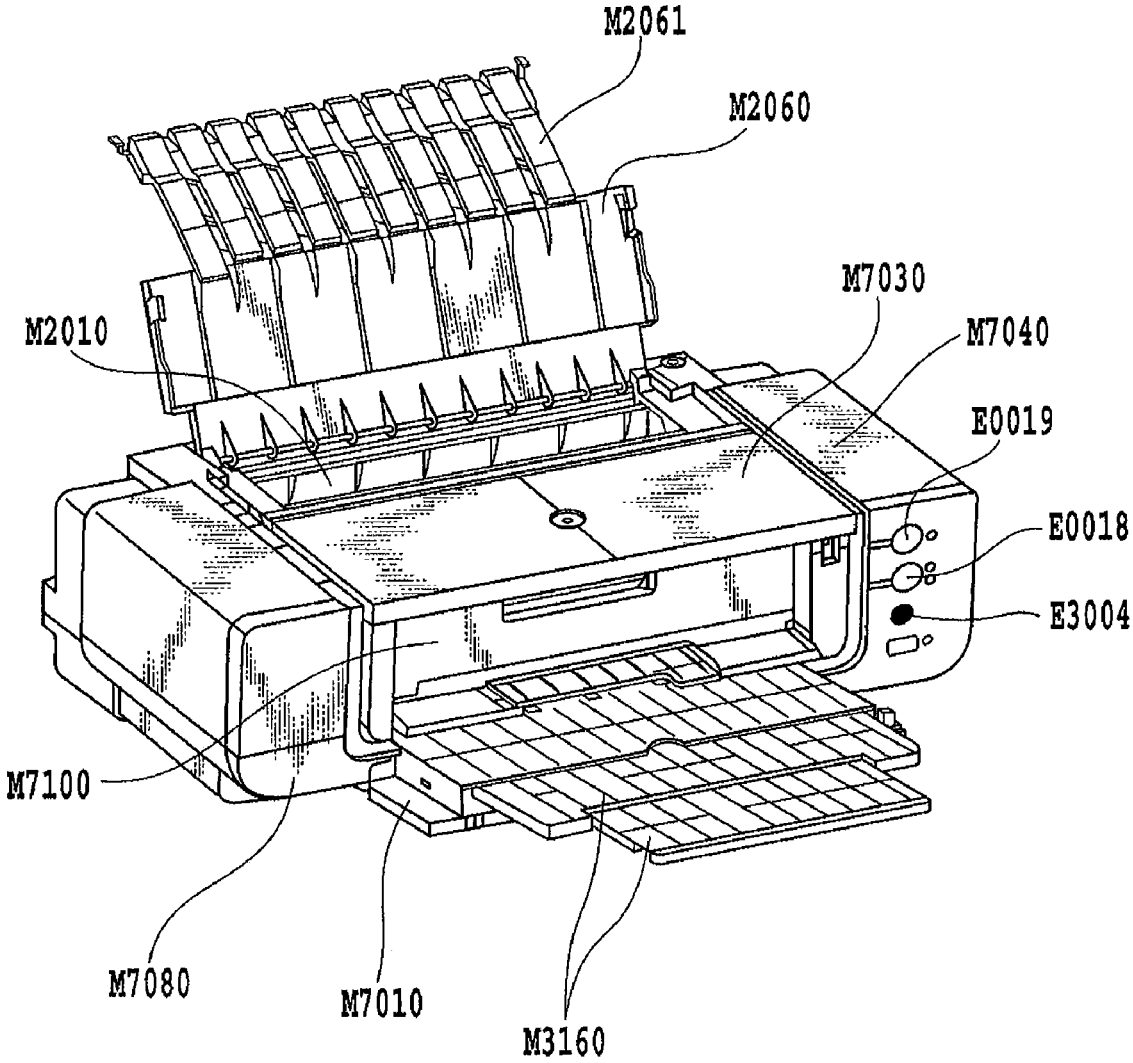
FIG. 4 is a perspective view in which the printing apparatus in FIG. 2 is viewed from its front face when it is used.
Figure 5:
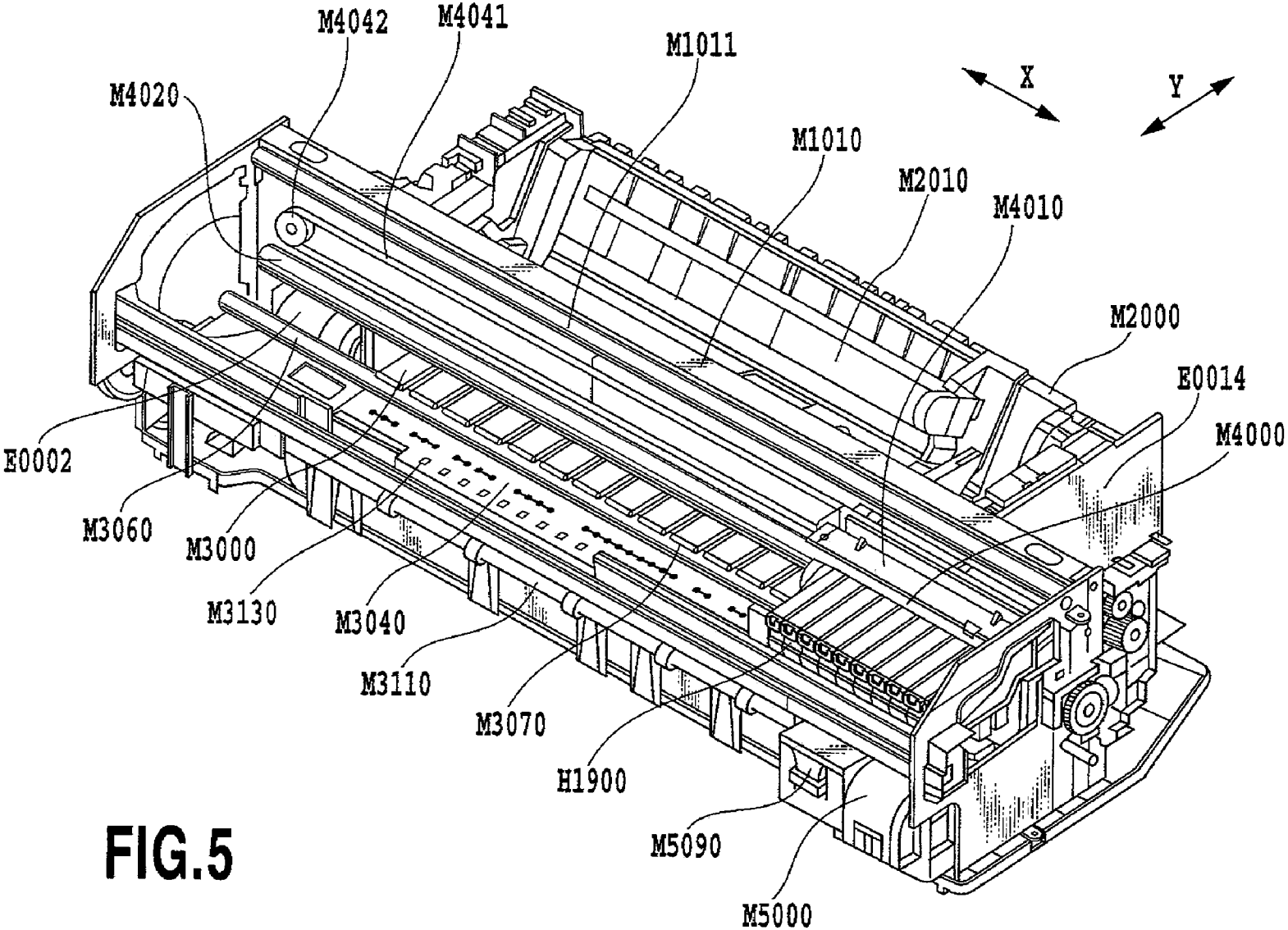
FIG. 5 is a perspective view in which an internal mechanism of the printing apparatus in FIG. 2 is viewed from upper right.
Figure 6:
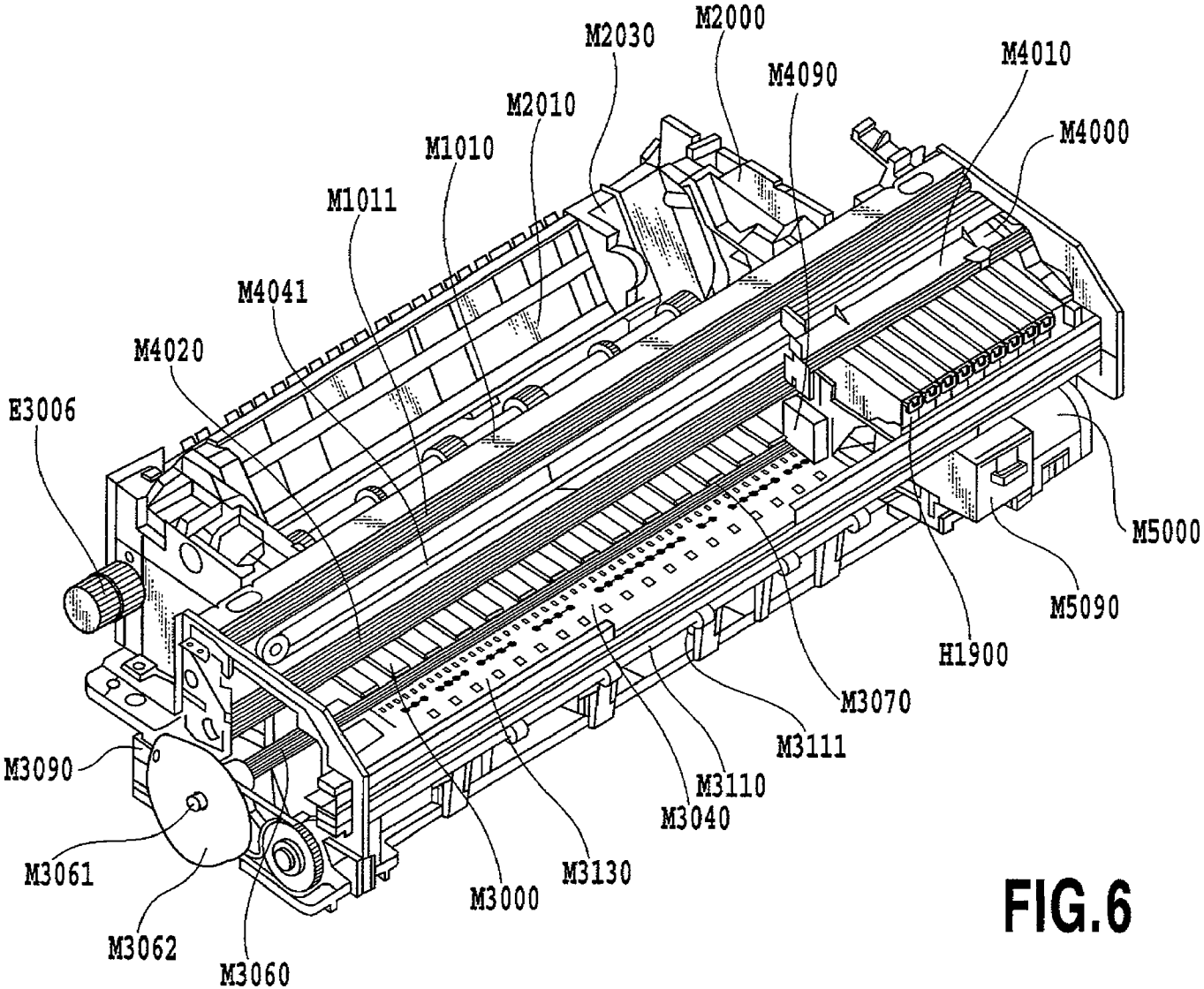
FIG. 6 is a perspective view in which the internal mechanism of the printing apparatus in FIG. 2 is viewed from upper left.
Figure 7:
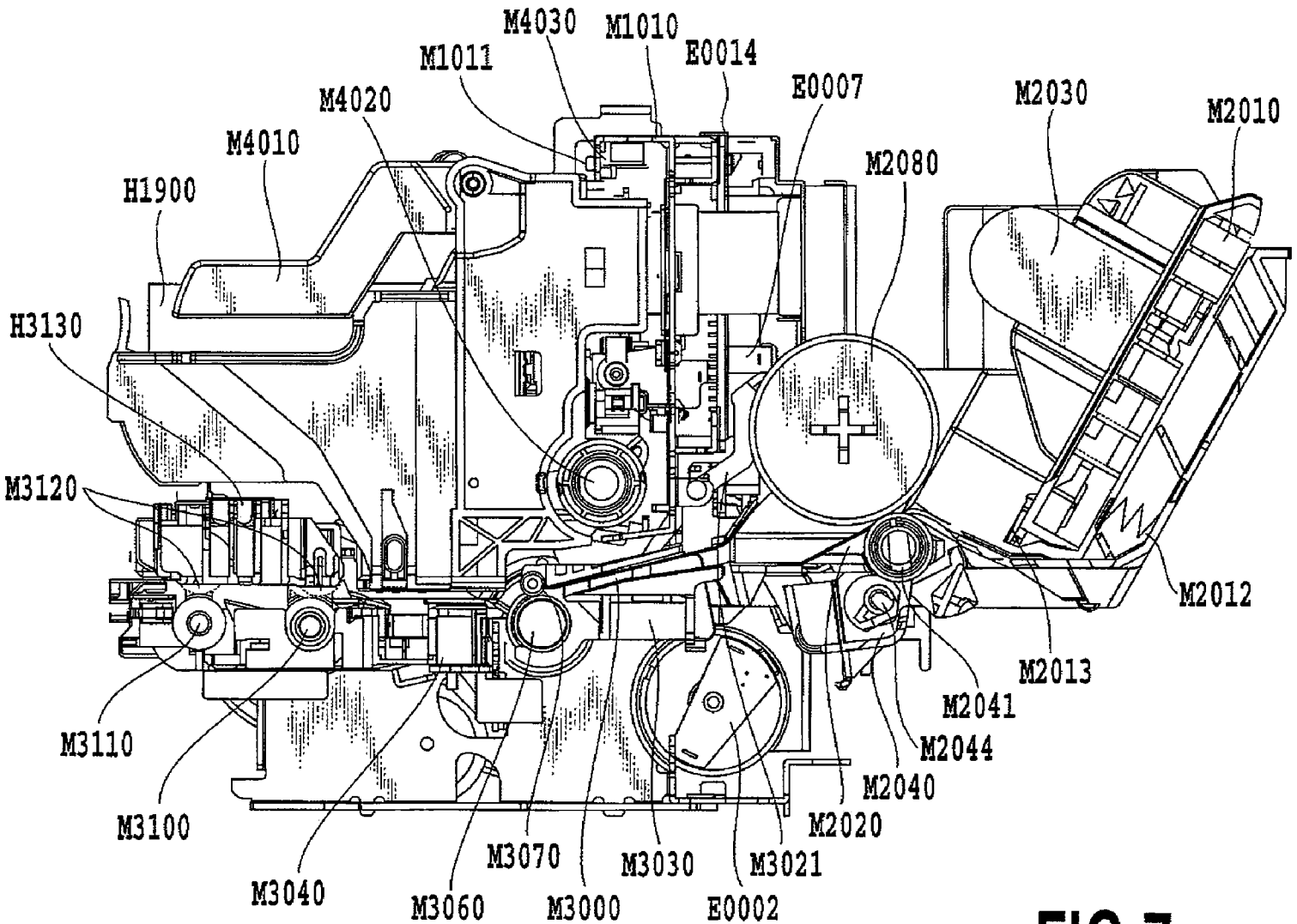
FIG. 7 is a cross-sectional side view of the internal mechanism of the printing apparatus in FIG. 2.
Figure 8:
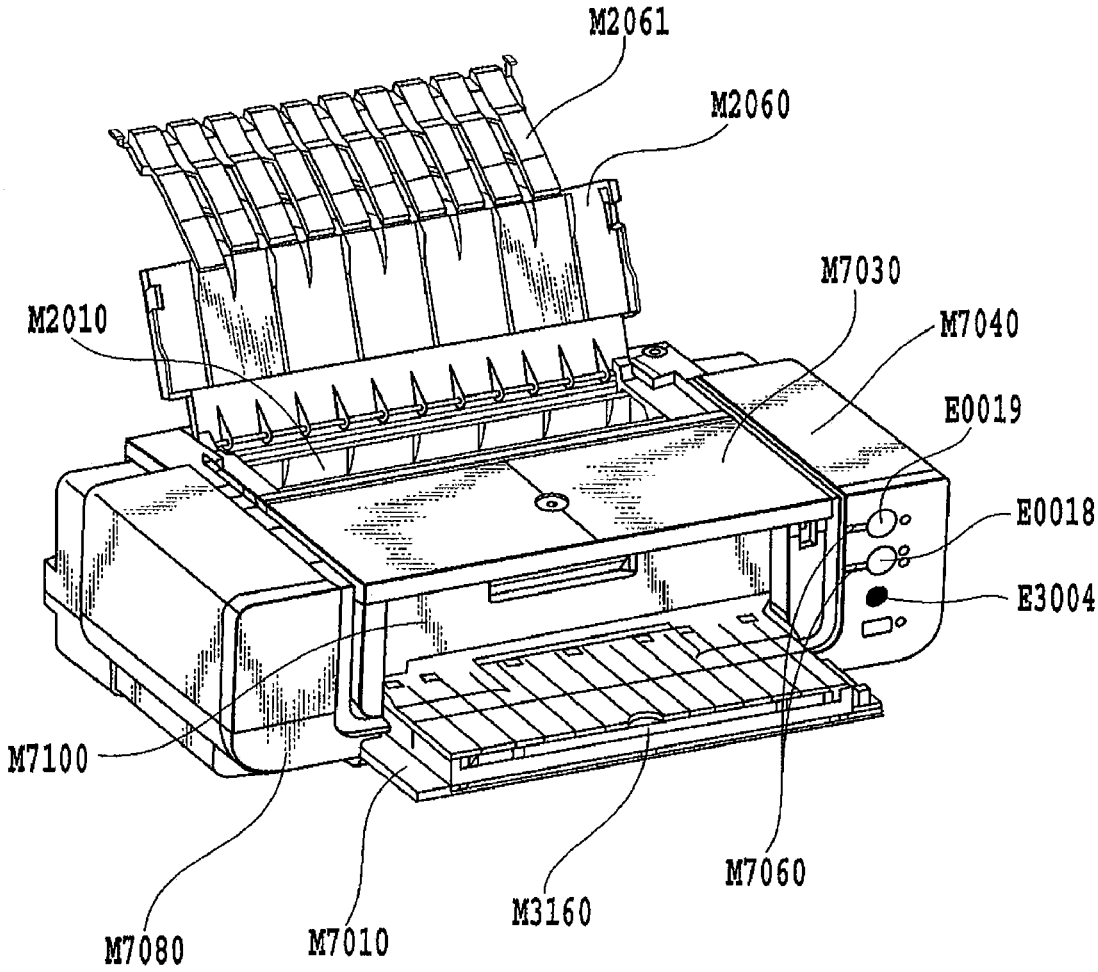
FIG. 8 is a perspective view in which the printing apparatus in FIG. 2 is viewed from its front face when flat-pass printing is performed.
Figure 9:
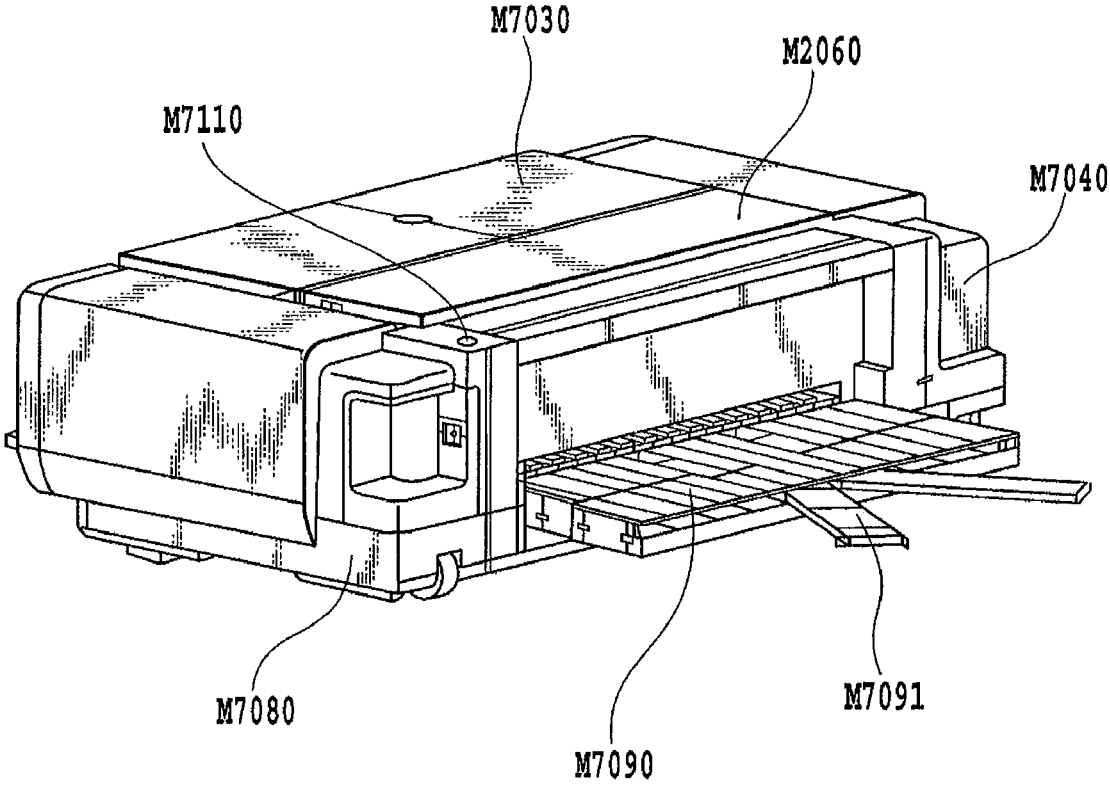
FIG. 9 is a perspective view in which the printing apparatus in FIG. 2 is viewed from its back face when flat-pass printing is performed.
Figure 10:
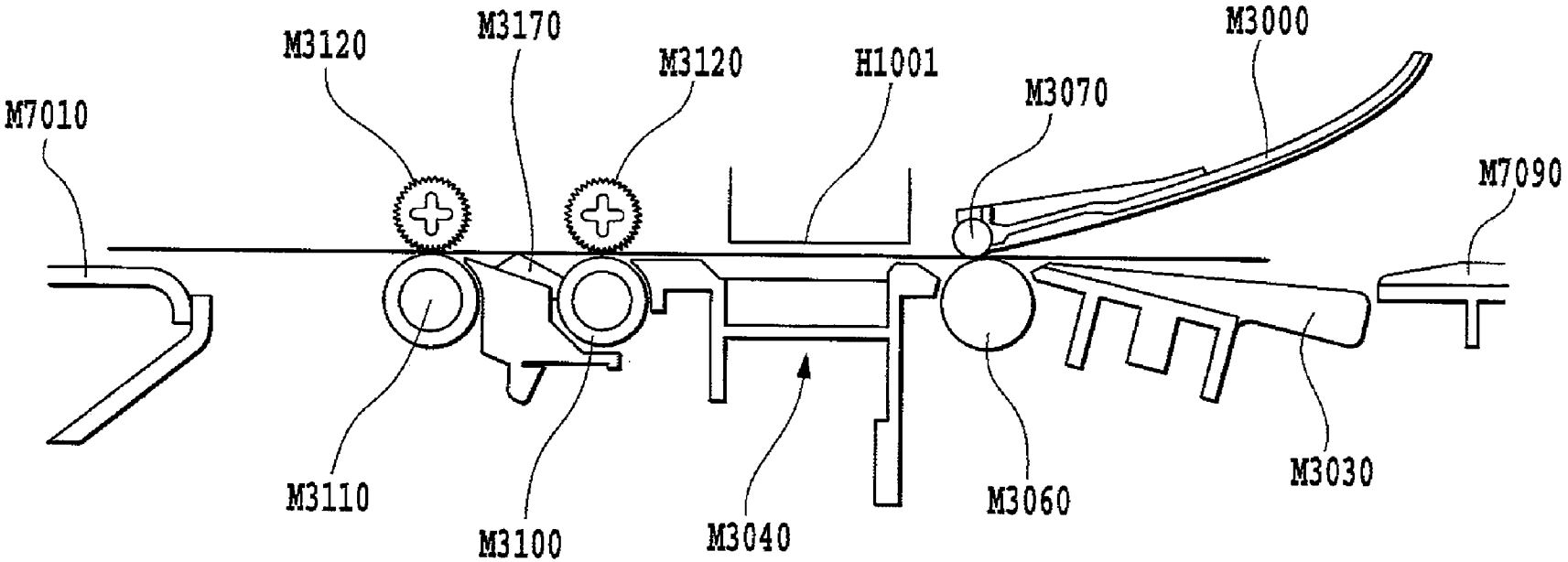
FIG. 10 is a schematic cross-sectional side view for explaining the flat-pass printing in the printing apparatus in FIG. 2.
Figure 11:
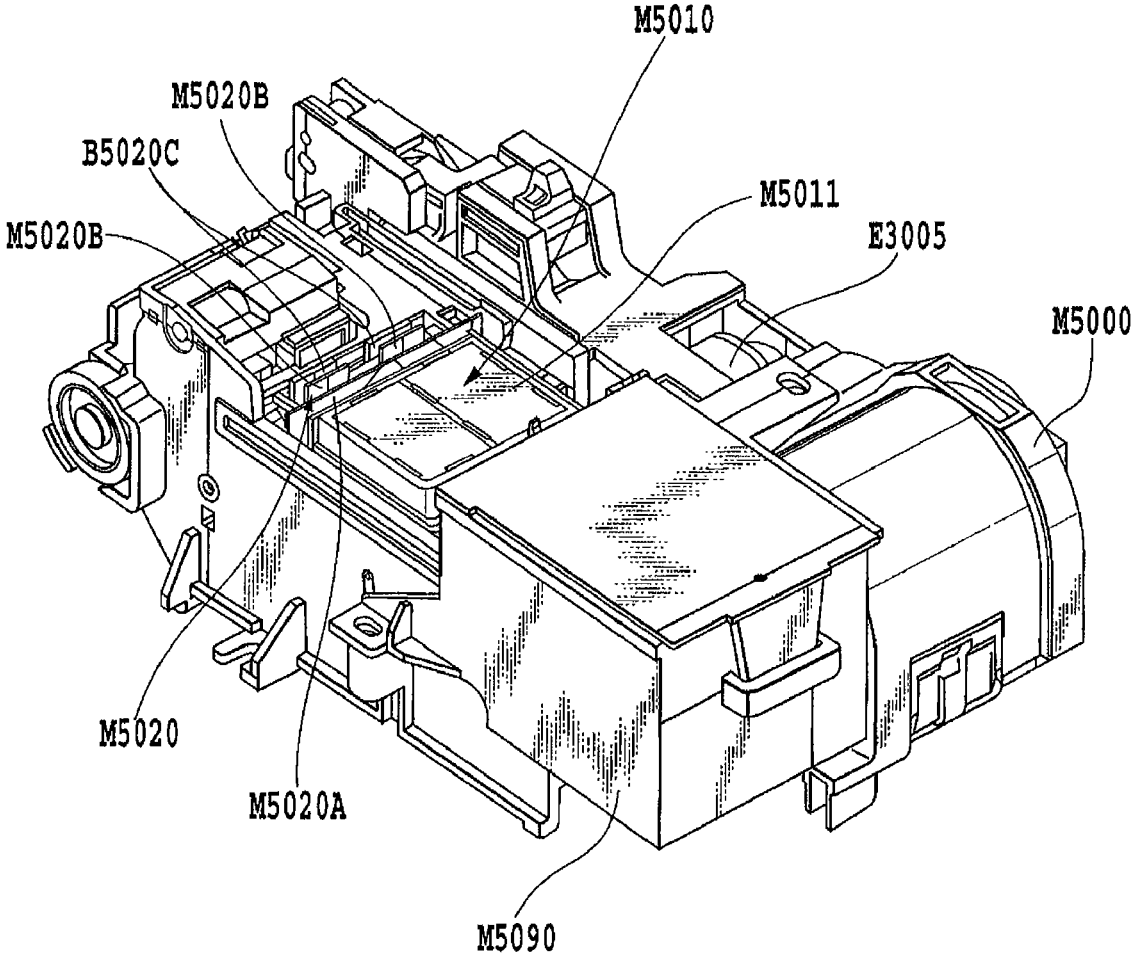
FIG. 11 is a perspective view of a cleaning part in the printing apparatus in FIG. 2.
Figure 12:
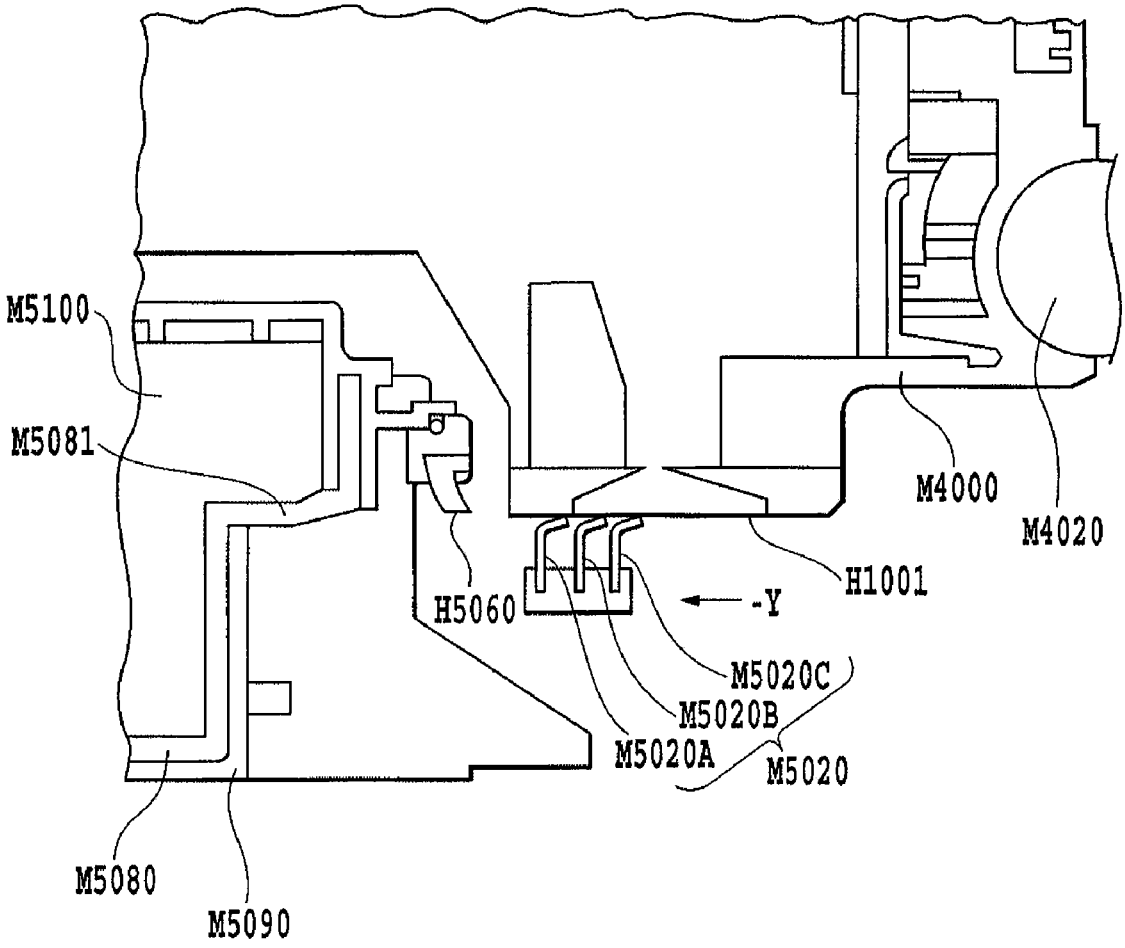
FIG. 12 is a cross-sectional view of a wiper portion in the cleaning part in FIG. 11.
Figure 13:
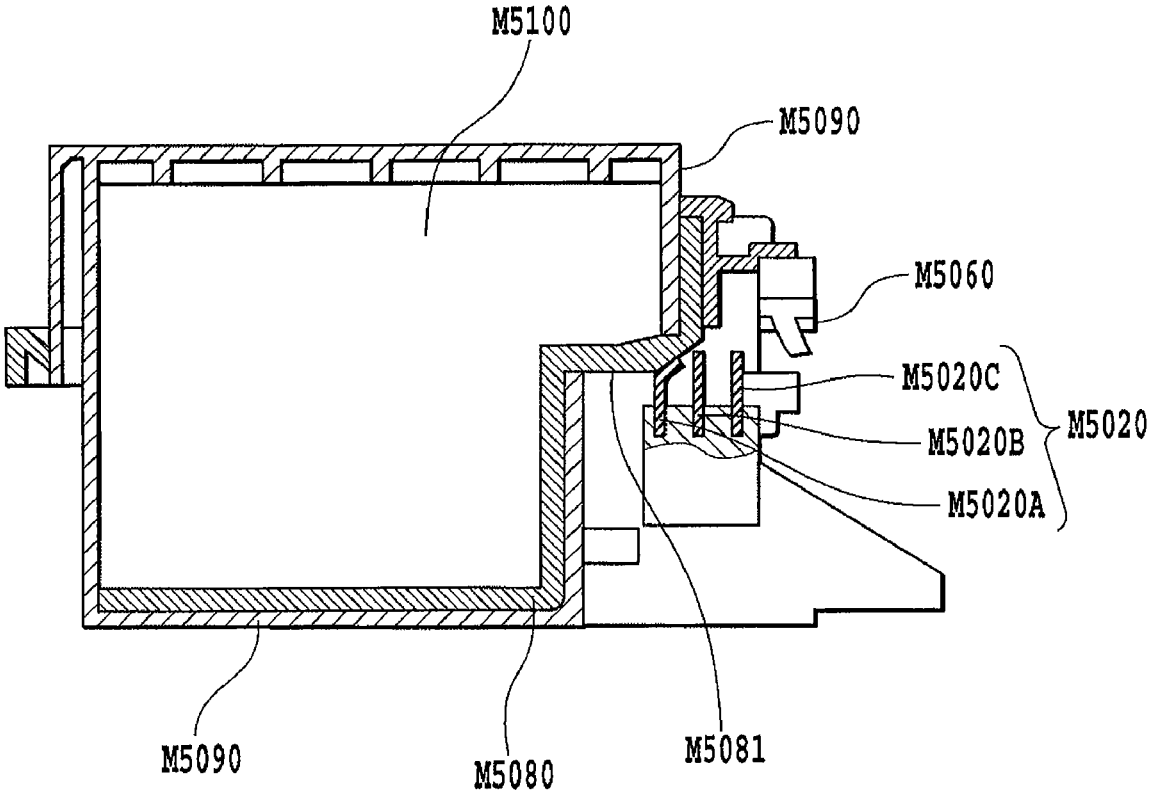
FIG. 13 is a cross-sectional view of a wetting liquid transfer portion in the cleaning part in FIG. 11.

FIGS. 2, 3, 4, 8 and 9 are perspective views respectively showing appearances of the printing apparatus to which this embodiment is applied. FIG. 2 shows the printing apparatus in an unused condition when viewed from the front. FIG. 3 shows the printing apparatus in an unused condition when viewed from the back. FIG. 4 shows the printing apparatus in a used condition when viewed from the front. FIG. 8 shows the printing apparatus during flat-pass printing when viewed from the front. FIG. 9 shows the printing apparatus during flat-pass printing when viewed from the back. In addition, FIGS. 5 to 7 and 10 to 12 are diagrams for describing internal mechanisms in the main body of the printing apparatus. In this respect, FIG. 5 is a perspective view showing the printing apparatus when viewed from the right above. FIG. 6 is a perspective view showing the printing apparatus when viewed from the left above. FIG. 7 is a side, cross-sectional view of the main body of the printing apparatus. FIG. 10 is a cross-sectional view of the printing apparatus during flat-pass printing. FIG. 11 is a perspective view of the cleaning section. FIG. 12 is a cross-sectional view for describing a configuration and an operation of a wiping mechanism in the cleaning section. FIG. 13 is a cross-sectional view of a wetting liquid transferring unit in the cleaning section.

Descriptions will be provided for each of the sections by referring to these figures whenever deemed necessary.

Outer Case (Refer to FIGS. 2 and 3)

The outer case is attached to the main body of the printing apparatus in order to cover the paper feeding section, the paper conveying section, the paper discharging section, the carriage section, the cleaning section, the flat-pass section and the wetting liquid transferring unit. The outer case is configured chiefly of a lower case M7080, an upper case M7040, an access cover M7030, a connector cover, and a front cover M7010.

Paper discharging tray rails (not illustrated) are provided under the lower case M7080, and thus the lower case M7080 has a configuration in which a divided paper discharging tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 or the printing head H1001 (refer to FIG. 17) is replaced with a new one in this position. Incidentally, in the printing apparatus of this embodiment, the printing head H1001 has a configuration in which a plurality of ejecting portions are formed integrally into one unit. The plurality of ejecting portions corresponding respectively to a plurality of mutually different colors, and each of the plurality of ejecting portions is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multi-stage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

Paper Feeding Section (Refer to FIGS. 4 and 7)

In the paper feeding section, a pressure plate M2010 on which printing media are stacked, a paper feeding roller M2080 for feeding the printing media sheet by sheet, a separation roller M2041 for separating a printing medium, a return lever M2020 used for returning the printing medium to a stacking position, and the like are attached to a base M2000.

Paper Conveying Section (Refer to FIGS. 4 to 7)

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 17) is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

Paper Discharging Section (Refer to FIGS. 4 to 7)

The paper discharging section is configured of a first paper discharging roller M3100, a second paper discharging roller M3110, a plurality of spurs M3120 and a gear train.

The first paper discharging roller M3100 is configured of a plurality of rubber portions provided around the metal shaft thereof. The first paper discharging roller M3100 is driven by transmitting the driving force of the conveying roller M3060 to the first paper discharging roller M3100 through an idler gear.

The second paper discharging roller M3110 is configured of a plurality of elastic elements M3111, which are made of elastomer, attached to the resin-made shaft thereof. The second paper discharging roller M3110 is driven by transmitting the driving force of the first paper discharging roller M3100 to the second paper discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper discharging rollers M3100 and M3110 at predetermined pressures. This configuration enables the spurs 3120 to rotate to follow the two paper discharging rollers M3100 and M3110. Some of the spurs M3120 are provided at the same positions as corresponding ones of the rubber portions of the first paper discharging roller M3110 are disposed, or at the same positions as corresponding ones of the elastic elements M3111 are disposed. These spurs chiefly generates a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the paper discharging rollers M3100 and M3110.

With the foregoing configuration, a printing medium on which an image is formed is pinched with nips between the first paper discharging roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing media, and prevents the printing surface of each of the printing media from being rubbed.

Carriage Section (Refer to FIGS. 5 to 7)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 14). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 14). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 14). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column arrangement direction. In terms of a position in a row arrangement direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium. In the printing main scan, the scan of the carriage M4000 is executed in the column arrangement direction while performed with the printing head H1001, and in the sub-scan, the printing medium is conveyed in the row arrangement direction.

Flat-Pass Printing Section (Refer to FIGS. 8 to 10)

A printing medium is fed from the paper feed section in a state where the printing medium is bent, because the passage through which the printing medium passes continues curving up to the pinch rollers as shown in FIG. 7. For this reason, if a thicker printing medium with a thickness of approximately 0.5 mm or more, for example, is attempted to be fed from the paper feeding section, a reaction force of the bent printing medium occurs, and thus resistance to the paper feeding increases. As a result, it is likely that the printing medium cannot be fed. Otherwise, even if the printing medium can be fed, the delivered printing medium remains bent, or is folded.

A flat-pass print is made on printing media, such as thicker printing media, which a user does not wish to fold, and on printing media, such as CD-Rs, which cannot be bent.

Types of flat-pass prints include a type of print made by manually supplying a printing medium from a slit-shaped opening portion (under a paper feeding unit) in the back of the main body of a printing apparatus, and by thus causing pinch rollers of the main body to nip the printing medium. However, the flat-pass print of this embodiment employs the following mode. A printing medium is fed from the paper discharging port located in the front side of the main body of the printing apparatus to a position where a print is going to be made, and the print is made on the printing medium by switching back the printing medium.

The front cover M7010 is usually located below the paper discharging section, because the front cover M7010 is also used as a tray in which several tens of printing media on which prints have been made are stacked (refer to FIG. 4). When a flat-pass print is going to be made, the front tray M7010 is elevated up to a position where the paper discharging port is located (refer to FIG. 8) for the purpose of supplying a printing medium from the paper discharging port horizontally in a direction reverse to the direction in which a printing medium is usually conveyed. Hooks and the like (not illustrated) are provided to the front cover M7010. Thus, the front cover M7010 is capable of being fixed to a position where the printing medium is supplied for the purpose of the flat-pass print. It can be detected by a sensor whether or not the front cover M7010 is located at the position where the printing medium is supplied for the purpose of the flat-pass print. Depending on this detection, it can be determined whether the printing apparatus is in a flat-pass printing mode.

In the case of the flat-pass printing mode, first of all, a flat-pass key E3004 is operated for the purpose of placing a printing medium on the front tray M7010 and inserting the printing medium from the paper discharging port. Thereby, a mechanism (not illustrated) lifts the spur holder M3130 and the pinch roller holder M3000 respectively up to positions higher than a presumed thickness of the printing medium. In addition, in a case where the carriage M4000 exists in an area through which the printing medium is going to pass, a lifting mechanism (not illustrated) lifts the carriage M4000 up. This makes it easy to insert the printing medium therein. Moreover, by pressing a rear tray button M7110, a rear tray M7090 can be opened. Furthermore, a rear sub-tray M7091 can be opened in the form of the letter V (refer to FIG. 9). The rear tray M7090 and the rear sub-tray M7091 are trays with which a long printing medium is supported in the back of the main body of the printing apparatus. This is because, if the long printing medium is inserted from the front of the main body of the printing apparatus, the long printing medium juts out of the back of the main body of the printing apparatus. If a thicker printing medium is not kept flat while a print is being made on the thicker printing medium, the thicker printing medium may be rubbed against the head ejection face (ejection opening formed face), or the conveyance load may change. This is likely to adversely affect the print quality. For this reason, the disposition of these trays is effective. However, if a printing medium is not long enough to jut out of the back of the main body of the printing apparatus, the rear tray M7090 and the like need not be opened.

In the foregoing manner, a printing medium can be inserted from the paper discharging port to the inside of the main body of the printing apparatus. A printing medium is positioned on the front tray M7010 by aligning the rear edge (an edge at the side located closest to a user) and the right edge of the printing medium to a position in the front tray M7010 where a marker is formed.

At this time, if the flat-pass key E3004 is operated once again, the spur holder M3130 comes down, and thus the paper discharging rollers M3100, M3110 and the spurs M3120 jointly nip the printing medium. Thereafter, the paper discharging rollers M3100 and M3110 draw the printing medium into the main body of the printing apparatus by a predetermined amount thereof (in a direction reverse to the direction in which the printing medium is conveyed during normal printing). Because the edge at the side closest to the user (the rear edge) of a printing medium is aligned to the marker when the printing medium is set up at the beginning, it is likely that the front edge (the edge located farthest from a user) of the printing medium may not reach the conveying roller M3060, if the printing medium is shorter. With this taken into consideration, the predetermined amount is defined as a distance between the rear edge of a printing medium with the presumably shortest length and the conveying roller M3060. Once a printing medium is transferred by the predetermined amount, the rear edge of the printing medium reaches the conveying roller M3060. Thus, the pinch roller holder M3000 is lowered at the position, and the conveying roller M3060 and the pinch rollers M3070 are caused to nip the printing medium. Subsequently, the printing medium is further transferred so that the rear edge of the printing medium is nipped by the conveying roller M3060 and the pinch rollers M3070. Thereby, the supplying of the printing medium for the purpose of the flat-pass print is completed (at a position where the printing medium waits for a print to be made thereon).

A nip force with which the paper discharging roller M3100 and M3110 as well as the spurs M3120 nip a printing medium is set relatively weak lest the force should adversely affect image formation while the printing medium is being delivered during a normal print. For this reason, in the case where a flat-pass print is going to be made, it is likely that the position of the printing medium shifts before the print starts. In this embodiment, however, a printing medium is nipped by the conveying roller M3060 and the pinch rollers M3070 which have a relatively stronger nip force. This secures a position where a printing medium should be set. In addition, while a printing medium is being conveyed into the inside of the main body by the predetermined amount, a flat-pass paper detection sensor can detect the position of the rear edge (the position of the front edge during the print) of the printing medium.

Once a printing medium is set at the position where the printing medium waits for a print to be made thereon, a print command is executed. Specifically, the conveying roller M3060 conveys the printing medium to a position where the printing head H1001 is going to make a print on the printing medium. Thereafter, the print is made in the same manner as a normal printing operation is performed. After the print, the printing medium is discharged to the front tray M7010.

In a case where the flat-pass print is intended to be made successively, the printing medium on which the print has been made is removed from the front tray M7010, and the next printing medium is set thereon. After that, it is sufficient that the foregoing processes are repeated. Specifically, the subsequent print starts with the setting of a printing medium after the spur holder M3130 and the pinch roller holder M3000 are lifted up by pressing the flat-pass key E3004.

On the other hand, in a case where the flat-pass print is intended to be completed, the printing apparatus is returned to the normal printing mode by returning the front tray M7010 to the normal print position.

Cleaning Section (Refer to FIGS. 11 and 12)

The cleaning section is a mechanism for cleaning the printing head H1001. The cleaning section is configured of a pump M5000, caps M5010, a wiper portion M5020 and the like. The caps M5010 are those which prevent the printing head H1001 from being dried out. The wiper portion M5020 is used for cleaning the surface of the printing head H1001 on which the ejection openings are formed.

In the cleaning section, a single purpose cleaning motor E0003 is disposed. The cleaning motor E0003 is provided with a one-way clutch (not illustrated), so that the pump M5000 is operated by rotation in one direction, and the wiper portion M5020 moves and the caps M5010 ascend and descend by rotation in the other direction.

The motor E0003 drives the caps M5010 so as for the caps M5010 to be capable of ascending and descending by means of an ascending/descending mechanism (not illustrated). When the caps M5010 go up to an ascending position, the caps M5010 cap each of the ejection faces of several ejecting portions provided to the printing head H1001. While no print operation is being performed, the caps M5010 can protect the printing head H1001. Otherwise, the caps M5010 can recover the printing head H1001 by suction. In the suction recovery, ink not involved in printing an image is absorbed from the printing head and discharged to an inside the cap M5010. Alternately, the ink not involved in printing an image may be pressurized at the inside the printing head and discharged to the inside the cap M5010 (pressurized recovery operation). While a print operation is being performed, the caps M5010 can be placed in a descending position which prevents the caps M5010 from interfering with the printing head H1001. In addition, by opposing the caps M5010 to the ejection face, the caps M5010 are capable of receiving preliminary ejections. In the preliminary ejection, the ink not involved in printing an image is ejected from the printing head to the inside the cap M5010. In a case where, for instance, the printing head H1001 is provided with ten ejecting portions, two caps M5010 are provided to the cleaning section in the illustrated example so that the ejection face corresponding to each five ejecting portions can be capped collectively by corresponding one of the two caps M5010.

A wiper portion M5020 made of an elastic member such as rubber is fixed to a wiper holder (not illustrated). The wiper holder is capable of moving in directions indicated by −Y and +Y in FIG. 12 (−Y and +Y are directions in which the ejection openings in the ejecting portions are arranged). When the printing head H1001 gets to the home position, the wiper holder moves in the direction indicated by an arrow −Y. Thereby, a surface of the printing head H1001 can be wiped. Once the wiping operation is completed, the carriage is caused to escape out of the range where the wiping operation is designed to be performed, and thus the wiper is returned to a position which prevents the wiper from interfering with the ejection face and the like. The wiper portion M5020 of this example is provided with a wiper blade M5020A, M5020B and M5020C (hereinafter also referred to as simply "wiper"). The wiper blade M5020A wipes the entire surface of the printing head H1001 including all of the ejection faces of the ejecting portions. The wiper blade M5020B and M5020C wipe vicinities of nozzles for each of ejection faces of five ejecting portions.

After wiping, the wiper portion M5020 abuts on a blade cleaner M5060. Thereby, the wiper blades M5020A to M5020C are configured to be cleaned of inks and the like which have been adhered to themselves. In addition, the wiper portion M5020 has the following configuration (a wetting liquid transferring unit). A wetting liquid is transferred onto the wiper blades M5020A to M5020C before wiping. This enhances cleaning performance of the wiping operation. Descriptions will be provided later for a configuration of this wetting liquid transferring unit and the wiping operation.

The suction pump M5000 is capable of generating negative pressure in a state where an airtight space is formed inside the cap M5010 by connecting the cap M5010 to the ejection faces. Thereby, inks can be filled in the ejecting portions from the ink tanks H1900. In addition, dust, adhering matter, bubbles and the like which exist in the ejection openings and the internal ink passage leading to the ejection openings can be removed by suction.

What is used for the suction pump M5000 is, for example, a tube pump. This includes a member having a curved surface which is formed by squeezing and holding at least part of a flexible tube; a roller being capable of pressing the flexible tube towards the member; and a roller supporting part which supports the roller, and which is capable of rotating. Specifically, the roller supporting part is rotated in a predetermined direction, and thereby the roller is rolled on the member in which the curved surface has been formed, while pressing the flexible tube. In response to this, the negative pressure is generated in the airtight space formed by the cap M5010. This negative pressure sucks inks from the ejection openings, and subsequently sucks up the inks into the tube or the suction pump from the cap M5010. Thereafter, the sucked inks are further transferred to a suitable member (a waste ink absorbing member) provided inside the lower case M7080.

Note that an absorbing member M5011 is provided to the inside portion of the cap M5010 for the purpose of reducing the amount of inks remaining on the ejection faces of the printing head H1001 after the suction. In addition, consideration is made for sucking inks, which remain in the cap M5010 and the absorbing member M5011, in a state where the cap M5010 is opened, and for thus precluding the ink residue from coagulating and for accordingly preventing an adverse affect from occurring subsequently by sucking. It is desirable that no abrupt negative pressure should work on the ejection faces by providing an open-to-atmosphere valve (not illustrated) in a middle of the ink suction passage, and by thus beforehand opening the valve when the cap M5010 is intended to be detached from the ejection faces.

Furthermore, the suction pump M5000 can be operated not only for the purpose of the recovery by suction, but also for the purpose of ejecting inks which have been received by the cap M5010 by the preliminary ejection operation performed in the state where the cap M5010 is opposite to the ejection faces. Specifically, when an amount of inks held in the cap M5010 after preliminary ejection reaches a predetermined amount, the inks held in the cap M5010 can be transferred to the waste ink absorbing member through the tube by operating the suction pump M5000. The preliminary ejection operation is performed in a state of the cap M5010 which is opposed to the ejection face.

The series of operations performed successively, such as the operations of the wiper portion M5020, the ascent/descent of the cap M5010 and the opening/closing of the valve, can be controlled by means of a main cam (not illustrated) provided on the output axle of the motor E0003, and a plurality of cams and arms and like which move so as to follow the main cam. Specifically, rotation of the main cam in response to a direction in which the motor E0003 rotates operates cams, arms and the like in each of the units and parts. Thereby, the predetermined operations can be performed. The position of the main cam can be detected with a position detection sensor such as a photo-interrupter.

Wetting Liquid Transferring Unit (Refer to FIGS. 12 and 13)

Recently, inks containing pigment components as coloring agents (pigmented inks) are increasingly used for the purpose of enhancing the printing density, water resistance, light resistance of printed materials. Pigmented inks are produced through dispersing coloring agents themselves, which are originally solids, into water by adding dispersants thereto, or by introducing functional groups to pigment surfaces. Consequently, dried matter of pigmented inks resulting from drying the inks through evaporating moisture from the inks on the ejection faces damages the ejection faces more than dried coagulated matter of dyed inks in which the coloring agents are dissolved at molecular level. In addition, polymer compounds used for dispersing the pigments into the solvent are apt to be adsorbed to the ejection faces. This type of problem occurs in matter other than pigmented inks in a case where polymer compounds exist in the inks as a result of adding reactive liquids to the inks for the purpose of administering the viscosities of the inks, for the purpose of enhancing the light resistance of the inks, or for other purposes.

In this embodiment, a liquid is transferred onto, and adhered to, the blades of the wiper portion M5020, and thus the wiping operation is performed with the wetted blades, in order to solve the foregoing problem. Thereby, the present embodiment attempts at preventing the ejection faces from deteriorating due to the pigmented inks, at reducing the abrasion of the wiper, and at removing the accumulated matter by dissolving the ink residue accumulated on the ejection faces. Such a liquid is termed as the wetting liquid from the viewpoint of its function in the description. The wiping by use of this liquid is termed as the wet wiping.

This embedment adopts a configuration in which the wetting liquid is stored inside the main body of the printing apparatus. Reference numeral M5090 denotes a wetting liquid tank. As the wetting liquid, a glycerin solution or the like is contained in the wetting liquid tank M5090. Reference numeral M5100 denotes a wetting liquid holding member, which is fibrous member or the like. The wetting liquid holding member M5100 has an adequate surface tension for the purpose of preventing the wetting liquid from leaking from the wetting liquid tank M5090. The wetting liquid holding member M5100 is impregnated with, and holds, the wetting liquid. Reference numeral M5080 denotes a wetting liquid transferring member, which is made, for example, of a porous material having an adequate capillary force. The wetting liquid transferring member M5080 includes a wetting liquid transferring part M5081 which is in contact with the wiper blade. The wetting liquid transferring member M5080 is also in contact with the wetting liquid holding member M5100 infiltrated with the wetting liquid. As a result, the wetting liquid transferring member M5080 is also infiltrated with the wetting liquid. The wetting liquid transferring member M5080 is made of the material having the capillary force which enables the wetting liquid to be supplied to the wetting liquid transferring part M5081 even if a smaller amount of wetting liquid remains Descriptions will be provided for operations of the wetting liquid transferring unit and the wiper portion.

The cap M5010 is first set to the lowered position, and the carriage M4000 is moved out to a position where it does not come into contact with the wipers M5020A~M5020C. In this condition, the wiper portion M5020 is moved in the −Y direction, and passed through a part of the blade cleaner M5060 to be brought into contact with the wetting liquid transfer portion M5081 (FIG. 13). That is, the wipers M5020A, M5020B, and M5020C come sequentially into contact with the transfer portion M5081 in this order. This causes an appropriate amount of the wetting liquid to be transferred to each of the wipers. Note that the wiper 5020A is in the form of one plate as described above in FIG. 11. On the other hand, each of the other wiper blades M5020B and M5020C has a configuration in which it is divided into two plate-like parts. In wiping, the wipers M5020A, M5020B, and M5020C sequentially wipe the ejection opening formed face of the printing head. During the wiping, the first wiper M5020A mainly wipes the face while applying the transferred wetting liquid to the ejection opening formed face. Also, the subsequent wipers M5020B and M5020C function to mainly scrape ink droplets and the like on the ejection opening formed face, which have been dissolved by the wetting liquid from the blade M5020A.

Then, the wiper portion M5020 is moved in the +Y direction. A portion where each of the blades comes into contact with the blade cleaner M5060 is a surface to which the wetting liquid is not attached, so that the wetting liquid is still being held by each of the blades M5020A, M5020B, and M5020C.

After the wipers have returned to the starting position of wiping, the carriage M4000 is moved to the wiping position. Moving the wiper portion M5020 in the −Y direction again causes wet wiping to perform. That is, a surface of the wiper M5020A, to which the wetting liquid is attached, wipes the ejection opening formed face of the printing head H1001, and the subsequent wipers M5020B and M5020C scrape ink and the like while applying the wetting liquid to the ejection opening formed face. Subsequently, the wiper M5020 comes into contact with the blade cleaner M5060 while moving, thereby removing the ink and the like attached to the wipers.

Configuration of Electrical Circuit

Descriptions will be provided next for a configuration of an electrical circuit of this embodiment.

Figure 14:
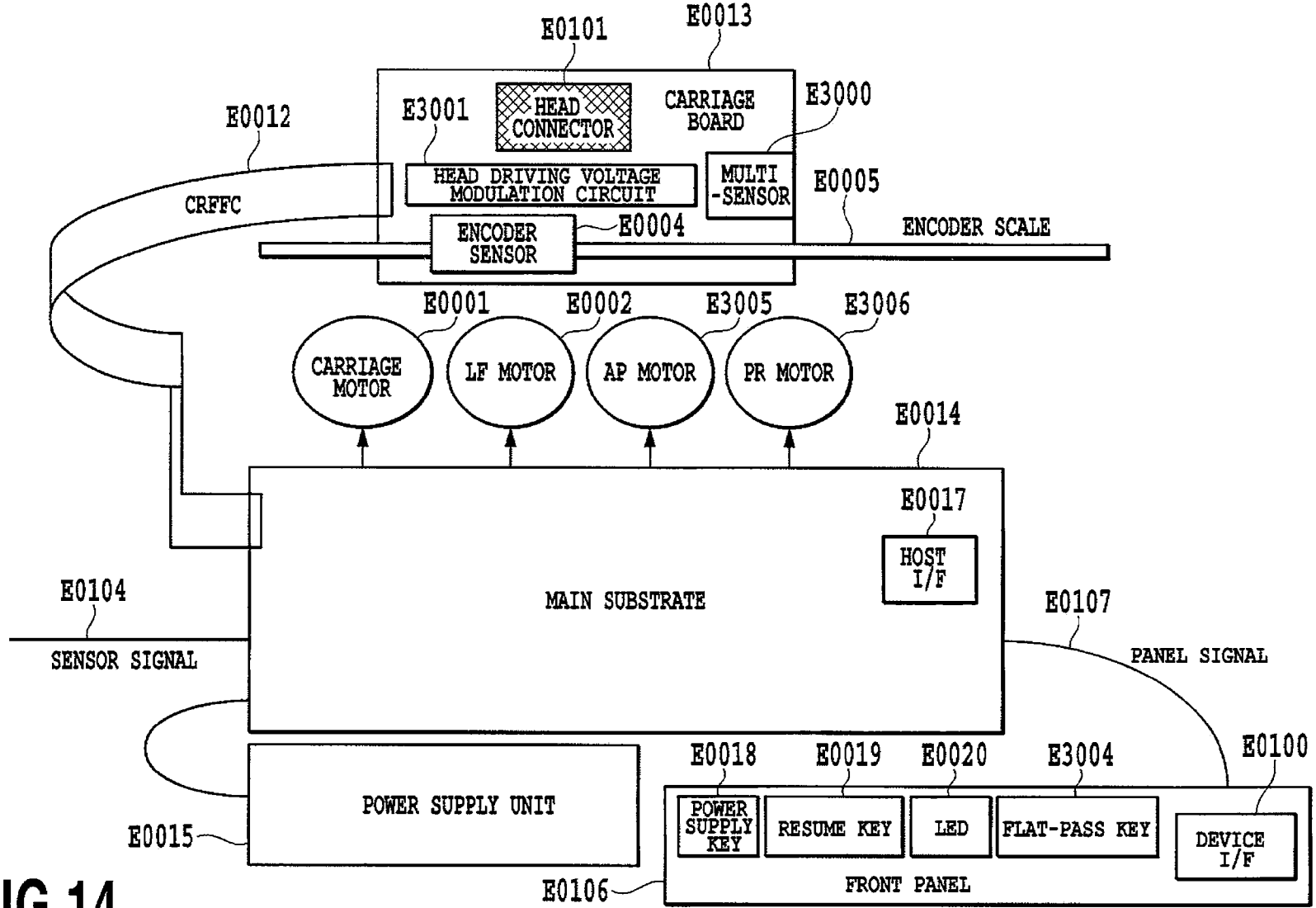
FIG. 14 is a block view of an electrical circuit in the printing apparatus in FIG. 2.

FIG. 14 is a block diagram for schematically describing the entire configuration of the electrical circuit in the printing apparatus according to the embodiment. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

Figure 16:
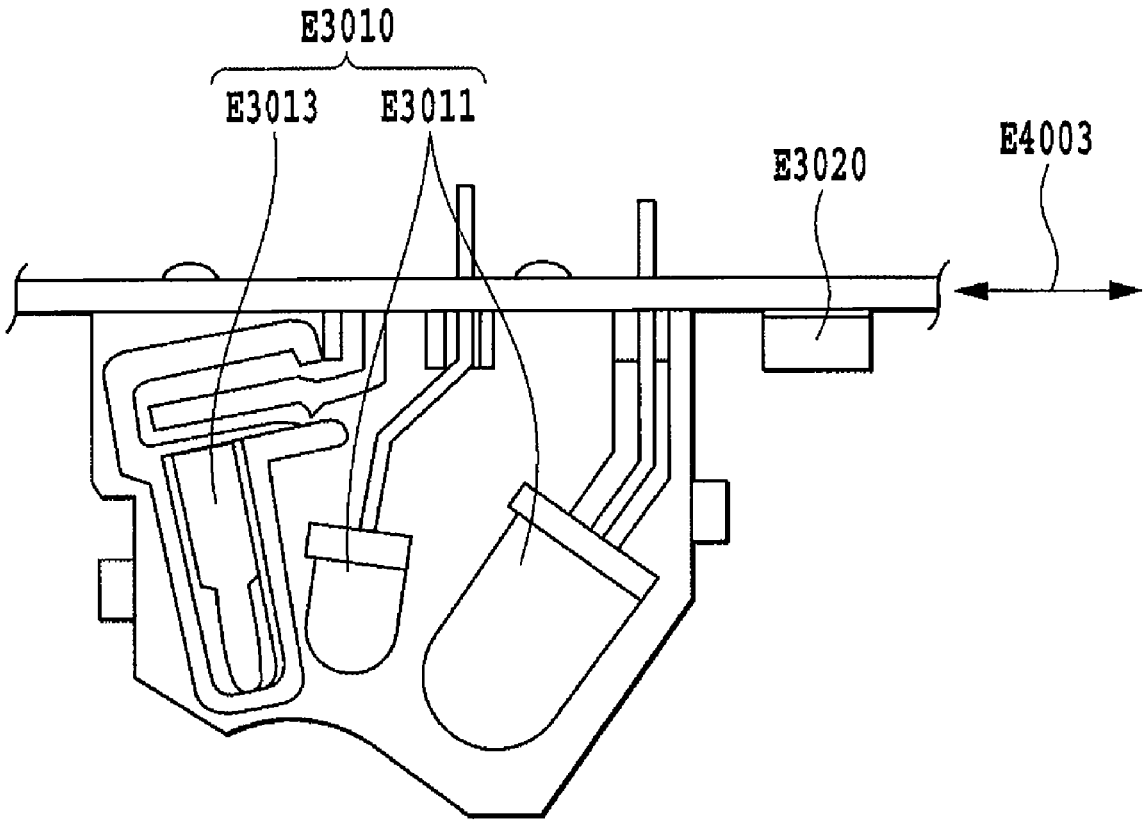
FIG. 16 is a configuration view of a multisensor implemented on a carriage substrate in FIG. 14.

An optical sensor E3010 and a thermistor E3020 are connected to the carriage board E0013, as shown in FIG. 16. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus (not shown). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 2). The front panel E0106 further includes a device I/F E0100 which is used for connecting peripheral devices, such as a digital camera, to the printing apparatus.

Figure 15:
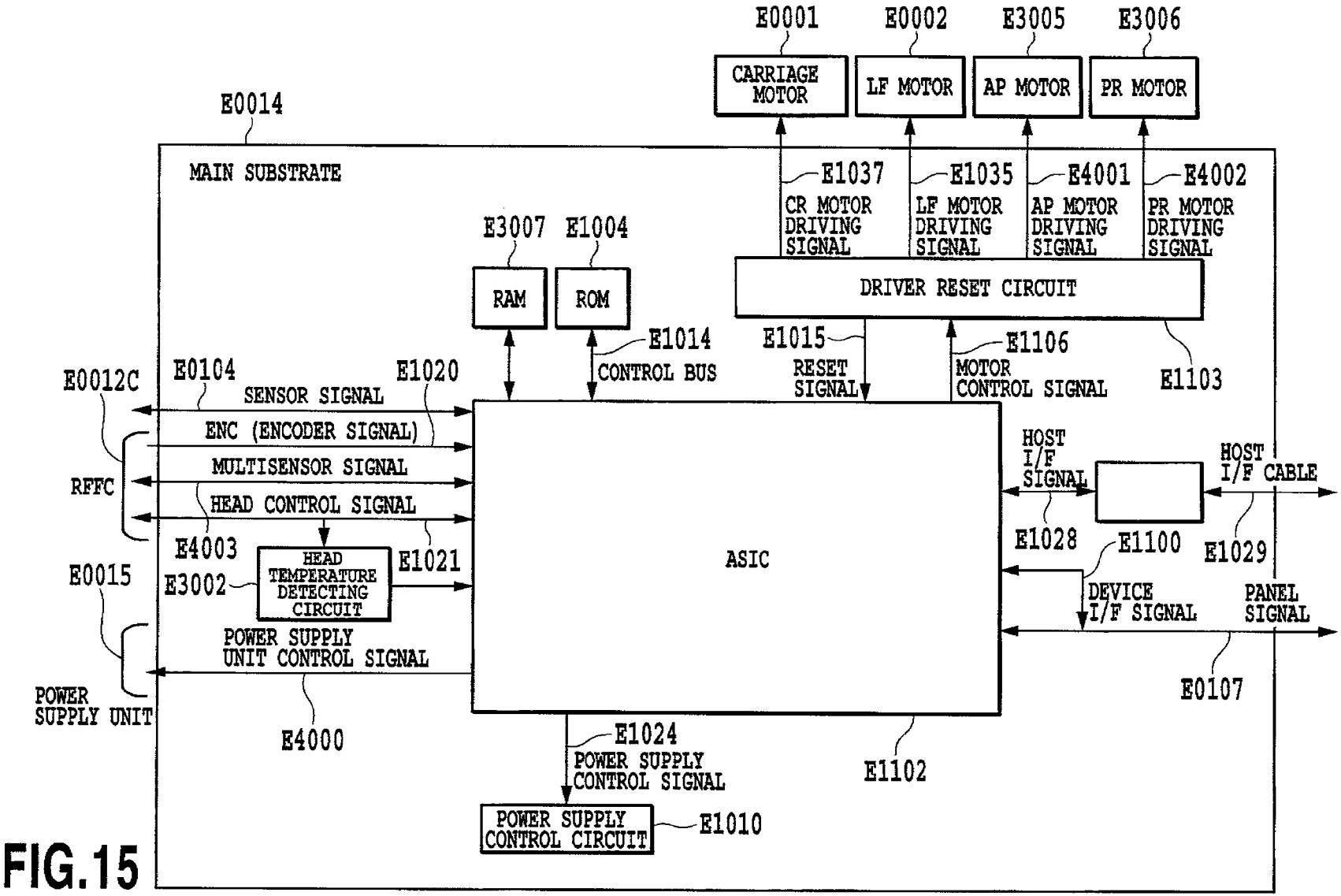
FIG. 15 is a block configuration view of a main substrate in FIG. 14.

FIG. 15 is a block diagram showing an internal configuration of the main substrate E1004.

In FIG. 15, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices. The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 17:
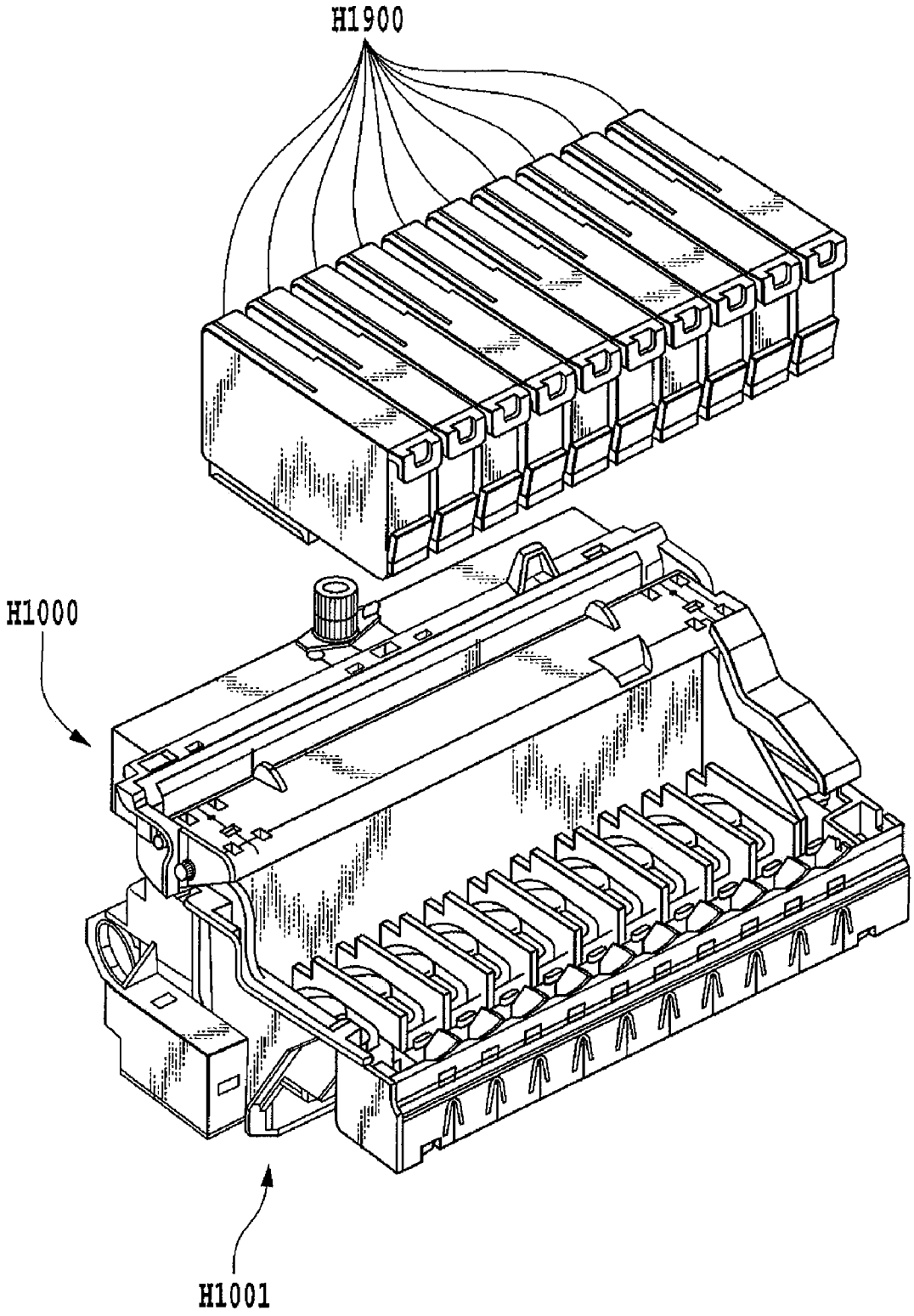
FIG. 17 is a perspective view of a head cartridge and an ink tank used for the printing apparatus in FIG. 2.

FIG. 17 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 17, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

Compositions of Inks

Descriptions will be provided below for the ten color inks used in the present invention.

The ten colors used in the present invention are cyan (C), light cyan (Lc), magenta (M), light magenta (Lm), yellow (Y), black 1 (K1), black 2 (K2), gray (Gray), red (R) and green (G). It is desirable that all of the coloring agents used respectively for the ten colors should be pigments. In this respect, for the purpose of dispersing the pigments, publicly known dispersants may be used. Otherwise, for the purpose, it is sufficient that pigments surfaces are modified by use of a publicly known method, and that self-dispersants are added thereto. In addition, coloring agents used for at least some of the colors may be dyes as long as the use agrees with the spirit and scope of the present invention. Furthermore, coloring agents used for at least some of the colors may be what are obtained by harmonizing pigments and dyes in color, and a plurality of kinds of pigments may be included therein. Moreover, as for the ten colors of the present invention at least one kind of substance selected from the group consisting of an aqueous organic solvent, an additive, a surfactant, a binder and an antiseptic may be included in therein as long as the inclusion is within the spirit and the scope of the present invention.

Preferred constituent materials for ten-colored ink used in the embodiment are now specifically described.

Pigments

Color pigments may include organic pigments. Specifically, some examples of them include dyed lake-based pigments such as acid dye-based lake and basic dye-based lake, insoluble azo pigments such as monoazo yellow, disazo yellow, β-naphthol-based, naphthol-AS-based, pyrazolone-based, and benzimidazolone-based, condensed azo pigments, azo lake pigments, and condensed polycyclic-based pigments such as phthalocyanine-based, quinacridone-based, anthraquinone-based, perylene-based, indigoid, dioxazine-based, quinophthalon-based, isoindolinone-based, and diketopyrrolopyrrole-based. It should be appreciated that the color pigments are not limited to the above pigments, but may include other organic pigments.

As a pigment used for a black pigment, a carbon black is preferred. For example, any of the carbon blacks such as furnace black, lamp black, acetylene black, and channel black may be used. Also, any carbon black separately and newly dispensed for the present invention may be used. However, the present invention is not limited to these carbon blacks, but may use any of well-known carbon blacks. Also, the present invention is not limited to such carbon blacks, but may use magnetic fine particles such as magnetite or ferrite, titan black, or the like as the black pigment.

To disperse the pigments, a well-known and general dispersant may be used, or a pigment surface may be reformed based on a well-known and general method to thereby provide self-dispersibility.

Also, a water-soluble organic solvent, an additive, a surfactant, and an antiseptic may be added to the ink, and any well-known and general materials may be respectively used for them.

2. Characteristic Configurations of the Embodiments

A characteristic configuration of each of the embodiments according to the present invention described below relates to wet wiping, and more particularly, to an operation or a process to be performed when a remaining amount of a wetting liquid decreases.

A basic configuration of wet wiping is described in FIGS. 12 and 13. Before each of the embodiments is described, wet wiping according to the embodiments is further described in detail.

Figure 18:
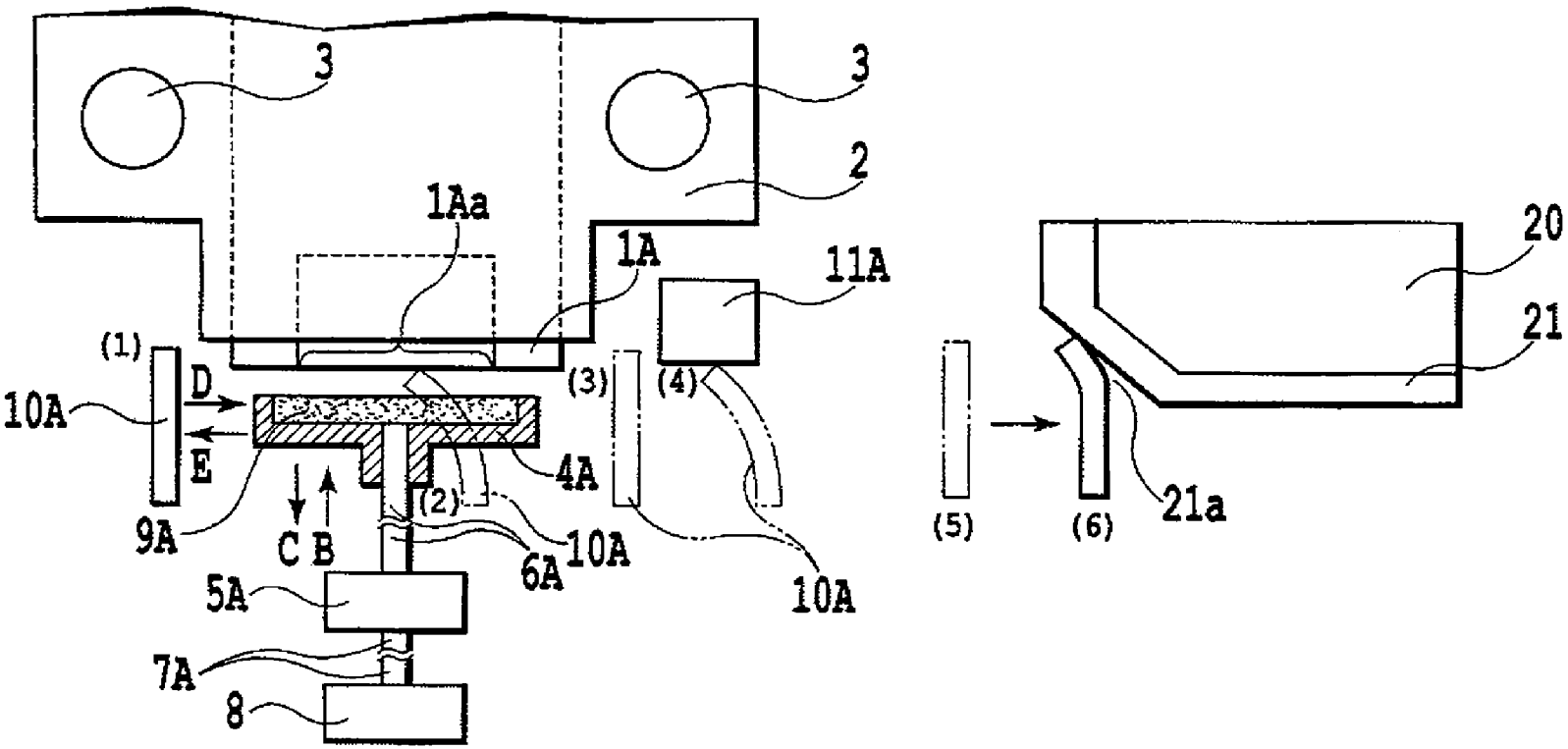
FIG. 18 is a view illustrating a basic configuration of wet wiping according to an embodiment of the present invention.

FIG. 18 is a view illustrating a configuration of wet wiping. Note that for each of components shown in FIG. 18, reference symbols different from that for corresponding components shown in FIGS. 12 and 13, etc is used. However, it is clear from the description below that basic functions and operations of them are the same as those described in FIGS. 12 and 13, etc. Also, in FIG. 18, only the wiper M5020A among three wipers M5020A, M5020B and M5020C shown in FIG. 12, etc. is shown as a wiper 10A. Each of the unshown wipers M5020B and M5020C performs the same operation as that of the wiper 10 A described below.

In FIG. 18, a unit for wet wiping is provided near a turnback position of the wiper (blade) on the right side of a blade cleaner 11A. In this unit, reference numerals 20, 21, and 21*a* denote a wetting liquid holding member, a wetting liquid transfer member, and a transfer portion with which the wiper 10A comes into contact to attach the wetting liquid thereto, respectively. The wiper 10A moves from the left-hand side of the figure to be cleaned by the blade cleaner 11A, then passes through the cleaner, and reaches the wet wiping unit (movement of (4)→(5)→(6) in the figure). The wiper 10A reciprocates from side to side in the figure, and the wet wiping unit is arranged such that the wiper 10A comes into contact with the transfer portion 21*a* at a position (6) of the turn-back position. In the transfer portion, the wetting liquid is transferred according to a predetermined nip width.

After the wetting liquid has been transferred, the wiper 10A again moves from (6) to (1), and stops at a waiting position for the wiper. Note that at this time, the blade cleaner 11A is in a position where it is moved out by an unshown mechanism. Also, the carriage 2 moves from the wiping position, so that a surface on the opposite side of a wiping surface of the wiper does not wipe the ejection opening formed face. That is, the wiper moves as (6)→(5)→(3)→(1), it eventually returns to a stop position (1). In addition, in the above system, the first wiping is actually performed while the wetting liquid is not transferred to the wiper. However, the wetting liquid is very unlikely to evaporate, so that the wetting liquid used for previous wiping still remains on the wiper. Also, the wetting liquid has higher viscosity than that of ink used for an ordinary ink-jet printer, so that it never flows out after it has been attached to the wiper. Furthermore, a condition change of the face of the printing head due to dry wiping performed only for the first time is negligible, compared with the number of times of wiping in terms of durability (hereinafter referred to as the of times of wiping on durability) during an apparatus lifetime, or the like.

In addition, an application of the present invention is not limited to the configuration described above, but is also effective for a wet wiping configuration using a rotary wiper as described, for example, Japanese patent Laid-Open No. 10-138502 (1998). Alternatively, it is also effective for other configurations in which a wiper as described above moves slidingly. Specifically, there may be employed a configuration in which in the above sliding wiper system, the turn-back position is provided between the positions (5) and (6), from which the wiper returns to the stop position (1). This enables the wiping including a transfer process of the wetting liquid (process of moving the wiper to the position (6) and then returning it to (1)) and the wiping process excluding the transfer of the wetting liquid (process of turning back the wiper at the position between (5) and (6) and then returning it to (1)) to be included.

Conditions of the wetting liquid, the holding and transfer portions for it, and the ejection opening formed face of the head in the wet wiping system as described above are as follows.

The wetting liquid holding member 20 is formed of polypropylene fibers having formed into a sponge-like appearance (hereinafter referred to as a PP sponge). A fiber diameter of the polypropylene fibers, an apparent density of the fibers having formed into the sponge, an orientation direction of the fibers in the sponge, a compressibility of the sponge at the time when it is incorporated in the device, and the like can be appropriately selected. The transfer member 21 is a member for transferring the wetting liquid from the PP sponge of the wetting liquid holding member 20 to the transfer portion 21*a*, and integrated with the transfer portion 21*a*. In the embodiment, Sunfine AQ 900 manufactured by Asahi Kasei Corporation is used as the transfer member 21. To surely supply the wetting liquid from the wetting liquid holding member 20 to the transfer member 21, there is a relationship in which capillary force of the transfer member 21 is higher than that of the wetting liquid holding member 20. An average pore diameter, an apparent density, the capillary force, and the like of the transfer member can be appropriately selected while the relationship is maintained.

Also, the wiper 10A employs polyether-urethane in the embodiment, and the ejection opening formed face of the head is in a condition of being coated with a water-repellent material.

The wetting liquid employs glycerin in the embodiment. Glycerin is characterized in that glycerin itself is unlikely to evaporate; however, it is likely to absorb moisture in the air, and even once it absorbs the moisture, it releases the moisture under a low humidity condition. For this reason, the wetting liquid holding member 20, the transfer member 21, and the like are preferably shielded therearound by an unshown material with low water vapor permeability so as not to be affected by moisture absorption or desiccation. However, they should not be completely sealed, but are preferably partially provided with fine pores for ventilation to endure expansion and contraction of air present in the wetting liquid holding member.

Also, a size of the wetting liquid holding member, i.e., a capacity of a tank back calculated from a wetting liquid requirement, can be calculated as follows. First, a transfer amount of the wetting liquid required so that there is no significant variation in water repellency of the face and landing position accuracy of ejected ink falls within an allowable range, even if wet wiping is performed the number of times corresponding to a number of sheets on durability of the ink-jet printing apparatus mounting the tank is obtained through an experiment and the like. Then, the capacity is adapted to be capable of holding the wetting liquid amount equals to the obtained transfer amount multiplied by the number of wiping corresponding to the number of sheets on durability.

For example, it is assumed that in the system shown in FIG. 18, transferring 1 mg of glycerin to the wiper and then coating it on the water-repellent-treated ejection opening formed face of the printing head for a single time of wet wiping enable the targeted number of sheets on durability, which is 10000, to be accomplished without any trouble. In this case, an amount of glycerin required before reaching the number of sheets on durability is 10 g. If in addition to this, a density of glycerin, an amount of glycerin held by the PP sponge, an amount of glycerin held by the transfer member, a remaining amount at the time when glycerin is used up, and the like are considered, the capacity of the glycerin holding portion will require approximately 20 cc. It cannot be usually expected that an initial injection amount of glycerin is 100% used up, although depending on a use up efficiency, so that approximately 1.2 times of the requirement should be injected. It should be appreciated that the above conditions, i.e., the amount of glycerin required for a single time of wiping, the number of sheets on durability, the amounts of glycerin held by the PP sponge and the transfer member should be appropriately set because they depend on a requirement of a printing apparatus.

Regarding a remaining amount detecting mechanism for the wetting liquid, in the embodiment, EEPROM (not shown) in the apparatus is assigned with a counter memory in which a remaining amount is stored. For example, it is only necessary to reduce the remaining amount by 1 mg by each time of wiping in such a way that an initial value is set to 10 g, and a maximum transfer amount is set to be the above-described 1 mg, even if a fluctuation due to a single time of wiping is assumed. A control using the remaining amount of the wetting liquid will be described later in detail.

In addition, the present invention is not only applied to the configuration as described above. For example, materials for the wetting liquid, the wetting liquid holding member, the transfer member, and the like; a condition of the ejection opening formed face, i.e., water repellency/non water repellency/hydrophilicity, and the like; surface tension of the ink, a contact angle of the ink with the above-described face, and the like, which are all indices of wettability of the ink, can be variously modified, and variations to different configuration are also possible. It should also be appreciated that regarding ink, the specification takes the case where the pigment ink is used; however, the present invention is applicable even if the ink is the dye ink.

Various embodiments characterizing configurations of the present invention are described below, regarding a control of wet wiping at the time when a remaining amount of the wetting liquid is decreased.

Embodiment 1

Embodiment 1 of the present invention is that a transfer amount is varied depending on a remaining amount detected (estimated in the embodiment) by a remaining amount detecting means. More specifically, an intrusion amount for the wiper comes into contact with the transfer portion is varied by mechanically moving the wet wiping unit up and down, and thereby a nip width in a portion with which the wiper comes into contact is varied. This increases the intrusion amount (nip width) with decreasing the remaining amount of the wetting liquid, to thereby minimize the variation in the transfer amount.

Figure 19:
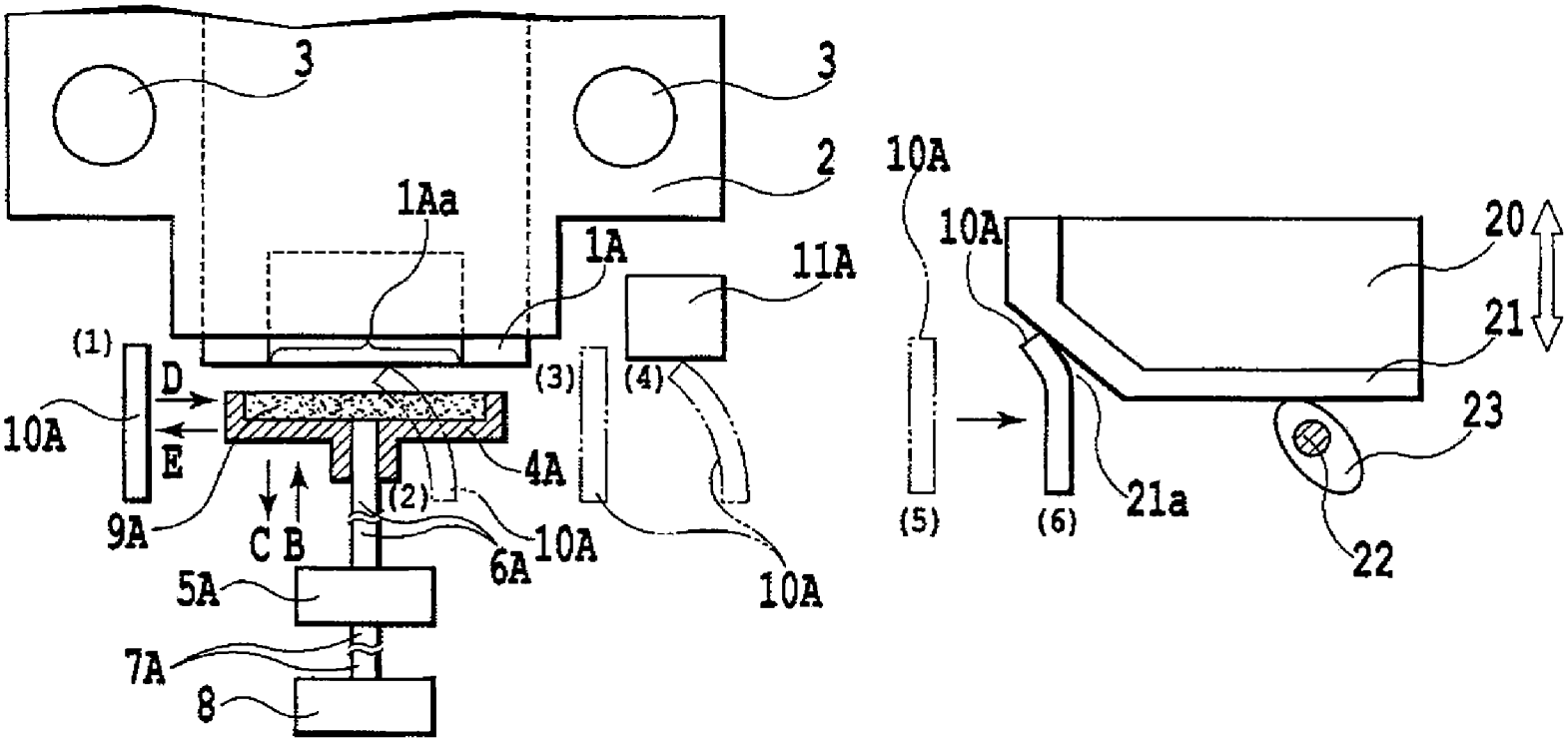
FIG. 19 is a view illustrating a configuration of wet wiping according to Embodiment 1 of the present invention.

FIG. 19 shows a view illustrating a configuration of wet wiping in the embodiment. In the figure, the reference numeral 23 denotes an eccentric cam, which rotates around a shaft 22 as a rotating shaft. The wetting liquid holding member (wetting liquid tank) is provided to be movable up and down by being supported by the eccentric cam. Further, the member is controlled by the above-described control and the driving sections, so as to move up and down depending on the remaining amount of the wetting liquid as shown in the following Table 1. That is, in the embodiment, the control is performed with reference to a table content shown in Table 1.

TABLE 1

| Remaining amount (g) | Intrusion amount of wiper (mm) | Transfer amount of wetting liquid (mg) *Experimental values | (Reference) Transfer amount of wetting liquid without control |
|---|---|---|---|
| 7 g or more | −0.2 mm | 1.0 mg | 1.2 mg |
| 7 g~4 g | Standard value | 1.0 mg | 1.0 mg |
| 4 g~2 g | +0.2 mm | 0.9 mg | 0.7 mg |
| Less than 2 g | +0.5 mm | 0.8 mg | 0.4 mg |

Table 1 shows that for example, the intrusion amount of the wiper to the transfer portion in the case where the remaining amount is in the range of 7~4 g is set as a standard value, and the transfer amount of the wetting liquid by a single time of wiping in the same case is 1.0 mg. When the remaining amount of the wetting liquid is gradually decreased and then estimated to be in the range of 4~2 g, the eccentric cam 23 is rotated to thereby move down the wetting liquid holding member 20, causing the intrusion amount to be increased by 0.2 mm higher than the above-described standard value. This increases an area of the wiper 10A where the wiper comes into contact with the transfer portion 21*a*, allowing the transfer amount to be maintained at approximately 0.9 mg, which is substantially the same amount as in the case of the standard value. Similarly, when it is determined that the remaining amount of the wetting liquid is less than 2 g, the intrusion amount of the wiper is increased by 0.5 mm higher than the standard value. This allows the almost same transfer amount (0.8 mg) to be maintained.

If such a control is not performed, it turns out that the transfer amount of the wetting liquid decreases with decreasing remaining amount of the wetting liquid as shown in the right hand of Table 1 as a reference, and particularly at a later stage of the apparatus lifetime, desired wet wiping performance cannot be provided.

On the other hand, according to the embodiment, mechanically controlling the intrusion amount of the wiper is executed, thereby enabling the transfer amount to be prevented from decreasing when the remaining amount decreases, and the transfer amount almost the same as that at an initial stage to be ensured even at the later stage of the apparatus life time.

In addition, in the above-described embodiment, the wetting liquid holding member is moved up and down; however, it may be configured to be moved right and left in FIG. 19 to thereby vary the intrusion amount of the wiper into the transfer portion 21*a*. That is, the turn-back position (6) for the wiper is mechanically fixed, so that in the case of the configuration shown in FIG. 19, i.e., in the case where a contact portion of the wiper is arranged so as to have an angle of 45° or the like (other than horizontal), not only the upward and downward movement, but also the rightward and leftward movement can vary the intrusion amount of the wiper.

As described above, by making the intrusion amount variable, in which the wiper intrudes into the transfer portion, depending on the remaining amount of the wetting liquid, the transfer amount of the wetting liquid at the later stage of the apparatus lifetime can be prevented from decreasing, and the desired wet wiping performance can be provided. As a result, printing quality can be maintained without large variation in condition of the ejection opening formed face of the head due to the wiping throughout the apparatus life time or deterioration in impact accuracy of the ink until the later stage of the lifetime.

Embodiment 2

Figure 20:
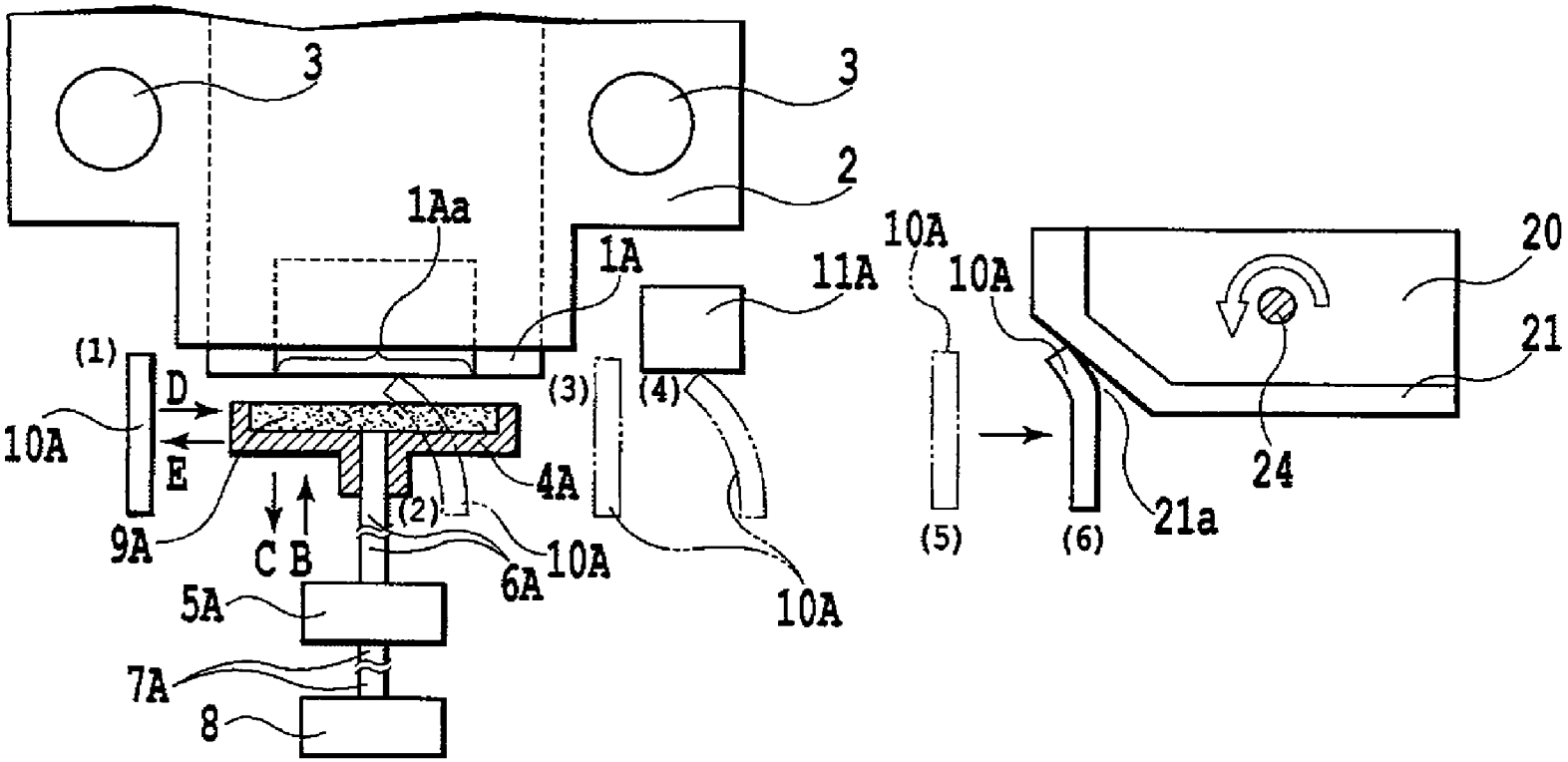
FIG. 20 is a view illustrating a configuration of wet wiping according to Embodiment 2 of the present invention.

A second embodiment of the present invention is that as shown in FIG. 20, the holding member 20 (wetting liquid tank) is provided so as to rotate around a shaft 24, differently from the above-described Embodiment 1. Configuring such a rotating mechanism enables space to be saved more than the configuration of the upward and downward movement in Embodiment 1. That is, it is not required to have a large space for the upward and downward movement of the wetting liquid tank as Embodiment 1, and enables an intrusion amount of the wiper for the transfer portion 21*a* to be varied substantially similarly to Embodiment 1 while narrowing a range of movement.

Controlling the intrusion amount, which is made by rotating the wetting liquid tank, depending on the remaining amount of the wetting liquid in the printing apparatus is the same as that in Embodiment 1. It should be appreciated that a degree of the variation in the intrusion amount at the time of a predetermined remaining amount may be appropriately set to be thereby able to provide the desired wet wiping performance.

Embodiment 3

Figure 21:
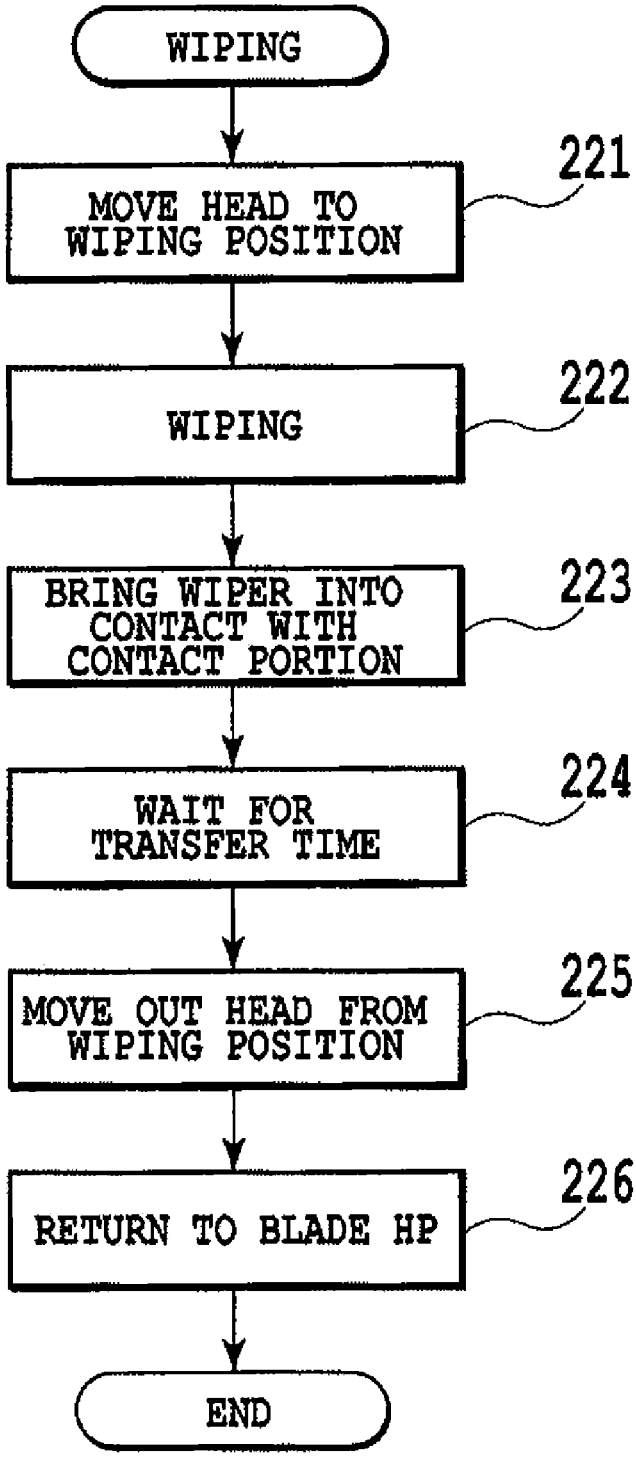
FIG. 21 is a flowchart illustrating a sequence of wet wiping according to Embodiment 3 of the present invention.

A third embodiment of the present invention is that a time period for which the wiper comes into contact with the transfer portion is varied depending on a remaining amount of the wetting liquid. FIG. 21 shows a flowchart illustrating a wet wiping process according to the third embodiment of the present invention.

In FIG. 21, it is first checked in step 221 that the printing head and the wiper are in wiping positions. Then, in step 222, wiping is performed. That is, in the wiping, ink and the like on the ejection opening formed face are dissolved by the wetting liquid transferred to the wiper 10A in the previous operation. Subsequently, in step 223, the wiper 10A is brought into contact with the wetting liquid transfer portion 21*a*. At this time, the wiper 10A waits for a time period (transfer time) corresponding to the remaining amount of the wetting liquid while contacting with the transfer portion 21*a* in step 224. The transfer time is determined according to a table content of Table 2 below, depending on the remaining amount of the wetting liquid stored in the EEPROM of the printer. In addition, the transfer times for the three wipers (M5020A, M5020B and M5020C) are the same as one another in the embodiment, and therefore the following description is made for one of the wipers. Also, the same is true in Embodiment 4 and the subsequent embodiments.

After the above-described waiting time for transfer has elapsed, the printing head is moved out to a position where it does not come into contact with the wiper in step 225, and then in step 226, the wiper is returned to a home position for the wiper, where it is prepared for the next wiping.

TABLE 2

| Remaining amount (g) | Contact time of wiper (sec) | Transfer amount of wetting liquid (mg) *Experimental values | (Reference) Transfer amount of wetting liquid without control |
|---|---|---|---|
| 7 g or more | 0.2 sec | 1.0 mg | 1.2 mg |
| 7 g~4 g | Standard (0.5 sec) | 1.0 mg | 1.0 mg |
| 4 g~2 g | 1 sec | 0.9 mg | 0.7 mg |
| Less than 2 g | 2 sec | 0.8 mg | 0.4 mg |

As shown in Table 2, the control of the transfer time of the wetting liquid depending on the remaining amount of the wetting liquid in the embodiment is intended to increase the transfer time to ensure the transfer amount regardless of the decrease in remaining amount of the wetting liquid.

For example, when the remaining amount is in the range of 4 g~2 g, the contact time of the wiper is set to 1 sec to promote the transfer of the wetting liquid, whereby the transfer amount of 0.9 mg substantially the same as in the case of the standard transfer time (0.5 sec) can be maintained. In addition, it should be appreciated that the contact time of the wiper is appropriately set, depending on the intensity of negative pressure of the wetting liquid holding member, a material for the wiper, a material for a contacting member, a mechanical configuration, and the like.

As described above, the embodiment is adapted to control the transfer amount of the wetting liquid by varying the contact time of the wiper with the wetting liquid transfer portion depending on the remaining amount of the wetting liquid. For this reason, it is not necessary for the embodiment to have a mechanism for operating the wetting liquid tank as in Embodiment 1 or 2. Accordingly, it has advantages in cost reduction and downsizing of the apparatus, compared with Embodiments 1 and 2.

Embodiment 4

A fourth embodiment is configured such that the transfer process described in the above Embodiment 3 is performed immediately before wiping. Also, the transfer depending on the remaining amount is performed a plurality number of times as required.

Figure 22:
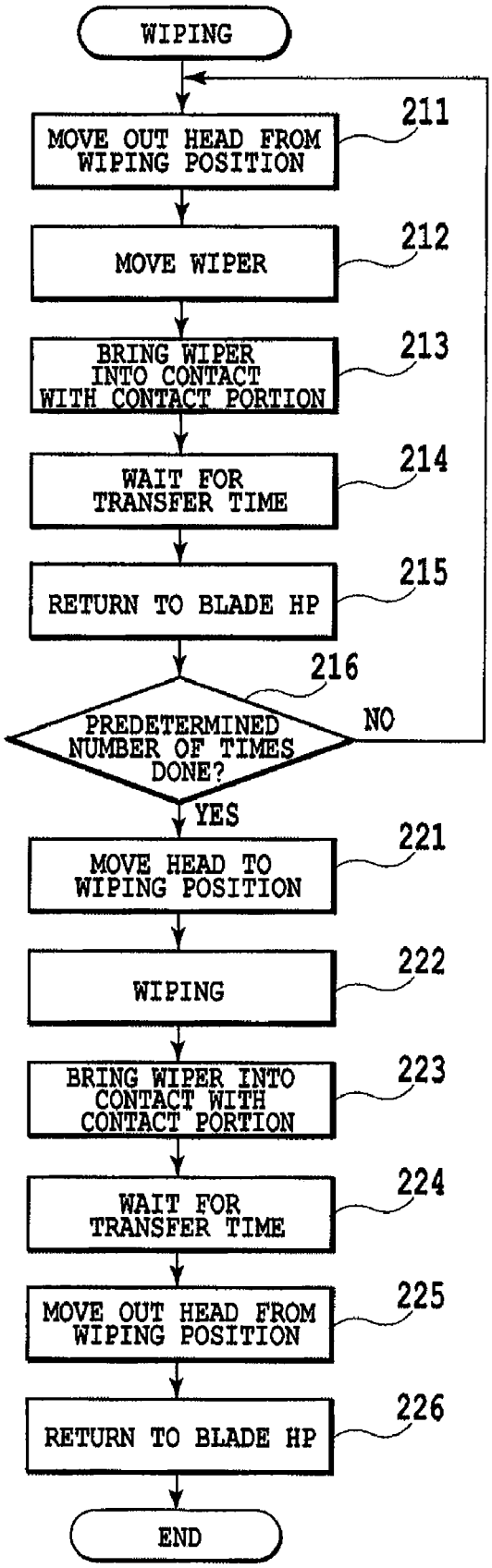
FIG. 22 is a flowchart illustrating a wet wiping operation according to Embodiment 4 of the present invention.

FIG. 22 is a flowchart showing a wiping operation according to the fourth embodiment of the present invention. This process is configured such that steps 211 to 216 are added to the process shown in FIG. 21.

Steps 211 to 216 show a process for transferring the wetting liquid immediately before the wiping operation. First, the printing head is moved out in step 211, and in step 212, a moving operation of the wiper 10A is performed. Then, in step 213, the wiper 10A is brought into contact with the wetting liquid transfer portion 21*a*. In step 214, a contact time of it is set depending on a remaining amount of the wetting liquid, similarly to the above-described Embodiment 3. Subsequently, in step 215, the wiper is returned to the home position for the wiper. After that, in step 216, steps 211 to 215 are repeated a required number of times. The repeat number of times can also be determined depending on the remaining amount of the wetting liquid.

Configuring to transfer the wetting liquid immediately before wiping as described above enables a wet wiping function to be more surely fulfilled. Furthermore, configuring to repeat the transfer process a plurality number of times also enables the transfer amount to be increased.

Embodiment 5

A fifth embodiment of the present invention is configured to also use temperature of an environment in which the printing apparatus is placed, in addition to the remaining amount of the wetting liquid described in each of the above embodiments, and to control a transfer condition depending on the remaining amount of the wetting liquid and the environmental temperature.

Figure 23:
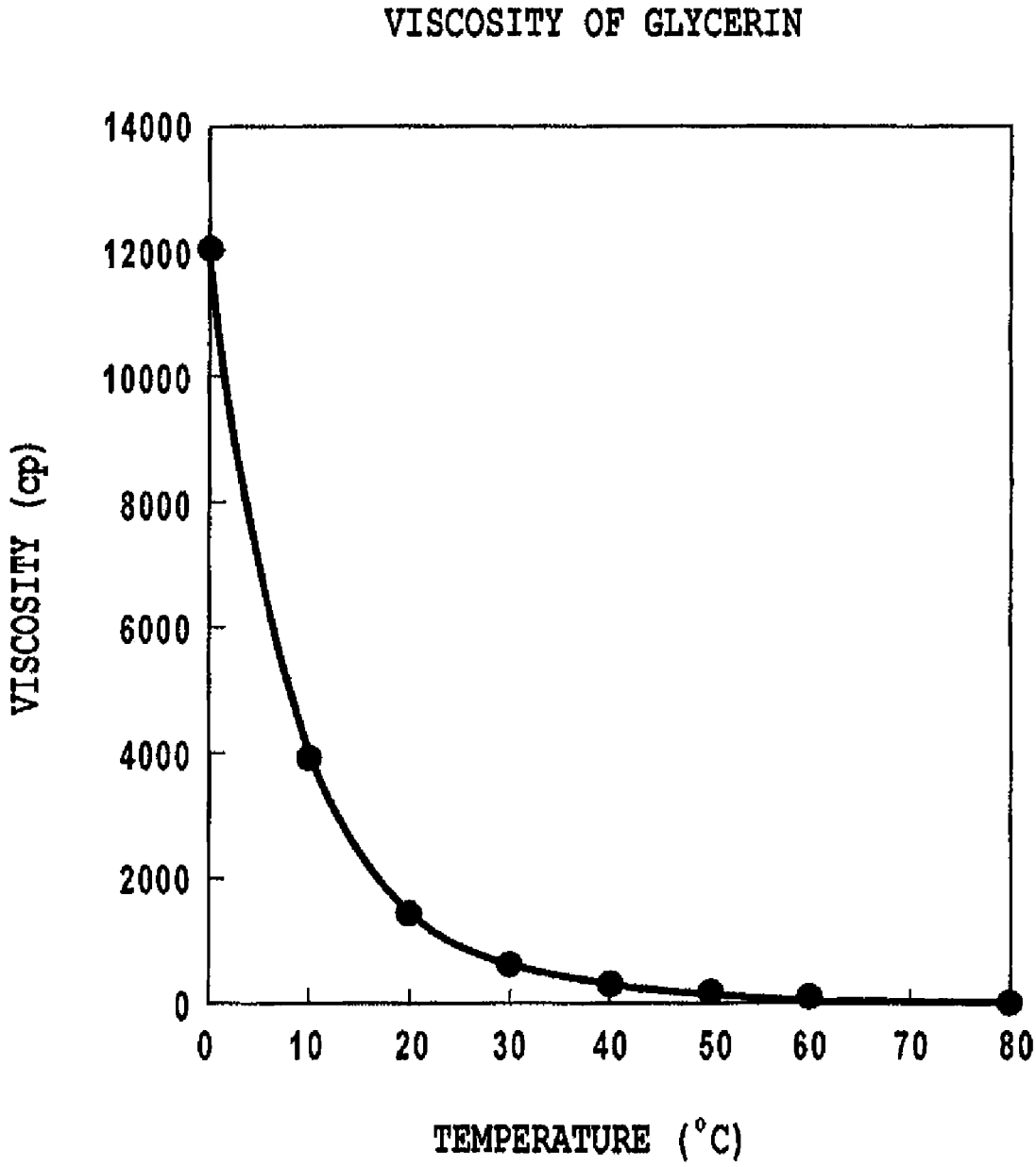
FIG. 23 is a graph illustrating a temperature-viscosity curve for glycerin used for the wetting liquid.

The wetting liquid should normally be kept until the end of the apparatus life time is reached. For this purpose, as the wetting liquid, a wetting liquid having low saturated vapor pressure in the air, i.e., the wetting liquid unlikely to evaporate, is preferably used. Also, if solubility for thickened matters of ink or liquid contacting with each member of the head is considered, polyhydric alcohols such as glycerin and polyethylene glycol, which are often used as compositions of ink used in ink-jet printing, are preferred. Many of these solvents have large molecular weights and high viscosities, so that a level of increase in viscosity under a low temperature environment is also large. FIG. 23 shows a temperature-viscosity curve for glycerin as an example. The viscosity rapidly increases with decreasing temperature, e.g., the viscosity of approximately 800 cp at room temperature increases to 2300 cp at 15° C., and to 7000 cp at 5° C.

For this reason, the transfer amount of the wetting liquid decreases particularly under a low temperature environment. This is because wettability of the wetting liquid with the wiper at the time when the wiper comes into contact with the transfer portion is insufficient due to viscosity. Alternatively, it can be considered that this is because the wetting liquid is unlikely to be detached from the transfer portion because the viscosity of the wetting liquid is high, when the wiper returns after contacting with the transfer portion.

In the embodiment, a temperature detecting section comprised of a thermistor and the like is provided near a recovering unit, with which environmental temperature affecting the wetting liquid is detected. Then, as shown in Table 3, the contact time with the transfer portion is controlled for each predetermined range within which environmental temperature to be detected falls, in the table for the contact time. In addition, the detected environmental temperature range of 20° C.~30° C. in a table content of Table 3 corresponds to the table content of the above-described Table 2.

Table 4 shows that the transfer amount is maintained substantially constant by the control according to the present embodiment, regardless of the variations in the remaining amount of the wetting liquid and in environmental temperature.

TABLE 3

| Remaining amount (g) | Environment temperature (° C.) ~10° C./ Contact time (sec) | 10° C.~20° C./ Contact time (sec) | 20° C.~30° C./ Contact time (sec) | 30° C.~/ Contact time (sec) |
|---|---|---|---|---|
| 7 g or more | +0.2 sec | +0.1 sec | 0.2 sec | −0.1 sec |
| 7 g~4 g | +0.4 sec | +0.2 sec | 0.5 sec | −0.2 sec |
| 4 g~2 g | +0.6 sec | +0.3 sec | 1 sec | −0.3 sec |
| Less than 2 g | +0.8 sec | +0.4 sec | 2 sec | −0.4 sec |

TABLE 4

| Remaining amount (g) | Environment temperature (° C.) ~10° C./ Transfer amount (mg) | 10° C.~20° C./ Transfer amount (mg) | 20° C.~30° C./ Transfer amount (mg) | 30° C.~/ Transfer amount (mg) |
|---|---|---|---|---|
| 7 g or more | 0.8 mg | 0.9 mg | 1.0 mg | 1.0 mg |
| 7 g~4 g | 0.8 mg | 0.8 mg | 1.0 mg | 1.0 mg |
| 4 g~2 g | 0.7 mg | 0.8 mg | 0.9 mg | 1.0 mg |
| Less than 2 g | 0.7 mg | 0.7 mg | 0.8 mg | 0.9 mg |

In addition, according to the present embodiment, setting the transfer time under a high temperature environment to be shorter than that at room temperature also enables the increase in transfer amount of the wetting liquid under a high temperature environment to be suppressed. By doing so, a steady supply of the wetting liquid independent of environment becomes possible, and taking out of a large amount of the wetting liquid is eliminated. This enables an amount of the wetting liquid, which should be contained before shipment of the apparatus, to be adjusted to an appropriate minimum amount.

In addition, an object to be controlled depending on a remaining amount of the wetting liquid and environmental temperature may be not only the contact time of the wiper, but also, for example, the intrusion amount described in Embodiments 1 and 2.

Embodiment 6

The above-described Embodiments 1 to 5 are configured to control a transfer amount of the wetting liquid. On the other hand, a sixth embodiment of the present invention is configured to vary the number of times of wiping operations to be performed in response to one wiping instruction, depending on a remaining amount of the wetting liquid (and environmental temperature).

Figure 24:
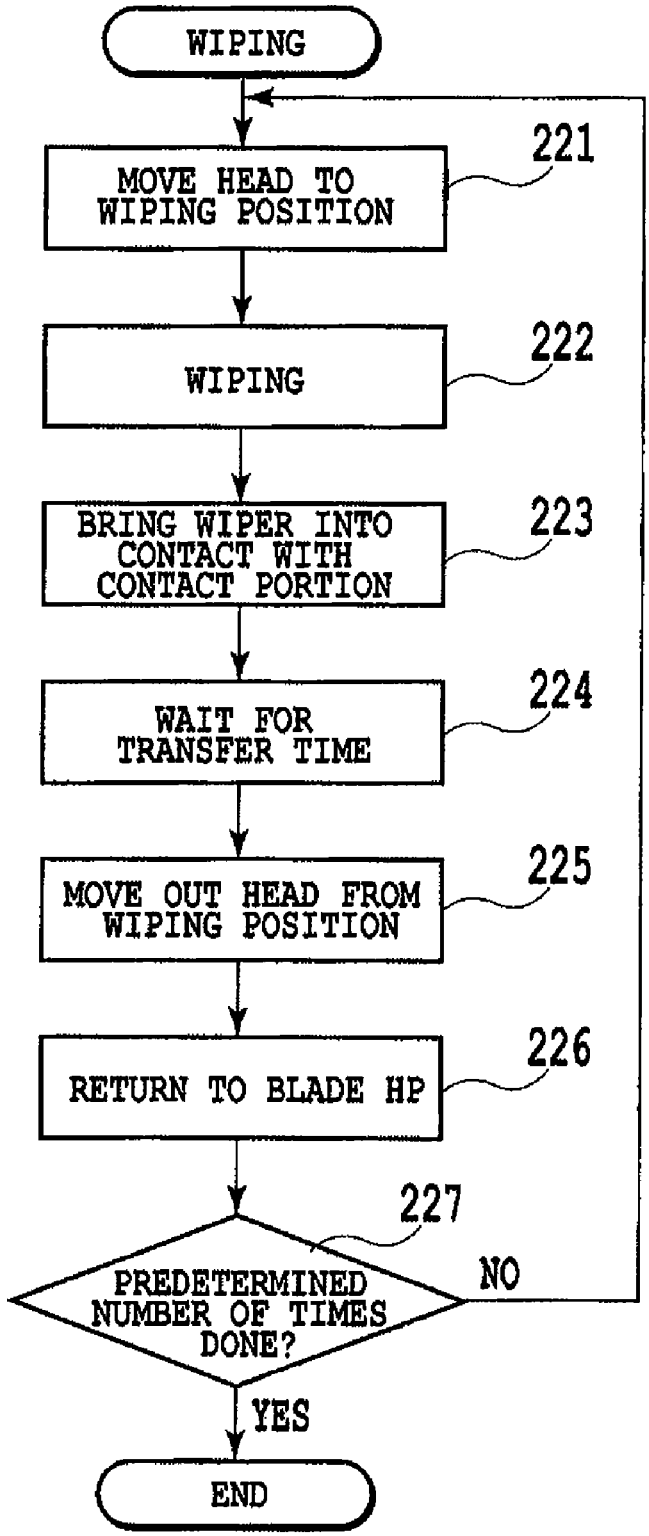
FIG. 24 is a flowchart illustrating a wiping operation according to Embodiment 6 of the present invention.

FIG. 24 is a flowchart showing the wiping operation according to the sixth embodiment of the present invention. Steps 221 to 226 shown in FIG. 24 are the same as the process in steps 221 to 226 shown in FIG. 21. In the subsequent step 227, it is determined whether wiping has been performed a number of times that is determined for each remaining amount of the wetting liquid (and environmental temperature). If it is determined that wiping has not been performed the number of times, the process in steps 221 to 226 is repeated. Note that the repeat number of times is adapted to be increased with decreasing remaining amount of the wetting liquid.

In the initial stage of use of the apparatus, a transfer amount of the wetting liquid to the wiper is sufficient, so that the ejection opening formed face can be cleaned by a single time of wiping. However, if a remaining amount of the wetting liquid becomes small in the later stage of the apparatus life time, the transfer amount of the wetting liquid to the wiper also becomes small. For this reason, an original wet wiping function cannot be fulfilled by only the single time of wiping, and therefore unwiped matters such as viscosity increased ink residues are left on the ejection opening formed face of the head. Accordingly, by setting the repeat number of times of wiping to a number of times corresponding to the remaining amount or environmental temperature, the unwiped matters cannot be left, and the ejection opening formed face of the head can also be kept appropriate.

Also, controlling transfer time in combination with controlling the repeat number of times depending on the remaining amount of the wetting liquid and the like enables more preferred control to be performed.

In addition, the embodiment can be performed with a relatively simple mechanical configuration in comparison with the above-described Embodiment 4. In Embodiment 4, there exist two cases regarding the wiper movement shown in FIG. 18, i.e., the case of the wiper movement of (3)→(4)→(5) immediately after the wiping of the printing head, and the case of the wiper movement of (3)→(4)→(5) for repeating steps 211 to 215 in FIG. 22 without wiping.

Note that after wiping, it is necessary to bring the blade cleaner 11A and the wiper into contact with each other to clean the wiper at the position (4). On the other hand, if the wiper and the blade cleaner 11A come into contact with each other at the position (4) while the wiper moves for the above repetitive transfer of the wetting liquid, the wetting liquid held by the wiper is removed by the cleaner. Therefore, it is necessary to move out the cleaner to a position where it does not come into contact with the wiper. As described, in Embodiment 4, a position of the blade cleaner 11A should be controlled according to two positions over the same directional wiper movement of (3)→(4)→(5), causing a complicated mechanical configuration. On the other hand, the present embodiment does not require such a configuration, and therefore can enhance a wet wiping function with a relatively simple configuration.

In addition, timing of performing the wet wiping operation in each of the above-described embodiments is the same as that in a conventional manner. That is, there exists so-called timer wiping configured such that after a cap open condition of the printing head has continued for a predetermined time period, the wiping is performed because the ejection opening formed face may be dried. Also, it is preferred to employ so-called dot count wiping in which wiping is performed while discharge dot counting is performed, because the ejection opening formed face may be stained with ink mist after a predetermined amount of printing or more has been performed. Alternatively, it may be performed at a timing before cap close in order to remove ink attached to the ejection opening formed face of the printing head before the cap close and prepare for a subsequent uncontrolled condition.

Also, a relatively large amount of un-sucked ink is attached to the ejection opening formed face even after a suction recovery operation, which is performed if fixed/thickened ink is present on the ejection opening of the printing head after long-term unused condition, so that wiping may be performed at a timing after the suction recovery in order to remove the un-sucked ink.

Figure 25:
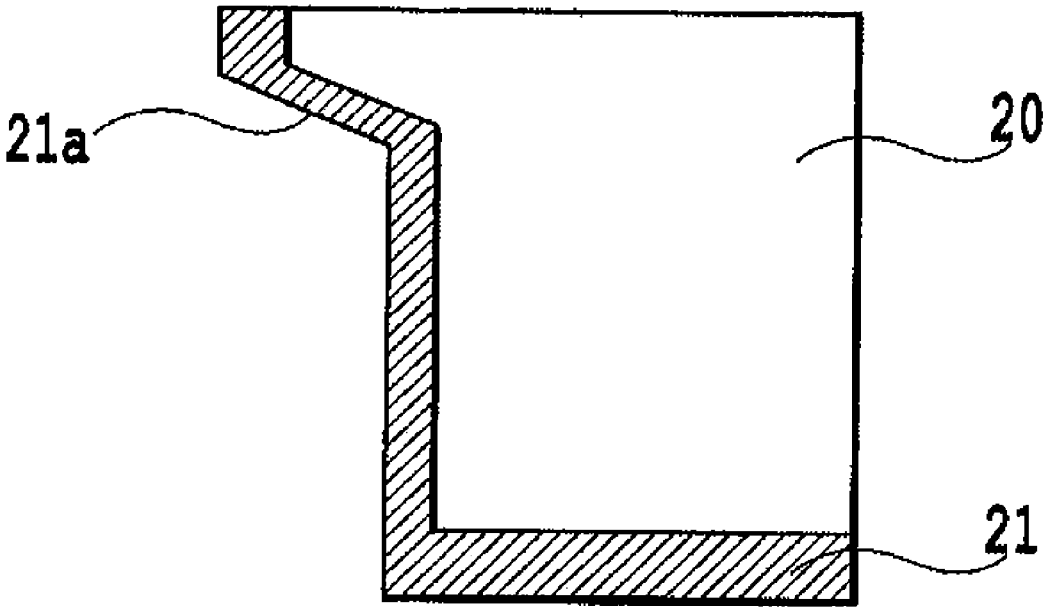
FIG. 25 is a view illustrating a configuration in which a wetting liquid tank is present below the wetting liquid transfer portion, according to one embodiment of the present invention.

Furthermore, as a mechanical configuration, there may be employed a configuration in which the wetting liquid holding member 20 and the transfer member 21 are present above the transfer portion 21*a* as shown in FIG. 18. Alternatively, there may be employed a configuration in which the wetting liquid holding member 20 and the transfer member 21 are present below the transfer portion 21*a* as shown in FIG. 25.

A system shown in FIG. 25 in which the wetting liquid is drawn from below has a favorable characteristic of being advantageous for leakage, etc. of the wetting liquid during physical distribution. Also, a correlation between a remaining amount and a transfer amount of the wetting liquid tends to be larger, so that the present invention is particularly effective in the system in which the wetting liquid is drawn from below as shown in FIG. 25.

As described above, according to each of the above-described embodiments, a transfer amount of the wetting liquid and a number of times of wiping are controlled depending on a remaining amount of the wetting liquid, so that desired wet wiping performance can be constantly provided. As a result, printing with good printing quality can be performed without large variation in condition of the ejection opening formed face due to wiping throughout an apparatus life time or without deterioration in impact accuracy of ink until the later stage of the lifetime.

Embodiments 7 to 10 described below perform an error display or other operations for assisting wet wiping when a remaining amount of the wetting liquid runs out or becomes small, rather than varying details of wet wiping as in the above-described embodiments. This configures a convenient printing apparatus in total.

Embodiment 7

A seventh embodiment of the present invention relates to a configuration that displays to a user a warning or an error indicating a remaining amount of the wetting liquid is small or has used out, in running short of the wetting liquid.

First, a relationship between a wetting liquid capacity of the wetting liquid holding member 20 and a possible number of times of wet wiping is described, which is briefly described in the above embodiments 1 to 6. A size of the wetting liquid holding member 20, i.e., a capacity of the holding member back calculated from a wetting liquid requirement can be calculated as follows. First, a transfer amount of the wetting liquid required so that there is no significant variation in water repellency of the ejection opening formed face and landing position accuracy of discharged ink falls within an allowable range even if wet wiping is performed the number of times corresponding to a number of sheets on durability (apparatus life time) of the ink-jet printing apparatus is obtained through an experiment or the like. Then, the capacity is configured to be capable of holding the wetting liquid amount equals to the obtained transfer amount multiplied by the number of wiping corresponding to the number of sheets on durability.

For example, assume that in a wet wiping system of the embodiment, 0.5 mg of glycerin is transferred to the wiper (three wipers in this case) in a single time of transfer and then the ejection opening formed face is wiped with the wiper. Also, the wiping is adapted to be capable of printing a targeted number of sheets on durability, which is 21000 (sheets), without any trouble. If the number of times of the wiping required for printing the number of sheets is estimated to be approximately 32000 (times), which is 1.5 times of the number of sheets on durability, a total glycerin amount will be 16 g.

If in addition to this, a density of glycerin, an amount of glycerin held by the PP sponge, an amount of glycerin held by the transfer member, a remaining amount at the time when glycerin is used up, and the like are considered, the capacity of the glycerin holding portion is approximately 32 cc. It cannot be usually expected that an initial injection amount of glycerin (Gross amount) is used up in an amount of 100% although depending on use up efficiency, so that a requirement (Net amount) is estimated based on the assumption that 80% of the Gross amount can be used. Conversely, approximately 1/0.8=1.25 times of the requirement should be injected. It should be appreciated that the above conditions, i.e., the amount of glycerin required for the single time of wiping, the number of sheets on durability, the amounts of glycerin held by the PP sponge and the transfer member should be appropriately set because they depend on a requirement of each printer.

Because it is difficult to accurately measure the above-described remaining amount of glycerin with a low-cost mechanism, a number of times wet wiping having been performed is usually counted, rather than the measurement of the remaining amount of glycerin. In the embodiment, the remaining amount of the wetting liquid is thus estimated. As described above, if a number of sheets on durability of the main body is assumed as 21000 (sheets), an upper limit of the number of times of wet wiping (which is defined as a wet wiping count value) is set to 32000 (times), which is approximately 1.5 times.

A temperature dependent variation in consumption amount of the wetting liquid is now described. FIGS. 26A and 26B show tables illustrating the relationship. As is clear from FIG. 26A, with increasing temperature, a transfer amount of the wetting liquid to the ejection opening formed face increases, whereas with decreasing the temperature, the transfer amount of the wetting liquid to the surface decreases. This is because of the variation in viscosity of glycerin used for the wetting liquid along with the change in temperature as described above, and particularly in a low temperature environment where the viscosity of glycerin increases, the transfer amount of the wetting liquid significantly decreases. Accordingly, as shown in FIG. 26B and as described above, the contact time of the wiper with the transfer portion is changed depending on environmental temperature. This enables the temperature dependent variation in transfer amount of the wetting liquid to be suppressed. However, controlling the contact time only has a certain limit, and as shown in FIG. 26B, a variation within the range of 0.3 mg to 0.5 mg may arise.

In the embodiment, 0.8T (g) that is an initial filling amount T (g) in a printer multiplied by a safety factor of 0.8 is defined as an initial net amount of the wetting liquid. Then, a remaining amount of the wetting liquid Wr (g) can be calculated based on the initial net amount, the wet wiping count N, and the maximum value W of a transfer amount of the wetting liquid in a single time of wiping. An expression for the calculation is given as follows:

$$Wr=T\times 0.08-W\times N$$

Assume that the initial filling amount T of glycerin in the wetting liquid tank is 20 g. Then, the net amount of the wetting liquid, which can be used for actual wet wiping, becomes 20×0.8=16 (g). The maximum value W of a transfer amount of the wetting liquid in a single time of wiping is 0.5 mg as can be seen from FIG. 26B, so that the remaining amount of the wetting liquid Wr, for example, after 10000 times of wiping has been performed becomes as follows:

$$Wr=20\times0.8-(0.5/1000)\times1000=11\ (g)$$

When a consumption rate of the wetting liquid reaches a certain threshold value (Th %) for the net amount after many times of wet wiping have been performed since the initial state of the printer, an error is issued and the printer is forcibly stopped. In the embodiment, the above threshold value Th is set to 100%. Accordingly, the number of times of wiping N_Th at the time when the consumption rate of the wetting liquid reaches the threshold value Th=100% becomes as follows:

$$N_Th=20\times0.8\times100\%/(0.5/1000)=3200$$

Thus, it follows that the 32000 times of wet wiping causes the wetting liquid to be consumed in an amount of 100%. The number of times of wiping N_Th at the time when the consumption rate of the wetting liquid reaches 100%, i.e., when a remaining amount of the wetting liquid reaches 0% of the net amount, is defined as a threshold value for an error indicating no remaining amount.

Figure 27:
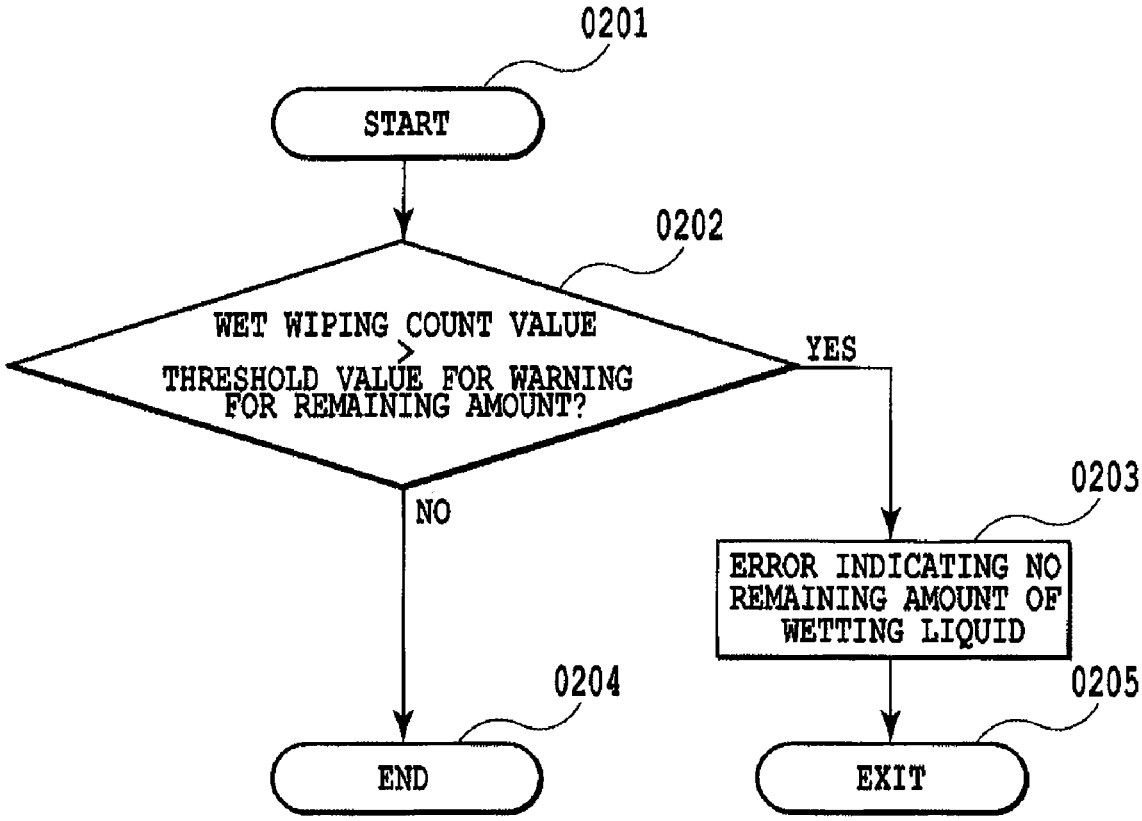
FIG. 27 is a flowchart illustrating a process for wet wiping according to Embodiment 7 of the present invention.

FIG. 27 is a flowchart showing a process for wet wiping according to the present embodiment. The process is performed every time immediately before wet wiping is performed. First, the process is started in step 0201. In step 0202, a wet wiping count value N in which an accumulated number of times since the initial stage of wet wiping is counted and the threshold value for an error indicating no remaining amount of the wetting liquid N_Th defined as above are compared with each other. If the wet wiping count value N is equal to or less than the threshold value for an error indicating no remaining amount of the wetting liquid N_Th, the process proceeds to step 0204 without doing anything, where it is ended. If the wet wiping count value N is more than the threshold value for an error indicating no remaining amount of the wetting liquid N_Th, an error indicating no remaining amount of the wetting liquid is displayed in step 0203, and in step 0205, the printer is brought into an error condition and forcibly stopped.

Regarding the error indicating no remaining amount of the wetting liquid in the above step 0203, information of the printer that cannot print any more is displayed as shown in FIG. 28 on a UI by a printer driver in a host PC connected to the printer. Then, functions of the printer are stopped. At this time, the printer does not accept any operation other than ON/OFF operation of a power switch. When the power switch is turned ON, the above error display is performed.

As described above, the embodiment controls a remaining amount of the wetting liquid based on a number of times wet wiping with the wetting liquid has been performed, and if the remaining amount exceeds a predetermined threshold value, the error is displayed and error processing for stopping the functions of the printer is performed. If the above error processing is not performed and printing is continued to be performed while the wetting liquid runs out, the ejection opening formed face of the printing head is damaged and thereby water repellency is significantly deteriorated, so that defective printing due to the deterioration of discharge condition arises. For example, because a user does not directly understand the cause of the defective printing, he/she may frequently repeat cleaning, or replace an ink tank by new one to thereby unnecessarily consume ink. On the other hand, appropriately performing the error processing according to the embodiment leads to the improvement of convenience for the user because the user can use the apparatus in a steady condition unless a number of sheets on durability is exceeded, and when the number of sheets on durability of the apparatus is reached, he/she can identify the apparatus condition based on the error display.

Embodiment 8

In the above Embodiment 7, there was described the process in which only when a remaining amount of the wetting liquid becomes 0%, the error is displayed and the functions of the printer are forcibly stopped. In addition to this, in the present embodiment, a warning is displayed at a stage where the remaining amount of the wetting liquid is left small, and the user is notified of information that the number of sheets on durability of the printer is about to be reached.

At the stage when a consumption rate of the wetting liquid reaches a first threshold value (defined as Th1 %) for a net amount after many times of wet wiping have been performed since the initial condition of the printer, the warning is issued to the user. Furthermore, at the stage when a second threshold value (defined as Th2 %) larger than the first threshold is reached, the error processing is performed and the printer is forcibly stopped. In the embodiment, the above first threshold value Th1 is set to 95%, and Th2 to 100%.

Accordingly, the number of times of wiping at the time when the consumption rate of the wetting liquid reaches the first threshold value Th1=95% becomes:

$$N_{th}1=20\times0.8\times95\%/(0.5/1000)=30400$$

That is, it follows that the 30400 times of wet wiping causes the wetting liquid to be consumed in an amount of 95%. The number of times of wiping N_Th1 at the time when the consumption rate of the wetting liquid reaches 95%, i.e., when a remaining amount of the wetting liquid reaches 5% of the Net amount, is defined as a threshold value for the warning for a remaining amount.

Also, the number of times of wiping at the time when the consumption rate of the wetting liquid reaches the second threshold value Th2=100% becomes:

$$N_Th2=20\times0.8\times100\%/(0.5/1000)=32000$$

That is, it follows that the 32000 times of wet wiping causes the wetting liquid to be consumed in an amount of 100%. The number of times of wiping N_Th2 at the time when the consumption rate of the wetting liquid reaches 100%, i.e., when a remaining amount of the wetting liquid reaches 0% of the Net amount, is defined as a threshold value for the error indicating no remaining amount.

Figure 29:
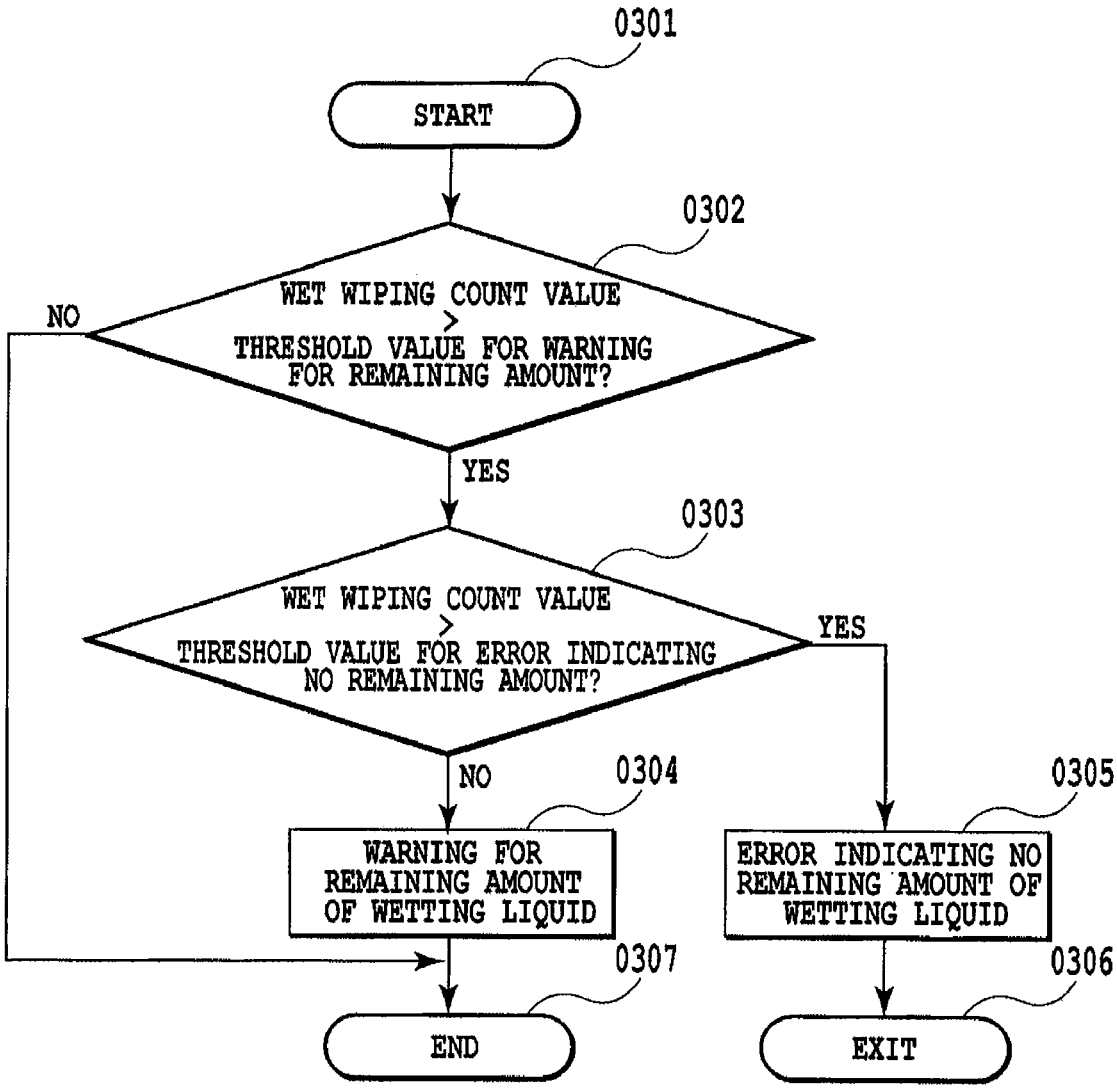
FIG. 29 is a flowchart illustrating a process for wet wiping according to Embodiment 8 of the present invention.

FIG. 29 is a flowchart showing a process for wet wiping in the embodiment. In the process, the warning or error displaying is performed based on a count value of the above number of times of wet wiping, and the threshold value for the warning for a remaining amount of the wetting liquid and for the error indicating no remaining amount. The process is performed every time immediately before wet wiping is performed. After the process has been started in step 0301, the wet wiping count value N, which is an accumulated number of times of wet wiping since the initial stage, and the threshold value for the warning for a remaining amount of the wetting liquid N_Th1 defined as above are compared with each other in step 0302. If the wet wiping count value N is equal to or less than the threshold value for the warning for a remaining amount of the wetting liquid N_Th1, the process proceeds to step 0307 without doing anything, where it is ended. If the wet wiping count value N is greater than the threshold value for the warning for a remaining amount of the wetting liquid N_Th1, it is further compared with the threshold value for the error indicating no remaining amount of the wetting liquid N_Th2 in step 0303. If the wet wiping count value N is equal to or less than the threshold value for the error indicating no remaining amount of the wetting liquid N_Th2, the warning for a remaining amount of the wetting liquid is performed in step 0304.

Regarding the warning for a remaining amount of the wetting liquid in the embodiment, a warning screen is displayed on a UI by the printer driver in the PC. However, it is not particularly required for the user to be interested in or know the remaining amount of the wetting liquid for wet wiping. Accordingly, a message indicating that the number of sheets on durability of the printer is about to be reached is displayed as show in FIG. 30. Then, the process proceeds to step 0307 without doing anything, where it is ended.

If it is determined that the wet wiping count value N is greater than the threshold value for the error indicating no remaining amount of the wetting liquid N_Th2 in step 0303, the error display is performed in step 0305, and the functions of the printer are stopped. Details of the process after step 0305 are the same as those in the above Embodiment 7.

As described above, according to the embodiment, the user can be further warned in advance of information that the number of sheets on durability is about to be reached, in addition to the operation in Embodiment 7. This enables convenience for the user to be further improved.

Embodiment 9

A ninth embodiment of the present invention manages three definition parameters of a waste ink capacity for holding ink discharged by a recovery process, and an ejection pulse count applied to an electro-thermal conversion element in the printing head, in addition to the remaining amount of the wetting liquid, which define a number of sheets on durability of the printing apparatus. Then, any of two types of wiping methods is selectively used depending on three count values (definition parameters).

As described in each of the above embodiments, there exists the remaining amount of the wetting liquid used in wet wiping as a factor for defining the number of sheets on durability of the printer. If the wetting liquid is sufficiently left, problems do not particularly arise during wiping; however, if the remaining amount of the wetting liquid is insufficient and thereby the effect of wet wiping cannot be produced, the ejection opening formed face of the printing head may be damaged. Furthermore, this causes the ejection to be unstable, leading to the deterioration in printing quality.

Meanwhile, as alternative means for addressing a problem of the variation in water repellency or hydrophilicity on the ejection opening formed face, there exists a technology of so-called pre-wetted wiping based on preliminary ejection, which is described in Japanese Patent Laid-Open Nos. 11-342620 (1999) and 2002-166560. This is a technology in which ink is ejected to a wiper from a printing head to wet a surface of the wiper, and then wiping is performed. This enables wiping performance to be improved.

Figure 31:
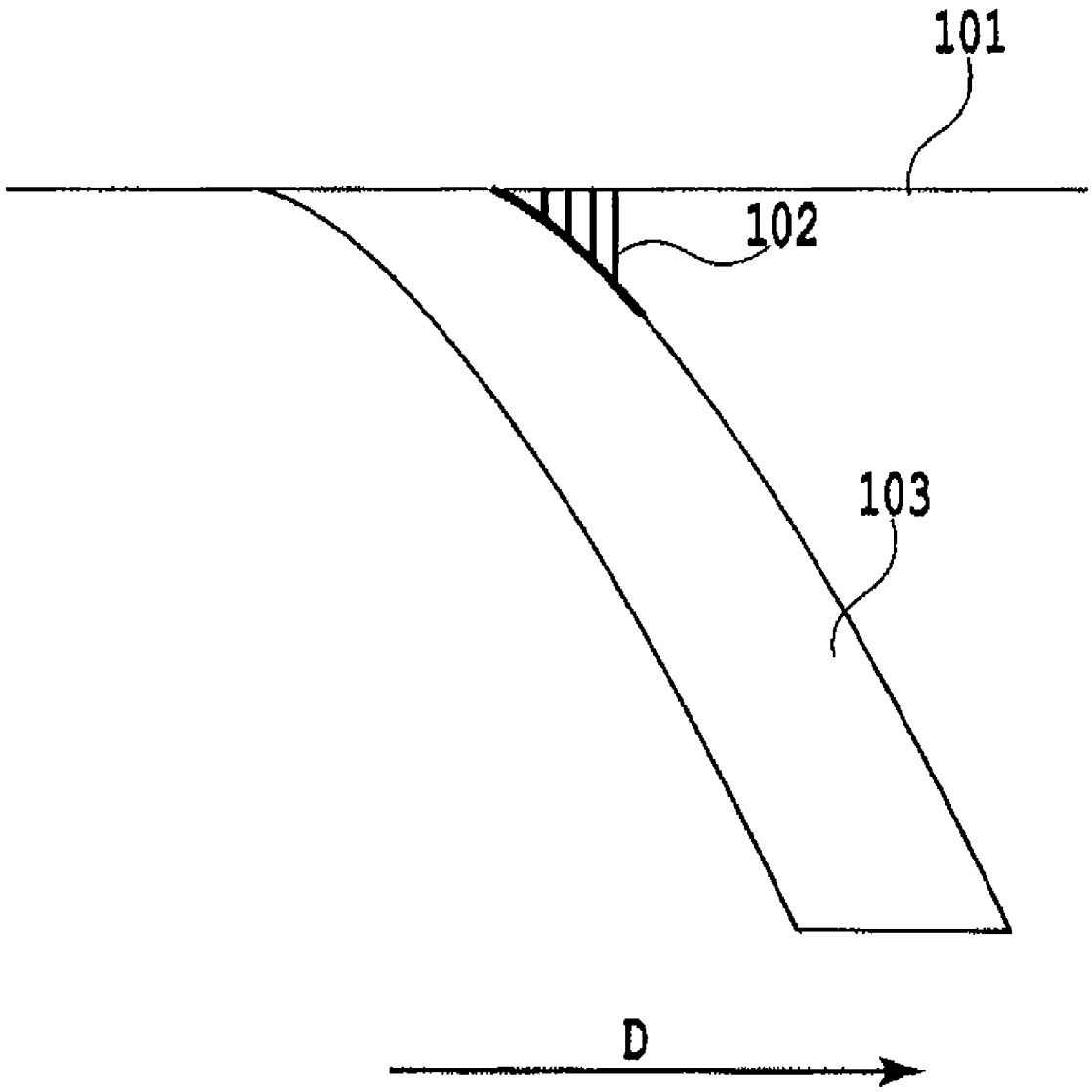
FIG. 31 is a view schematically illustrating a wiping operation according to Embodiment 9 of the present invention.

FIG. 31 is a view schematically illustrating a wiping operation. The wiper 103 moves in a direction indicated by an arrow D while coming into contact with the ejection opening formed face 101 of a printing head. Preliminary ejection 102 is performed in synchronization with the movement of the wiper 103 with cleaning of the ejection opening formed face. This allows an effect equivalent to that of the above-described wet wiping to be obtained. That is, instead of the wetting liquid, ink is attached to a surface of the wiper by the preliminary ejection, and wiping is adapted to be performed in wet condition. This enables wiping performance to be improved, as well as enabling the deteriorations in water repellency and hydrophilicity to be reduced.

However, in the pre-wetted wiping based on the preliminary ejection, the wiper itself or its peripheral members are attached with mist by the preliminary ejection, and fixation of the mist may adversely affect a wiping operation or wiping performance. Also, there exists a problem that the mist floats in the apparatus and thereby contamination within the apparatus is likely to occur. Furthermore, there exists another adverse effect of a high running cost because performing the preliminary ejection results in the unnecessary consumption of ink. Accordingly, completely replacing the wiping with the wetting liquid by only the pre-wetted wiping based on the preliminary ejection is not realistic.

Next, the waste ink capacity defining the number of sheets on durability of the ink-jet printing apparatus is now described. The waste ink produced by the suction recovery or the preliminary ejection is discharged to a waste ink processing member, where it is held. A capacity of the waste ink processing member is set to have a limit value the printing apparatus can process, on the assumption of an ordinary usage of the printing apparatus in addition to an evaporating amount of the waste ink processed within a predetermined time period. If the waste ink in an amount exceeding the limit value is attempted to be processed, an error is generated and the printing apparatus is brought into an unavailable condition. If the waste ink in an amount exceeding the limit value is processed, unabsorbed waste ink may leak out of the apparatus, causing an adverse effect of staining its periphery. Accordingly, the waste ink capacity is set, coupled with a margin, and the error is immediately generated and the functions of the printer are stopped so as not to produce the waste ink in an amount of exceeding an absorption capacity of the waste ink processing member. Regarding the waste ink amount, the number of times of suction and the number of times of preliminary ejection are all counted, and if the sum of them (which is defined as a waste ink count value) exceeds a predetermined threshold value, the waste ink error is issued and all of the functions of the printer are stopped.

Further, a pulse count in terms of durability of the printing head is described. The printing head used in the embodiment utilizes thermal energy generated by the electrothermal conversion element (heater) to eject ink as described above. The heater may be brought into an unstable ink ejection condition because continuing to providing the thermal energy causes the production of burnt deposits on a surface of the heater and surface modification, resulting in the deterioration of thermal conductivity near the heater. Furthermore, thermal stress given to the heater may cause the disconnection of the heater, bringing the printing head into a condition where no ejection can be performed. Such phenomena do not occur in the initial stage of the use of the printing head; however, with applying a considerable number of ejection pulses to the printing head, they gradually appear. A so-called permanent-type printing head in which one fixed printing head is used for an ink-jet printing apparatus should have durability appropriate for a number of sheets on durability of the ink-jet printing apparatus. However, an image to be printed depends on a user, i.e., an ejection pulse count applied to the printing head also depends on the user's usage. For this reason, the pulse count applied to the printing head is counted (which is defined as applied pulse count value), and if it exceeds a predetermined threshold value, a printing head error is issued and printing is stopped. Counting the applied pulse count for every ejection opening is not realistic because a load in terms of processing is too large in either case of software processing or hardware processing.

Therefore, an average applied pulse count value of all of the ejection openings is used for the control. In this case, the applied pulse count depends on each of the ejection openings, so that a threshold value for the applied pulse count value is set in consideration of a certain margin for a lifetime of the heater of the printing head.

As described above, as parameters defining the number of sheets on durability of the ink-jet printing apparatus, there exist the following three values. That is, they are: the wet wiping count value in which the number of times of wet wiping is counted; the waste ink count value for controlling an amount of waste ink; and the applied pulse count value in which a pulse count applied to the printing head is counted. A threshold value for each of them is set so as to meet the number of sheets on durability of the apparatus based on the assumption of normal usage of the ink-jet printing apparatus. For example, assume that the number of sheets on durability of the ink-jet printing apparatus in the embodiment is 10000 sheets in A4 document size. Also, assume that the user prints 10000 sheets of documents of which a printing duty is 15% for each color on average, as the user's usage. Furthermore, assuming that printing is performed onto an A4 printable area of 21×29.7 cm under a condition of a printing resolution of 1200 dpi×1200 dpi, details are as follows. If a resolution of the printing head in a sub scanning direction is 1200 dpi and the number of ejection openings is 512 for each color, the average applied pulse count per one ejection opening becomes $$(21\div2.54)\times(29.7\div2.54)\times1200\times1200\times0.15\times10000\div512=4.0\times10^8$$

Therefore, the threshold value for the applied pulse count value is set to 4.0×10^8. Also, regarding the waste ink count, an amount of waste ink produced by the suction and/or the preliminary ejection is estimated based on the assumption that ** sheets are printed per month on average, and the estimated value is set as the threshold value. Furthermore, regarding the wet wiping count value, the case where the wiping is performed for each of 10000 sheets corresponding to the number of sheets on durability is assumed as the case where wiping is performed a largest number of times. In this case, 10000 times is set as the threshold. Furthermore, as the waste ink count value, total amount of ink consumed by all of suction processes and preliminary ejection processes performed during the use of the ink-jet printing apparatus is calculated. The suction processes include a suction process performed at the time of replacement of an ink tank, and a suction process for periodically discharging air bubbles generated at the time of printing of a pattern with a high printing duty. Also, the preliminary ejection processes include a preliminary ejection process for preventing the ejection opening from being fixed when the wait is instructed during printing, and a preliminary ejection process for discharging mixed color ink flowing into the nozzle during the suction process. For example, assume that three types of suction processes, i.e., a suction process A, a suction process B, and a suction process C, cover all of the above suction processes, and corresponding suction amounts are a (mg), b (mg), and c (mg), respectively. Also, assume that the respective suction processes are performed x times, y times, and z times, respectively until 10000 sheets, the number of sheets on durability of the apparatus, are used up. In such a case, a total suction amount until 10000 sheets corresponding to the number of sheets on durability are used up becomes $a\times x+b\times y+c\times z$ (mg). Also, regarding the preliminary ejection processes, similarly assume that three types, i.e., a preliminary ejection process P, a preliminary ejection process Q, and a preliminary ejection process R, cover all of the above preliminary processes, and corresponding ink consumption amounts are p (mg), q (mg), and r (mg), respectively. Also, assume that the respective preliminary ejection processes are performed s times, t times, and u times, respectively. In such a case, a total preliminary ejection amount until 10000 sheets corresponding to the number of sheets on durability are used up becomes $p\times s+q\times t+r\times u$ (mg). Accordingly, the waste ink count value becomes $(a\times x+b\times y+c\times z)+(p\times s+q\times t+r\times u)$ (mg). Setting of the threshold value indicating when to issue the waste ink error according to the waste ink count value is determined based on a volume of a waste ink absorber provided in the printing apparatus main body, and an ink retention rate and an ink evaporation rate of the absorber. For example, if the volume of the absorber is 800 cc, the ink retention rate is 80%, and the evaporation rate is 60%, then $800\times0.8/0.6\times1000=1066667$ (mg) is the threshold value. If the threshold value is exceeded, the waste ink may not be fully absorbed by the absorber, causing an adverse effect of the overflow of the ink outside the apparatus, and therefore the error is issued and the functions of the printing apparatus are all stopped.

Figure 32:
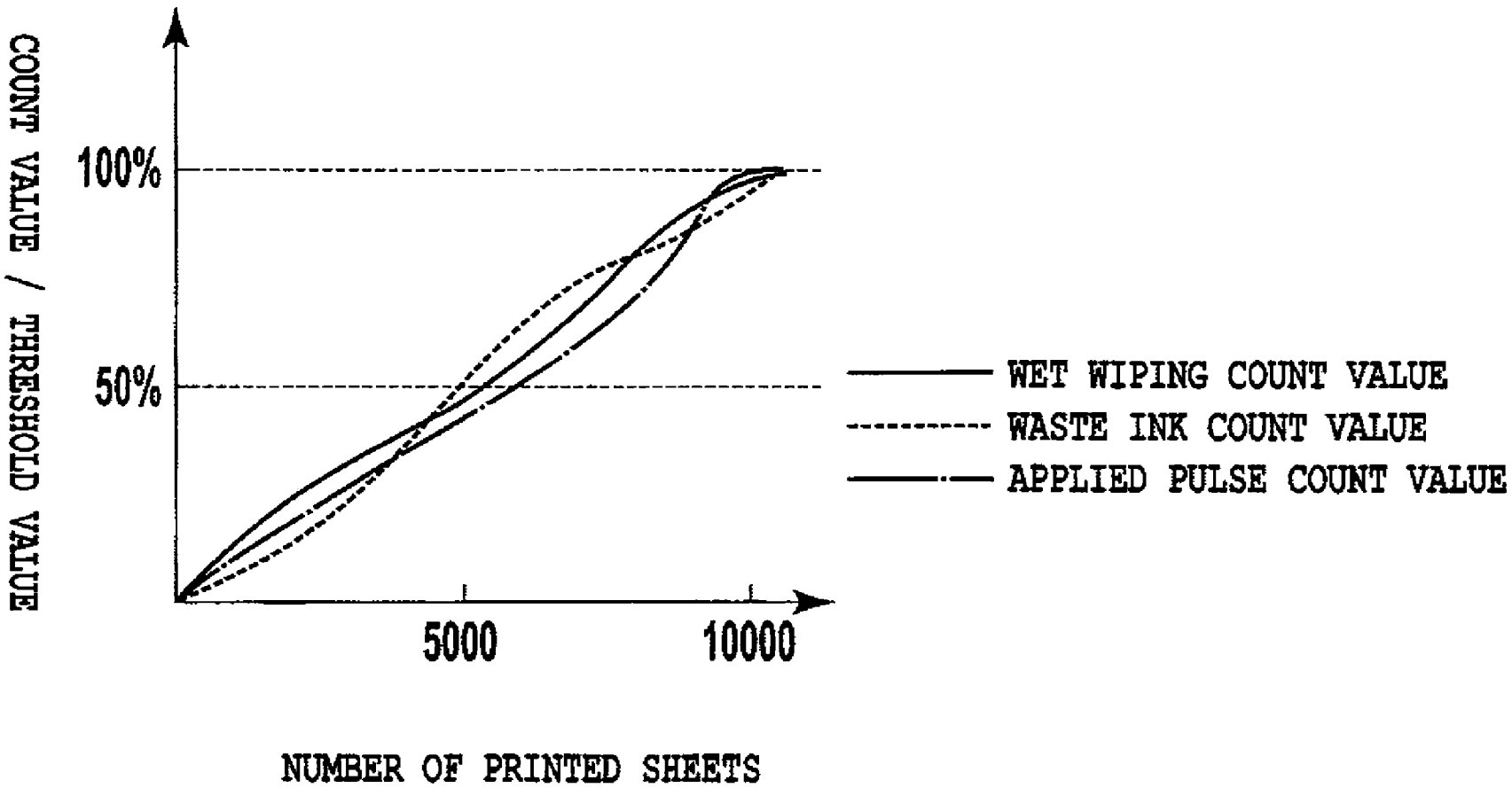
FIG. 32 is a graph schematically illustrating how count values of factors defining the number of sheets on durability develop with increasing the number of printed sheets, according to one embodiment of the present invention.

FIG. 32 is a graph schematically showing how the count values of the above three types of parameters defining the number of sheets on durability change with increasing the number of printed sheets. As shown in the figure, generally, each of the parameters increases averagely with respect to the threshold value having been set although it fluctuates slightly up and down depending on a usage of the printing apparatus.

Figure 33:
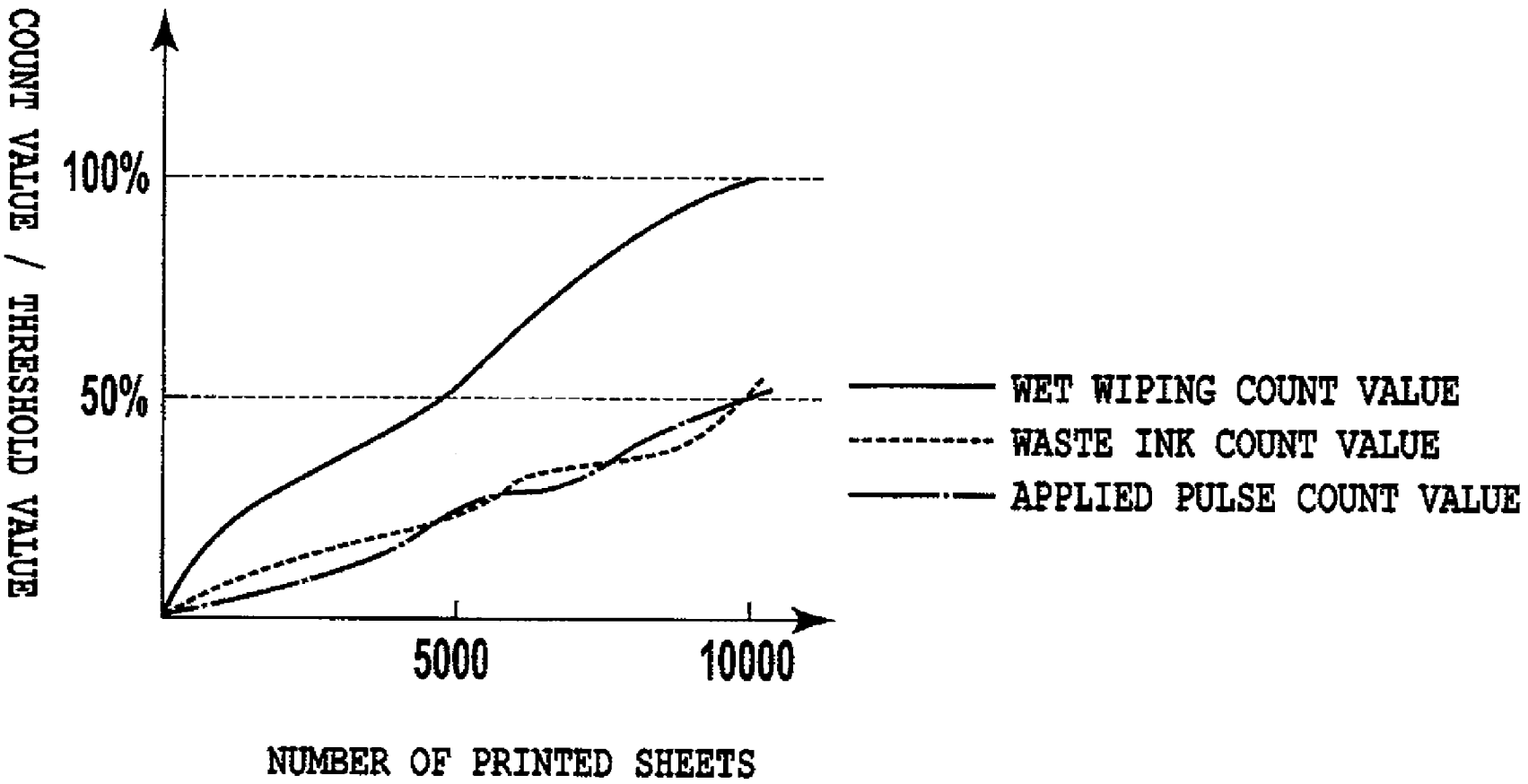
FIG. 33 is a graph illustrating the case where deviations arise in the developments of the factors in FIG. 32.

In contrast to this, FIG. 33 is a graph showing the case where deviations arise in the changes of the three types of parameters. An example shown in the figure represents the case where only the wet wiping count value reaches the corresponding threshold value faster, and the other two parameters exhibit relatively lower values than their corresponding threshold values. For example, in the case where patterns with a relatively low printing duty are often printed at low speed, i.e., in the condition that the number of applied pulse count is small, and a waste ink amount by the suction and the preliminary ejection is also small, wiping for preventing the ejection opening from drying during printing is performed every time each page is completed. In such a case, a situation shown in FIG. 32 appears.

Regarding the threshold values for the maximum pulse count to the printing head and the waste ink count, a relatively large adverse effect on performance and quality of the printing apparatus may occur if they are exceeded. Also, in such a case, there is no alternate means for compensating it, except for the replacement of the printing head or the waste ink absorber. Therefore, if these thresholds are exceeded, it is required to issue an error and stop the printing apparatus.

However, regarding wet wiping, performing the above-described pre-wetted wiping based on the preliminary ejection enables water repellency and hydrophilicity on the ejection opening formed face, which wet wiping originally intends to prevent, to be almost prevented from deteriorating even in the condition that the wetting liquid has used up. Also, performing the pre-wetted wiping based on the preliminary ejection for each of 10000 times of wiping based on the assumption that the number of sheets on durability is 10000 (sheets) may cause another adverse effect of contamination within the apparatus due to mist. However, even if wet wiping is replaced by the pre-wetted wiping based on the preliminary ejection for the last 1000 to 2000 sheets out of the 10000 sheets, the above adverse effect becomes almost a negligible level.

Figure 34:
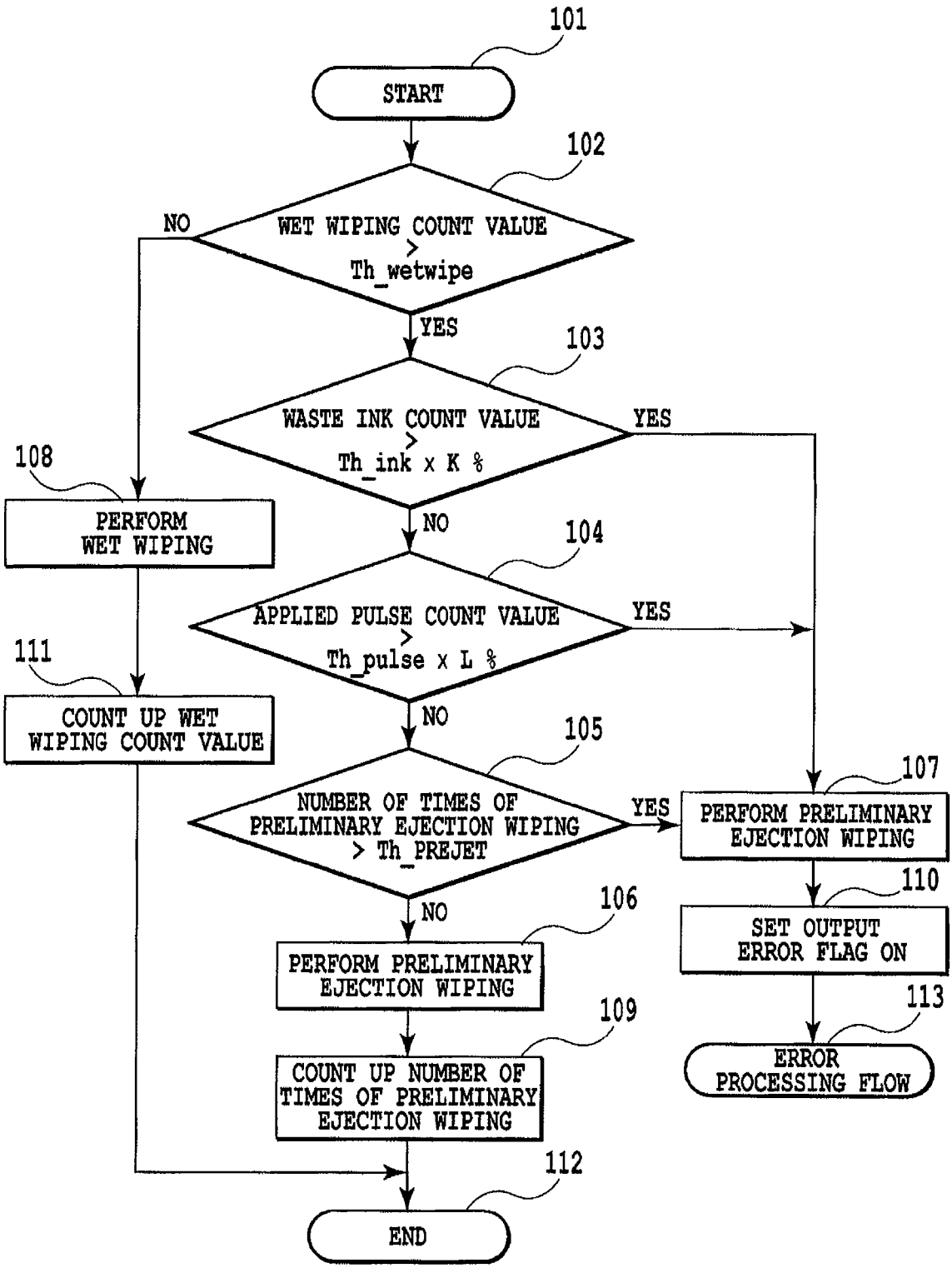
FIG. 34 is a flowchart illustrating a control for changing from wet wiping to pre-wetted wiping based on a preliminary ejection, depending on a remaining amount of the wetting liquid.

Accordingly, the embodiment performs a control so as to change from wet wiping to the pre-wetted wiping based on the preliminary ejection, depending on a remaining amount of the wetting liquid. FIG. 34 is a flowchart showing the corresponding process.

The process shown in the flowchart is started at timing when the wiping is performed in the ink-jet printing apparatus. In step 102, it is first determined whether the wet wiping count value exceeds the threshold value for wet wiping (defined as Th_wetwipe). If it is determined that the wet wiping count value is equal to or less than the threshold value, then wet wiping can be performed, i.e., the wetting liquid is considered to be sufficiently left and the process proceeds to step 108, where wet wiping is directly performed. On the other hand, if it is determined that the wet wiping count value exceeds the threshold value in step 102, then it is determined whether the waste ink count value exceeds the threshold value for the waste ink count (defined as Th_Ink) in an amount of a predetermined ratio of K % in step 103. If it exceeds a value of Th_Ink×K %, it can be estimated that the number of times of wet wiping reaches a considerable number of times, and also a waste ink amount reaches a considerable amount, so that it is determined that the number of sheets on durability is reached, and the error is output. Note that K % is adapted to set timing when the pre-wetted wiping based on the preliminary ejection is performed before the waste ink error is issued, with respect to a time point when wet wiping cannot be performed. K may be appropriately set, for example, if it is set to the same timing as a waste ink error output timing, then K=100%, or if some margin for the waste ink error is ensured, then K=90%.

However, even if it is determined that the error should be output in step 103, the pre-wetted wiping based on the preliminary ejection is performed once in step 107 because this process has been started as a timing when wiping is performed. Then, in step 110, a flag indicating the error output is set, and subsequently the process proceeds to step 113 of the error processing. The error processing flow is performed such that an appropriate sequence is performed depending on whether the error output flag is set in the above step 110, and then a printer error is issued and all of the functions are stopped, even though the error processing flow is not particularly described in detail.

If the waste ink count value is equal to or less than the value of Th_Ink×K % in step 103, then process proceeds to step 104. In step 104, it is determined whether the applied pulse count value exceeds the threshold value for the applied pulse count (defined as Th_pulse) in an amount of a predetermined ratio of L %. If it exceeds a value of Th_pulse×L %, not only the number of times of wet wiping, but also the applied pulse count to the printing head is estimated to reach a considerable number, so that it is determined that the number of sheets on durability is reached, and the error is output. Note that L % is adapted to set timing when the pre-wetted wiping based on the preliminary ejection is performed before the printing head error is issued, with respect to a time point when wet wiping cannot be performed. L may be appropriately set, for example, if it is set to the same timing as a printing head error output timing, then L=100%, or if some margin for the printing head error is ensured, then K=90%.

If the applied pulse count value is equal to or less than the value of Th_pulse×L % in step 104, then the process proceeds to step 105. In step 105, it is determined whether the number of times the pre-wetted wiping based on the preliminary ejection is performed is equal to or less than the corresponding threshold value (Th_prejet). If it is greater than the threshold value Th_prejet, then the pre-wetted wiping based on the preliminary ejection will be performed equal to or more than a predetermined number of times, which may cause an adverse effect such as contamination due to mist. For this reason, the process proceeds to step 107, where the pre-wetted wiping based on the preliminary ejection is performed only once, and then the error output flag is turned ON in step 110. Note that even if the pre-wetted wiping based on the preliminary ejection is performed once, no problem arises because the only one-time pre-wetted wiping does not lead to any critical adverse effect.

Furthermore, if the number of times of pre-wetted wiping based on the preliminary ejection is equal to or less than the threshold value Th_prejet in step 105, then the pre-wetted wiping based on the preliminary ejection is performed in step 106. Subsequently, in step 109, the number of times of pre-wetted wiping based on the preliminary ejection is counted up, followed by the end of the process in step 112.

Note that the threshold value Th_prejet is, as described above, set to approximately 1000 to 2000 times, i.e., to the number of times that is sufficient not to cause the mist contamination due the pre-wetted wiping based on the preliminary ejection.

As described above, according to the embodiment, even if a remaining amount of the wetting liquid used in wet wiping is decreased, it is possible to change to the pre-wetted wiping based on the preliminary ejection, which fulfills a function almost equivalent to that of wet wiping for a certain time period. This enables a user to use the ink-jet printing apparatus for a longer time.

Embodiment 10

A tenth embodiment of the present invention is characterized by using wet wiping in combination with the pre-wetted wiping based on the preliminary ejection for a certain time period.

As described above, the wetting liquid holding member employs a sponge made of PP fibers, and keeps negative pressure sufficient to hold the wetting liquid. However, there arises a large difference between initial negative pressure at which the wetting liquid is sufficiently impregnated and pressure at the time when the number of sheets on durability is about to be reached with decreasing remaining amount of the wetting liquid, because of an effect of a hydraulic head of the wetting liquid. For this reason, a transfer amount of the wetting liquid is slightly different between the initial stage and the later stage when the number of sheets on durability is about to be reached, i.e., the transfer amount at the initial stage tends to be slightly larger, whereas that at the later stage tends to be slightly smaller.

If a minimum requisite transfer amount is attempted to be ensured at a time point when the transfer amount reaches the minimum amount in the above case where the transfer amount of the wetting liquid gradually decreases with increasing the number of printed sheets, wet wiping will be aborted at a considerably earlier stage relative to a use up condition of the wetting liquid. That is, wet wiping will have to be aborted in the condition where the wetting liquid is considerably left. In contrast, if the minimum requisite transfer amount is attempted to be ensured at a time point when the number of sheets on durability (e.g., 10000 sheets) is reached, the wetting liquid has to be excessively held from the initial stage. For this reason, a capacity of the wetting liquid portion increases, leading to the increase in size of the printing apparatus itself.

Therefore, in the embodiment, additional pre-wetted wiping based on the preliminary ejection simultaneously with wet wiping is performed at a stage when the minimum requisite transfer amount becomes impossible to be ensured. This is characterized by keeping of a wet condition required for wiping.

Figure 35A:
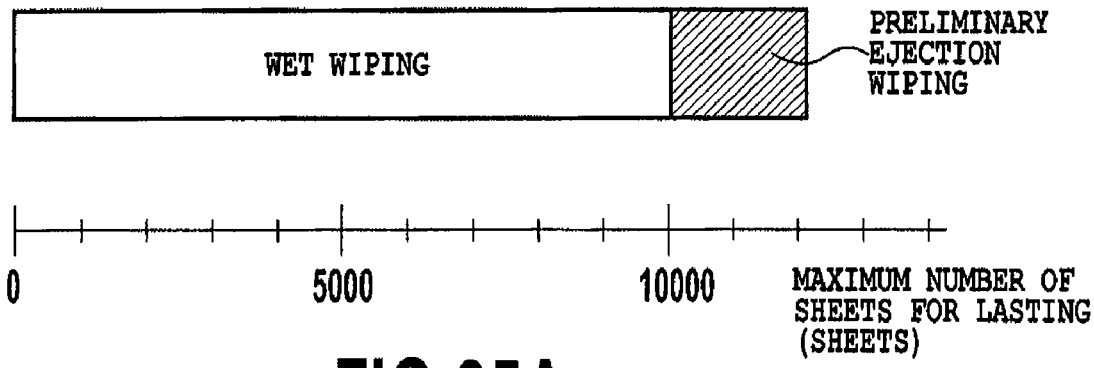
FIGS. 35A and 35B are diagrams schematically illustrating how the switching control between wet wiping and pre-wetted wiping based on the preliminary ejection is performed along with the development of the number of sheets on durability.
Figure 35B:
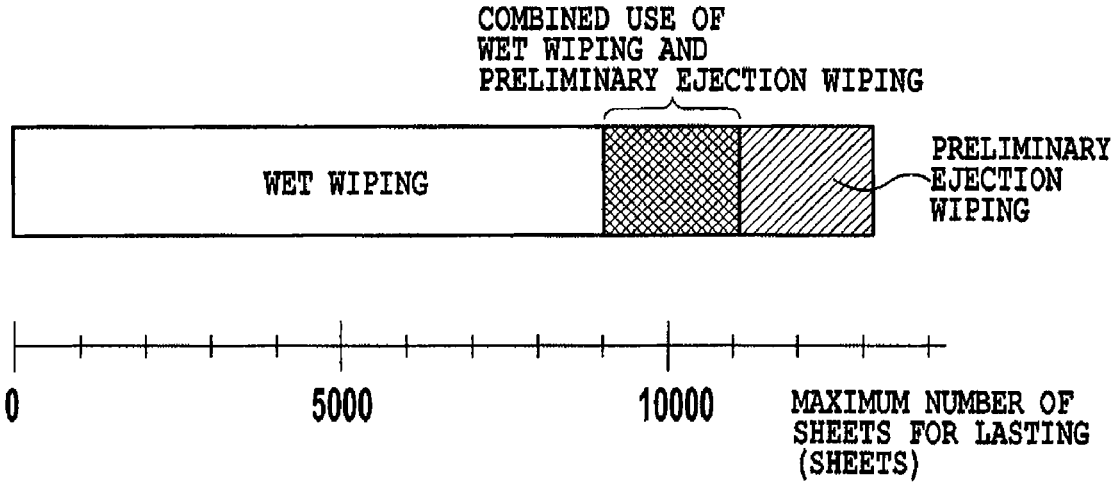

FIGS. 35A and 35B show graphs schematically showing how the switching control between wet wiping and the pre-wetted wiping based on the preliminary ejection is performed along with the variation of the number of sheets on durability. FIG. 35A shows a switching timing in the process of the above-described Embodiment 9. As shown in the figure, wet wiping is performed from the initial stage to the 10000th sheet, and after the 10000th sheet, the pre-wetted wiping based on the preliminary ejection is performed up to the 12000th sheet.

In contrast to this, FIG. 35B shows a switching timing of the wiping control according to the present embodiment. As shown in the figure, wet wiping is performed from the initial stage to the 9000th sheet, then at a time point of the 9000th sheet, the wiping control is changed to compensate the shortage of a transfer amount due to the wetting liquid decrease, and from the 9000th sheet to the 11000th sheet, the pre-wetted wiping based on the preliminary ejection is used in combination with wet wiping. During the combined use, it is only necessary for a preliminary ejection amount in the pre-wetted wiping based on the preliminary wiping to have a level sufficient to compensate the wiping by wet wiping. Therefore, only a relatively small preliminary ejection amount is sufficiently used. Furthermore, at a stage after the 11000th sheet, the wiping control is changed to the pre-wetted wiping based on the preliminary ejection only. The reason why the combined use region of wet wiping and the pre-wetted wiping based on the preliminary ejection exceeds the 10000th sheet that corresponds to the switching timing in Embodiment 9 is as follows. If a minimum requisite transfer amount of the wetting liquid (e.g., 1 mg) is attempted to be ensured only by wet wiping with the wetting liquid, the number of sheets on durability should be set to 10000 (sheets). On the other hand, a certain amount of transfer (e.g., 0.7 mg) can be practically performed even if the 10000th sheet is exceeded. Therefore, if the preliminary ejection can compensate a certain amount of the wetting liquid (0.3 mg in the above example) corresponding to the shortage due to wet wiping with the wetting liquid, further effective use of the wetting liquid becomes possible. This also enables a total number of sheets on durability (maximum number of sheets for lasting) to be increased.

As described above, according to the embodiment, wet wiping and the pre-wetted wiping based on the preliminary ejection are switched, and also used in combination. This enables a number of sheets on durability of the ink-jet printing apparatus to be further increased while meeting wiping performance required for reliability.

According to the above Embodiments 7 to 10, wastes of media and ink by a user who uses the apparatus in a use up condition of the wetting liquid and continues to use it while the ejection opening formed face of the printing head is damaged can be minimized.

Also, printing quality can be kept good even in the later stage when the number of sheets on durability is about to be reached. Furthermore, a volume of a tank for holding the wetting liquid does not have to be increased more than necessary, so that a number of sheets on durability can be increased while the increase in main body size is prevented.

Other Embodiments

In the above embodiments, there is described a configuration in which the wetting liquid is transferred to each of the three wipers; however, it should be appreciated that the application of the present invention is not limited to the configuration. For example, there may be employed a configuration in which the wetting liquid is transferred to only one or two of the three wipers. Also, the configuration itself comprised of the three wipers is not always necessary. For example, it is clear from the above description that the present invention can be applied to a configuration in which only one wiper is provided to which the wetting liquid is transferred.

Furthermore, in the above Embodiment 1 to 5 or Embodiment 9 or 10, there may be employed a configuration that when a remaining amount of the wetting liquid is small, the warning display indicating that the end of the apparatus life time is about to be reached, which is described in Embodiment 8, is performed in combination. Still furthermore, in Embodiment 1 to 5 or Embodiment 9 or 1, there may be employed a configuration that when the wetting liquid runs out, the error display indicating that a printing operation of the apparatus cannot be performed, which is described in Embodiment 7, is performed in combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-152690, filed May 31, 2006, which is hereby incorporated by reference herein in its entirety.

What is claimed is:

1. An ink jet printing apparatus which performs a wiping operation in which an ejection opening formed face of a print head for ejecting ink is wiped, said apparatus comprising:

a wiper to which a wetting liquid is transferred;

a holding portion for holding the wetting liquid;

a transfer portion disposed in said holding portion and subjected to be in contact with the wiper to transfer wetting liquid from the holding portion to the wiper;

detecting means for detecting a remaining amount of the wetting liquid held by said holding portion; and control means for controlling a contacting operation of said wiper to said transfer portion, said control means causing said wiper to contact said transfer portion over a first area when the remaining amount detected by said detecting means is equal to or greater than a predetermined amount, and causing said wiper to contact said transfer portion over a second area larger than the first area when the remaining amount detected by said detecting means is less than the predetermined amount.

2. An ink jet printing apparatus as claimed in claim 1, wherein said control means moves said transfer portion up and down to change the contact area of said wiper.

3. An ink jet printing apparatus as claimed in claim 1, wherein said control means rotates the transfer portion to change the contact area.

4. An ink jet printing apparatus as claimed in claim 1, further comprising notifying means for giving a user warning information, depending on the detected remaining amount.

5. A control method for an ink jet printing apparatus which performs a wiping operation in which an ejection opening formed face of a print head for ejecting ink is wiped with a wiper to which a wetting liquid is transferred, a holding portion for holding the wetting liquid, and a transfer portion disposed in said holding portion and subjected to be in contact with the wiper to transfer wetting liquid from the holding portion to the wiper, said method comprising:

a detection step of detecting a remaining amount of the wetting liquid in the holding portion; and a control step of causing said wiper to contact said transfer portion over a first area when the remaining amount detected by said detecting means is equal to or greater than a predetermined amount, and causing said wiper to contact said transfer portion over a second area larger than the first area when the remaining amount detected by said detecting means is less than the predetermined amount.

6. An ink jet printing apparatus comprising:

a wiper for wiping an ejection formed face of a print head;

a holding portion for holding a wetting liquid;

a transfer portion disposed in said holding portion and subjected to be in contact with the wiper to transfer wetting liquid from the holding portion to the wiper;

detecting means for detecting a remaining amount of the wetting liquid held by said holding portion; and control means for controlling a transfer operation in which said wiper is caused to contact with said transfer portion so that the wetting liquid held by said holding portion is transferred to said wiper, said control means causing said wiper to contact said transfer portion over a first area when the remaining amount detected by said detecting means is equal to or greater than a predetermined amount, and causing said wiper to contact said transfer portion over a second area larger than the first area when the remaining amount detected by said detecting means is less than the predetermined amount.

* * * * *